US011873825B2

(12) United States Patent
Liu et al.

(10) Patent No.: US 11,873,825 B2
(45) Date of Patent: Jan. 16, 2024

(54) PORTABLE BLOWING DEVICE

(71) Applicant: Shenzhen Lanhe Technologies Co., Ltd., Shenzhen (CN)

(72) Inventors: Kai Liu, Guangdong (CN); Xunhuan Wu, Guangdong (CN); Guang Yang, Guangdong (CN); Weiping Li, Guangdong (CN); Quan Lv, Guangdong (CN); You Lai, Guangdong (CN); Jun Zhu, Guangdong (CN); Tong Li, Guangdong (CN)

(73) Assignee: SHENZHEN LANHE TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 18/169,216

(22) Filed: Feb. 15, 2023

(65) Prior Publication Data

US 2023/0193910 A1 Jun. 22, 2023

Related U.S. Application Data

(63) Continuation of application No. 17/717,144, filed on Apr. 11, 2022, now Pat. No. 11,624,370, and a (Continued)

(30) Foreign Application Priority Data

Oct. 9, 2019 (CN) ..... 201921684168.3
Jan. 18, 2020 (CN) ..... 202020122560.5
(Continued)

(51) Int. Cl.
*F04D 25/08* (2006.01)
*F04D 25/16* (2006.01)
(Continued)

(52) U.S. Cl.
CPC ..... *F04D 25/084* (2013.01); *F04D 17/162* (2013.01); *F04D 25/166* (2013.01); *F04D 29/281* (2013.01); *F04D 29/4226* (2013.01)

(58) Field of Classification Search
CPC .... F04D 17/162; F04D 25/084; F04D 25/166; F04D 29/281; F04D 29/4226
See application file for complete search history.

(56) References Cited

U.S. PATENT DOCUMENTS 5,304,035 A * 4/1994 Carter ..... F04D 25/084 362/108
5,802,865 A * 9/1998 Strauss ..... A61F 7/10 62/259.3
(Continued)

FOREIGN PATENT DOCUMENTS

CN 202040104 U * 11/2011
CN 104728130 A * 6/2015
(Continued)

*Primary Examiner* — Alexander B Comley
(74) *Attorney, Agent, or Firm* — Andrew C. Cheng

(57) ABSTRACT

A portable blowing device configured for being worn around a neck of a human body, includes two arms each defining an airflow channel therein; and fans received in the arms respectively. The arm includes an inner side wall close to the neck and an outer side wall connected to the inner side wall. The arm includes an air inlet and an air outlet in communication with the airflow channel respectively. The air inlet is arranged at the inner side wall and/or the outer side wall. The fan is configured to generate an airflow passing through the air inlet, the airflow channel and the air outlet in sequence.

19 Claims, 30 Drawing Sheets

Related U.S. Application Data continuation-in-part of application No. 17/315,274, filed on May 8, 2021, and a continuation-in-part of application No. PCT/CN2021/072345, filed on Jan. 16, 2021, and a continuation-in-part of application No. PCT/CN2020/089050, filed on May 7, 2020, and a continuation-in-part of application No. PCT/CN2020/089049, filed on May 7, 2020, and a continuation-in-part of application No. PCT/CN2019/123073, filed on Dec. 4, 2019.

(30) Foreign Application Priority Data

| | | |
|---|---|---|
| Jan. 19, 2020 | (CN) | 202020122804.X |
| Jan. 19, 2020 | (CN) | 202020135409.5 |
| May 13, 2020 | (CN) | 202020796618.4 |
| Aug. 25, 2020 | (CN) | 202021804208.6 |
| Dec. 31, 2020 | (CN) | 202011641197.9 |
| Dec. 20, 2021 | (CN) | 202123206726.5 |
| Mar. 10, 2022 | (CN) | 202220549967.5 |

(51) Int. Cl.

| | |
|---|---|
| ***F04D 29/42*** | (2006.01) |
| ***F04D 17/16*** | (2006.01) |
| ***F04D 29/28*** | (2006.01) |

(56) References Cited

U.S. PATENT DOCUMENTS

| | | | | |
|---|---|---|---|---|
| 6,189,327 | B1 * | 2/2001 | Strauss | A41D 13/0025 62/259.3 |
| 6,666,647 | B1 * | 12/2003 | Trask | F04D 25/08 416/246 |
| 6,682,552 | B2 * | 1/2004 | Ramsden | A61F 7/10 607/114 |
| 6,955,524 | B2 * | 10/2005 | Stengel | F24F 7/007 415/129 |
| 7,828,524 | B2 * | 11/2010 | Chen | F04D 25/084 415/206 |
| 8,684,661 | B2 * | 4/2014 | Horng | F04D 17/04 415/99 |
| 9,458,857 | B2 * | 10/2016 | Yang | F04D 17/162 |
| 9,655,278 | B2 * | 5/2017 | Wu | F04D 17/04 |
| 10,436,217 | B2 * | 10/2019 | Aiello | F04D 29/4213 |
| 10,709,601 | B2 * | 7/2020 | Adair | A61F 7/02 |
| 2001/0003907 | A1 * | 6/2001 | Siman-Tov | A62B 17/005 2/458 |
| 2008/0226446 | A1 * | 9/2008 | Fujieda | F04D 29/281 415/203 |
| 2010/0198322 | A1 * | 8/2010 | Joseph | A61F 7/007 607/108 |
| 2011/0259028 | A1 * | 10/2011 | Lee | A61F 7/0085 165/59 |
| 2012/0128486 | A1 * | 5/2012 | Lin | F04D 17/16 415/224 |
| 2013/0089425 | A1 * | 4/2013 | Wu | F04D 17/162 416/198 R |
| 2014/0099197 | A1 * | 4/2014 | Chen | F04D 29/4226 415/206 |
| 2014/0127024 | A1 * | 5/2014 | Yang | F04D 29/30 416/211 |
| 2017/0241443 | A1 * | 8/2017 | Takashima | F04D 29/703 |
| 2017/0266038 | A1 * | 9/2017 | Peavy | A41D 13/0053 |
| 2017/0370596 | A1 * | 12/2017 | Lee | A41D 20/005 |
| 2019/0136866 | A1 * | 5/2019 | Kedelty | F04D 29/30 |
| 2020/0187574 | A1 * | 6/2020 | Te Hsiang | A41D 13/0053 |

FOREIGN PATENT DOCUMENTS

| | | | | | |
|---|---|---|---|---|---|
| CN | 105626555 | A | * | 6/2016 | |
| CN | 206386293 | U | * | 8/2017 | |
| CN | 209594925 | U | * | 11/2019 | |
| CN | 111120369 | A | * | 5/2020 | F04D 25/08 |
| CN | 210531205 | U | * | 5/2020 | |
| CN | 210829801 | U | * | 6/2020 | |
| CN | 211474489 | U | * | 9/2020 | |
| CN | 110566482 | B | * | 10/2020 | |
| CN | 211692897 | U | * | 10/2020 | F04D 25/08 |
| JP | 2008286014 | A | * | 11/2008 | |
| JP | 2019105266 | A | * | 6/2019 | |
| KR | 1446609 | B1 | * | 10/2014 | A41D 13/0025 |
| KR | 101905697 | | * | 10/2018 | |
| KR | 2019041795 | A | * | 4/2019 | F04D 25/10 |
| KR | 2047027 | B1 | * | 11/2019 | F04D 25/084 |
| WO | WO-2005068846 | A1 | * | 7/2005 | F04D 25/08 |
| WO | WO-2007094578 | A2 | * | 8/2007 | F04D 17/105 |
| WO | WO-2018075635 | A1 | * | 4/2018 | F04D 17/162 |
| WO | WO-2019045212 | A1 | * | 3/2019 | F04D 25/06 |
| WO | WO-2019093567 | A1 | * | 5/2019 | F04D 25/08 |

* cited by examiner

PORTABLE BLOWING DEVICE

CROSS REFERENCE TO RELATED APPLICATIONS

This application is a continuation of application Ser. No. 17/717,144 filed on Apr. 11, 2022, which is a continuation-in-part of International Patent Applications 1) No. PCT/CN2020/089050, filed on May 7, 2020, which claims priority of China Patent Application No. 202020135409.5, filed on Jan. 19, 2020, 2) PCT/CN2020/089049, filed on May 7, 2020, which claims priority of China Patent Application No. 202020122804.X, filed on Jan. 19, 2020, 3) PCT/CN2021/072345, filed on Jan. 16, 2021, which claims priority of China Patent Application No. 202020122560.5, filed on Jan. 18, 2020, and 4) PCT/CN2019/123073 filed on Dec. 4, 2019, which claims priority of China Patent Application No. 201921684168.3, filed on Oct. 9, 2019. This application claims priority of China Patent Application No. 202123206726.5, filed on Dec. 20, 2021. This application claims priority of China Patent Application No. 202220549967.5, filed on Mar. 10, 2022. This application is a continuation-in-part of application Ser. No. 17/315,274 filed on May 8, 2021, which claims priority of China Patent Application Nos. 202020796618.4, 202021804208.6 and 202011641197.9. The contents of the above-identified applications are incorporated herein by reference.

TECHNICAL FIELD

The present disclosure relates to the technical field of cooling devices, in particular to a portable blowing device.

BACKGROUND

With people's growing request for a more convenient life in recent years, various portable fans such as neck fans have appeared in the market to meet the needs in outdoor activities or other life scenes. Neck fans cancel the activity limitation of hand-held fans. Whether it is during exercise and outdoor activities or in the office, neck fans can achieve the effect of blowing air anytime and anywhere while freeing users' hands.

An existing neck fan usually comprises an arc-shaped body for wearing on the neck of a human body and two fans connected to opposite ends of the arc-shaped body to supply airflow. The fan comprises a mesh cover and axial fan blades arranged in the mesh cover. Due to the fans being exposed outside of the arc-shaped body and the relatively large size of the air inlet holes and outlet holes of the mesh cover, the problem of twisting hair is prone to occur when users use it, thus affecting the safety of users. Furthermore, this kind of neck fan can only blow air toward the user's face but not toward the user's neck, which results in excessive sweating being accumulated on the neck of the user due to the high temperature in hot summer and affects the user experience.

BRIEF SUMMARY OF THE INVENTION

It is desired to provide an improved portable blowing device.

In one aspect, the present disclosure provides a portable blowing device which includes two arms each defining an airflow channel therein; and fans received in the arms respectively. The arm comprises an inner side wall close to the neck when the device is worn around the neck and an outer side wall connected to the inner side wall. The arm includes an air inlet and an air outlet in communication with the airflow channel respectively. The air inlet is arranged at the inner side wall and/or the outer side wall.

In some embodiments, the arm further comprises a top wall and a bottom wall, and the inner side wall and the outer side wall are connected between the top wall and the bottom wall respectively.

In some embodiments, the arm further comprises an end wall connecting the inner side wall and outer side wall.

In some embodiments, the air inlet is defined in each of the inner side wall and the outer side wall, the fan comprises a pair of air intake sides opposite to each other, and the pair of air intake sides faces the air inlets respectively.

In some embodiments, a protective cover is covered on the air inlet, and a gap communicating the air inlet with outside is formed between the protective cover and the outer surface of the arm.

In some embodiments, the fan defines an axial direction, and the protective cover completely covers the air inlet in the axial direction of the fan. That is, the periphery of the protective cover extends beyond the periphery of the air inlet.

In some embodiments, a plurality of ribs is provided in the air inlet to divide the air inlet into a plurality of air inlet openings communicated with the gap.

In some embodiments, the air inlet and the protective cover are arranged at the outer side wall.

In some embodiments, the arm comprises a mounting section, the air inlet is arranged around the mounting section, and the fan is mounted to the mounting section.

In some embodiments, a protective cover is covered on the air inlet, the protective cover defining through holes communicated with the air inlet.

In some embodiments, a plurality of ribs is provided in the air inlet to divide the air inlet into a plurality of air inlet openings communicated with the ventilation holes.

In some embodiments, the fan comprises a hub and a blade unit around the hub, and a driving device is installed in the hub for driving the hub and the blade unit to rotate.

In some embodiments, the blade unit comprises an annular connecting plate around the hub, a first blade group and a second blade group respectively arranged at inner and outer sides of the annular connecting plate.

In some embodiments, the annular connecting plate is arranged around and spaced from the hub, a plurality of spokes being connected between the annular connecting plate and the hub.

In some embodiments, an end of the blade unit is flushed with an end surface of the hub or a recess is formed between the end surface of the hub and the end of the blade unit. Specifically, the blade unit comprises multiple blades, ends of the blades are flushed with an end surface of the hub or the ends of the blades extend beyond the end surface of the hub in the axial direction of the fan.

In some embodiments, each arm comprises a receiving chamber in which one of the fans is received, the receiving chamber is in communication with the air inlet and the airflow channel, a gap is formed between an inner surface of a sidewall of the receiving chamber and said one of the fans, and the gap increases gradually from an end thereof to the other end thereof or the gap has an unequal width at opposite ends thereof.

In some embodiments, the portable blowing device further comprises a connecting section, the two arms each comprises a connecting end connected to an end of the connecting section, and a cap is secured to the connecting end of the arm or the end of the connecting section.

In some embodiments, a space is provided inside the arm and located at the discharge side of the fan, a windshield is provided in the space for guiding an airflow generated by the fan to the air outlet.

In some embodiments, a partition plate is arranged within an interior space of the arm to form the airflow channel and a cavity, the airflow channel extending along a lengthwise direction of the arm such that a cross section area of the airflow channel reduces gradually in a direction from an end of the airflow channel close to the fan to the other end of the airflow channel away from the fan.

In some embodiments, the portable blowing device further comprises another fan disposed between the fans, wherein the body defines another air inlet facing an air intake side of said another fan.

In some embodiments, the body comprises a connecting section and the arms are connected to opposite ends of the connecting section respectively, a connecting end of the arm connected to the connecting section is provided with a recessed portion sunken relative to other portions of the connecting end around the recessed portion, and a cap is secured to the recessed portion.

In some embodiments, each arm comprises an airflow channel corresponding to the fan, the airflow channel extends along a lengthwise direction of the arm, each arm defines at least two rows of air outlets each communicating the airflow channel with outside of the arm, each row of air outlets being arranged along the lengthwise direction of the arm.

In some embodiments, the portable blowing device further comprises a temperature regulation device disposed within the arm and a thermal conductive member arranged on an inner side wall of the arm, wherein the thermal conductive member is exposed to outside the arm and in thermal conductive connection with the temperature regulation device, the temperature regulation device and the thermal conductive member being located between the fans.

In some embodiments, the device further comprises a connecting section and two arms are connected to opposite ends of the connecting section, the connecting section is deformable to allow the arms to be moved away from each other by an external force and restorable to drive the arms to move toward each other after the external force is withdrawn.

In some embodiments, the connecting section comprises a restorable and flexible sleeve in which reinforcing members are arranged at intervals, the sleeve comprises an inner side wall for facing the portion of the human body and an outer side wall opposite to the inner side wall, the reinforcing member comprising an inner portion connected to the inner side wall of the sleeve and an outer portion connected to the outer side wall of the sleeve.

In some embodiments, the portable blowing device comprises two said thermal conductive members respectively mounted to the inner side walls of the two arms, each said thermal conductive member is arc-shaped and comprises a first end portion close to the connecting section and a second end portion away from the connecting section; the portable blowing device defines an initial state at which the connecting section is located at its original state; when the portable blowing device is at the initial state, a distance between the two said thermal conductive members first increases and then decreases in a direction from the first end portion to the second end portion.

In another aspect, the present application further provides a portable blowing device which comprises two arms arranged opposite to each other, each arm defining an airflow channel therein, the arm comprising a side wall extending along a lengthwise direction thereof and an end wall connected to an end of the side wall, the side wall defining an air inlet and an air outlet in communication with the airflow channel respectively; and a centrifugal fan accommodated within each of the arms and configured to generate an airflow passing through the air inlet, the airflow channel and the air outlet in sequence.

DETAILED DESCRIPTION OF THE INVENTION

Figure 1:
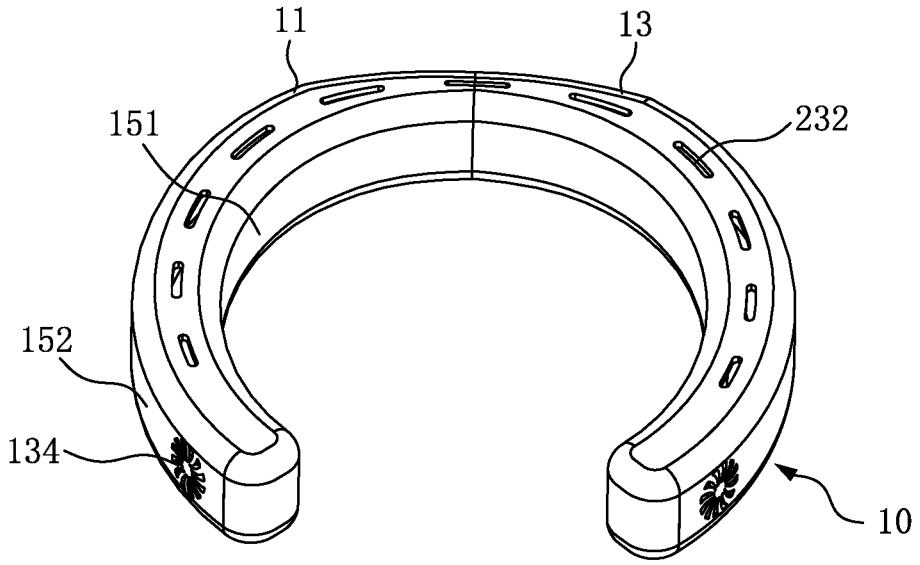
FIG. 1 is a perspective assembled view of a portable blowing device according to Embodiment 1 of the present disclosure.
Figure 2:
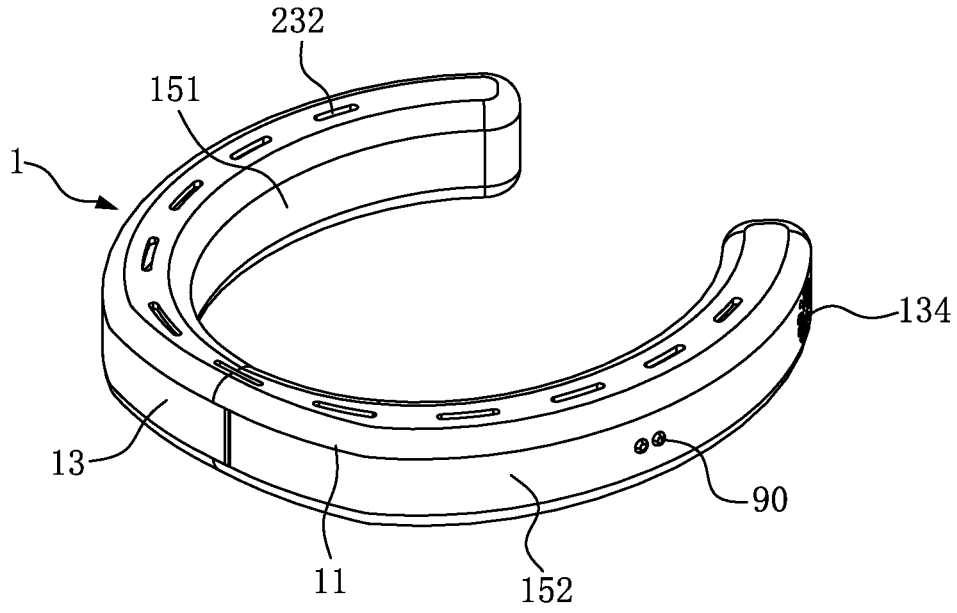
FIG. 2 is similar to FIG. 1 but viewed from another aspect.
Figure 3:
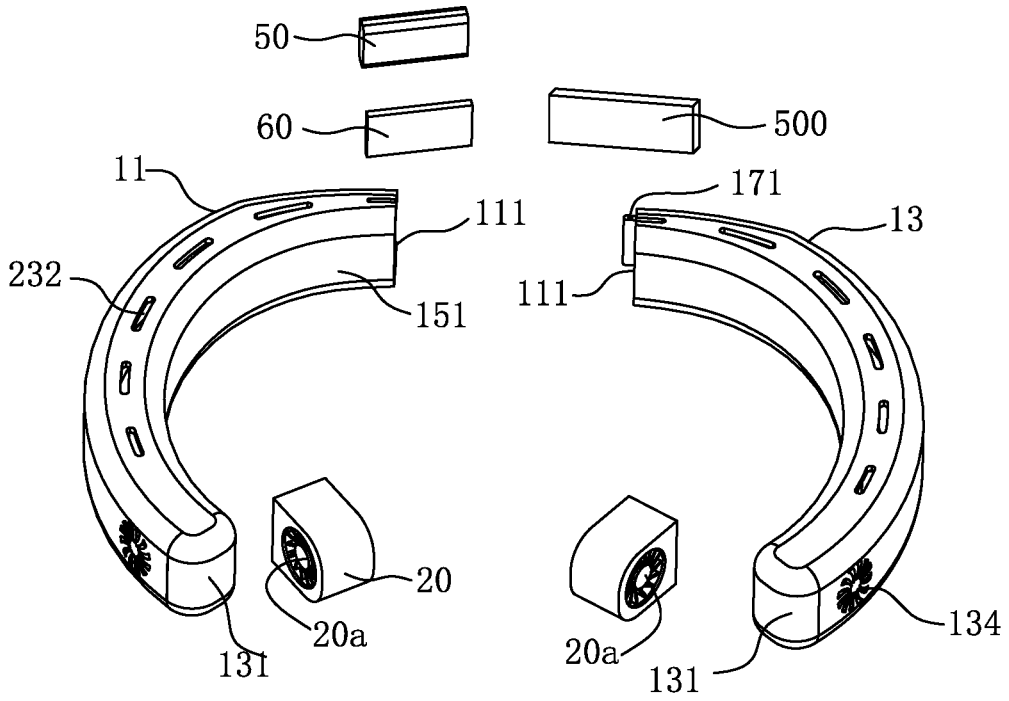
FIG. 3 is a partially exploded view of FIG. 1.

In order to further explain the technical means and efficacy adopted by the present disclosure to achieve the intended purpose of the present disclosure, the specific implementation mode, structure, characteristics and efficacy of a portable blowing device according to the present disclosure are described in detail as follows with reference to the attached drawings and preferred embodiments.

Embodiment 1

As shown in FIG. 1 to FIG. 4, a portable blowing device for example a neck fan in accordance with a first embodiment of the present disclosure comprises a body 10 for being hung on the neck of a human body and fans 20 disposed in opposite end portions of the body 10. The body 10 is of a curved configuration and preferably of an arcuate shape that is ergonomically designed. One or multiple airflow channels 231 are provided in the body 10 and are arranged along a lengthwise direction of the body 10 (i.e., a circumference direction of the neck). The body 10 defines one or multiple air outlets 232 and one or multiple air inlets 134. The air outlets 232 are arranged along the lengthwise direction of the body 10 and communicated with the corresponding airflow channels 231. The air inlets 134 are in communication with the corresponding airflow channels 231. The fans 20 are arranged at positions facing the air inlets 134 and driven by electric motors to generate airflows. Airflows generated by the fans 20 are capable of entering the airflow channels 231 via the air inlets 134 and then exiting the airflow channels 231 via the air outlets 232. In the present embodiment, the fan 20 is a centrifugal fan which draws air in in a first direction and discharges air out in a second direction perpendicular to the first direction. The fan 20 comprises an air intake side 20*a* through which air is forced into the fan 20 and an air discharge side 20*b* through which the air is discharged from the fan 20. The air discharge side 20*b* is perpendicular to the intake side 20*a*. The fan 20 defines an axial direction extending along its rotation axis (for example the rotation axis of the impeller) and the axial direction is oriented to the intake side. The air intake side of the fan 20 is oriented to the corresponding air inlet 134 and the air discharge side of the fan 20 is orientated to the corresponding airflow channel 231 so that the fan 20 is capable of blowing air into the airflow channel 231 from the air inlet 134.

The body 10 comprises a bottom side wall, a top side wall opposite to the bottom side wall, an inner side wall 151 and an outer side wall 152 connected between the bottom side wall and the top side wall. The inner side wall 151 is close to the neck of the human body while the outer side wall 152 is distant from the neck of the human body. The body 10 further comprises a pair of end walls at opposite ends thereof. The end walls are respectively connected to ends of the top wall, bottom wall, inner side wall and outer side wall. In the present embodiment, the air outlets 232 may be arranged at the bottom side wall, top side wall and/or inner side wall 151 of body 10 so that the fans 20 are capable of blowing air toward the neck of the user effectively to avoid sweat being accumulated at portions of the body contacting with the neck of the user.

In the present embodiment, the air out 232 of the body 10 comprises a plurality of discrete air outlet openings arranged along the lengthwise direction of the body 10. The air outlet openings are disposed at the top side wall of the body 10 which is oriented toward the neck of the user. Cooling air can be drawn by the fans 20 into the airflow channels 231 of the body 10 via the air inlets 134, discharged from the airflow channels 231 via the air outlets 232 and blown to the neck of the user to thereby cool the neck of the user. Optionally, the air outlets 232 may be arranged on both the top side wall and the inner side wall 151. Specifically, the air outlets 232 start from the top wall and end at the inner side wall; or the top side wall and the inner side wall are provided with independent air outlet openings respectively. Optionally, the bottom side wall of the body adjacent to the shoulders of the user may be provided with some of the air outlets so that the fans 20 are capable of blowing air toward the shoulders of the user. The air outlet opening may be an elongated slot/groove or a round hole. The shape of the air outlet opening is not limited here.

Optionally, the air outlet 232 comprises one single elongated air outlet opening extending along the lengthwise direction of the body. That is, the air outlet is an elongated opening extending from one end of the body to the other end of the body.

In some embodiments, the body 10 is provided with a controller, a detection device (not shown), a temperature regulation device 500, a battery 50 and a switch 90. Specifically, the temperature regulation device 500 is a semiconductor temperature regulation plate configured to cool or heat the air inside the airflow channel 231. The semiconductor temperature regulation plate comprises a cold end surface and a hot end surface opposite to the cold end surface. The switching between cooling and heating modes can be realized by changing the polarity of the voltage applied on opposite end surfaces of the temperature regulation device 500. The controller is configured to control the temperature of the cold or hot end surfaces of the temperature regulation sheet 500. The detection device is configured to detect the temperature of the air inside the airflow channel 231 and send a detected signal to the controller so that the controller is capable of controlling the temperature adjustment device 500 to adjust the temperature of the air in the airflow channel 231. When it is detected that the temperature of the air inside the airflow channel 231 is greater than or less than a preset threshold, the controller automatically adjusts the cooling or heating temperature of the semiconductor temperature regulation sheet 500 to thereby adjust the temperature of the air in the airflow channel 231.

The battery 50 is electrically connected to the fan 20. A control signal can be sent to the controller by operating the switch 90, and the controller is capable of controlling the working state of the fan 20 and the temperature adjusting device 500 in response to the control signal. Specifically, the switch 90 is configured to adjust operation of both the temperature adjustment device 500 and the fan 20, or to adjust operation only one of the temperature adjustment device 500 and the fan 20. The battery 50 is a rechargeable battery 50 or a disposable battery 50 built into the main body 10, and the switch 90 is disposed on the outer side wall 152 of the body 10. Preferably, the body 10 is further provided with a battery heat insulation sheet 60 for preventing heat generated by the battery 50 from being transferred to the neck of the user. Specifically, the battery heat insulation sheet 60 made of heat nonconductive material is disposed between the battery 50 and the inner side wall 151 of the body 10 to isolate heat conduction from the battery 50 to the inner side wall 151 of the body 10, thereby preventing heat generated by the battery 50 from being transferred to the neck of the user via the inner side wall 151 of the body 10.

In some other embodiments, the temperature adjustment device 500 may be a heat generating member configured to heat the air in the airflow channel 231. When air drawn from outside of the body 10 into the airflow channel 231 by the fan 20, the air becomes hot air after being heated by the heating member and the hot air is then brown out toward the neck of the user to achieve the effect of heating the neck of the user, which is suitable for use in cold weather. The heat generating member can adopt a plurality of fins and two adjacent fins form therebetween a channel through which air can pass.

It is understood that the user can selectively turn on or off the temperature adjustment device 500. When the temperature adjustment device 500 is turned off, the temperature adjustment device 500 is disconnected from the circuit and the portable blowing device only realizes the blowing function of the fan 20.

In this embodiment, the body 10 includes a first arm 11 and a second arm 13 that are connected to each other. The first arm 11 and the second arm 13 each have a connection end 111 and a free end 131. The connection ends 111 of the first arm 11 and the second arm 13 contact with each other, and a hinge connection structure 170 is provided between the connection ends 111 of the first arm 11 and the second arm 13 so that the first arm 11 and the second arm 13 are rotatably connected to each other by the hinge connection structure 170.

When the user needs to wear or take off the neck fan, through the hinge connection structure 170 provided between the connecting ends 111 of the first arm 11 and the second arm 13, the first arm 11 and the second arm 13 can be rotated relative to each other using the hinge connection structure 170 as the rotation point so that the distance between the free ends 131 of the first arm 11 and the second arm 13 is enlarged, which is convenient for the user to wear or take off the neck fan. After the user wears the neck fan, the connecting ends 111 of the two arms abut against each other to form an arc structure around the neck.

Preferably, magnets may be provided between the end faces of the connection ends 111 of the two arms 11, 13. Through the attraction function of the magnets, the first arm 11 and the second arm 13 can be connected and positioned well. In other embodiments, the body 10 can be made of a material with elastic restoring force so that the body 10 can be worn by holding opposite ends of the body 10 to move away from each other.

Specifically, the connection end 111 of the first arm 11 has a connection hole 171, and the connection end 111 of the second arm 113 has a connection shaft 172. The connection shaft 172 is rotatably received in the connection hole 171 so that the first arm 11 and the second arm 13 are hinged to each other.

In this embodiment, the number of fans 20 is two, and the number of air inlets 134 corresponding to the fans 20 is two. The two air inlets 134 are arranged in the outer side wall 152 of the body 10 respectively and the two fans 20 are provided at opposite ends of the body 10 respectively. Specifically, the two fans 20 are located close to the free ends 131 of the first arm 11 and the second arm 13 respectively.

Understandably, the portable blowing device can have other shapes suitable for wearing around other portions of a human body, such as a wrist, a waist, a shoulder and so on.

Embodiment 2

The present embodiment is partially identical to Embodiment 1, and the same parts are not repeated here. The difference is as following: as shown in FIG. 5 to FIG. 8, the body 10 is further provided with second air outlets 234 and second air inlets 236. The second air inlets 236 communicate with the airflow channel 231. The body 10 is further provided with second fans 201. The number of the second fans 201 can also be two. The two second fans 201 are respectively disposed near the free ends 131 of the first arm 11 and the second arm 13, and are located beside the fans 20 and are closer to the free ends 131 of the body 10 than the fans 20. The second fans 201 are arranged corresponding to the second air inlets 236 respectively. It can be understood that the second air inlets 236 are arranged adjacent to the air inlets 134, but not limited thereto. The second fan 201 is preferably an axial fan which draws air in and discharges air out in the same direction parallel to the axis of the fan.

In this embodiment, the second air inlet 236 and the second air outlet 234 are located on opposite sides of the body 10 and are arranged coaxially. The second fan 201 is arranged between the corresponding second air inlet 236 and second air outlet 234. The second fan 201 is electrically connected to the battery 50. Specifically, the second air outlet 234 is arranged on the inner side wall 151 of the body 10, and the second air inlet 236 is arranged on the outer side wall 152 of the body 10, so that the second fan 201 can introduce the external air into the airflow channel 231 through the second air inlet 236, and discharge the air through the second air outlet 234 to realize blowing air toward the face of the user. Preferably, in order to ensure sufficient wind power of the airflow exiting from the air outlet 232 and the second air outlet 234, a partition 202 (shown in FIGS. 10 and 11) may be provided between the fan 20 and the second fan 201 to isolate the airflow generated by the two fans respectively. That is, the airflow generated by the fan 20 is discharged from the air outlet 232 and the airflow generated by the second fan 201 is discharged from the second air outlet 234, which improves the utilization rate of the airflow generated by the fan 20 and the second fan 201.

Embodiment 3

Figure 9:
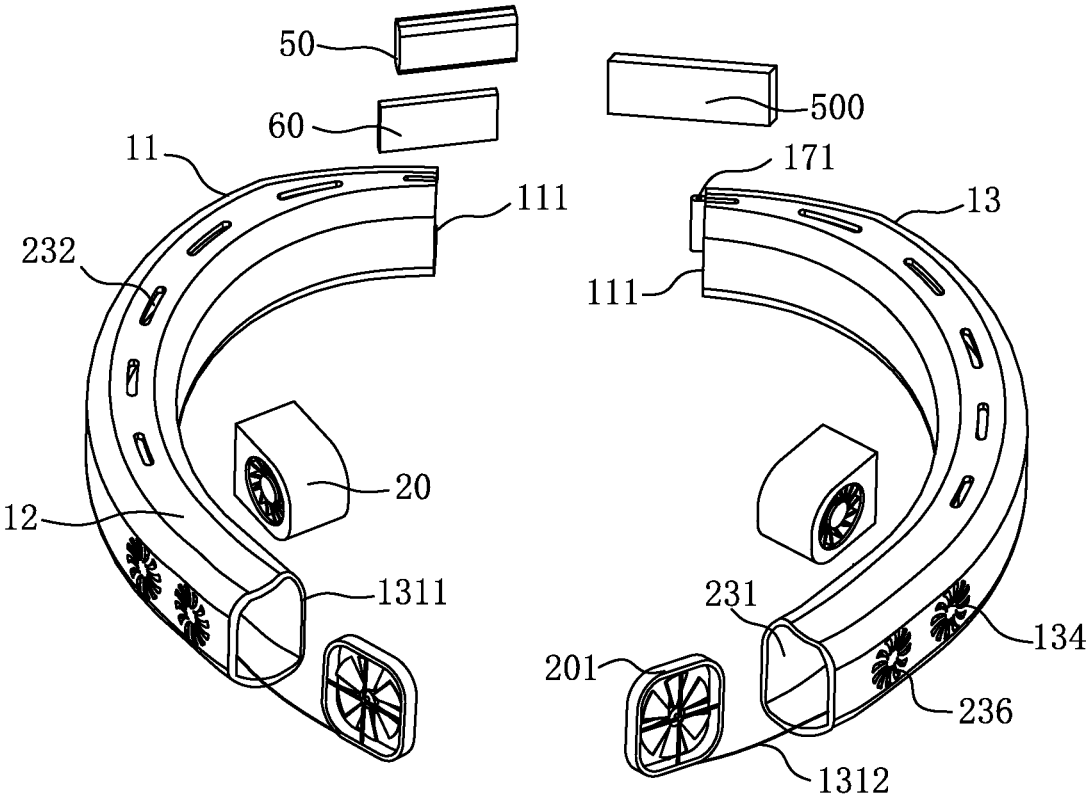
FIG. 9 is a perspective exploded view of a portable blowing device according to Embodiment 3 of the present disclosure.

The present embodiment is partially identical to Embodiment 2, and the identical parts are not repeated here. The difference is as following: as shown in FIG. 9, the free ends 131 of the first arm 11 and the second arm 13 are defined with through holes 1311 which are communicated with the airflow channels 231. The second fans 201 are arranged in the through holes 1311. An angle adjustment member 1312 is provided on the inner wall of the through hole 1311, the angle adjustment member 1312 is connected with the second fan 201 and is configured to adjust the orientation of the second fan 201.

Figure 10:
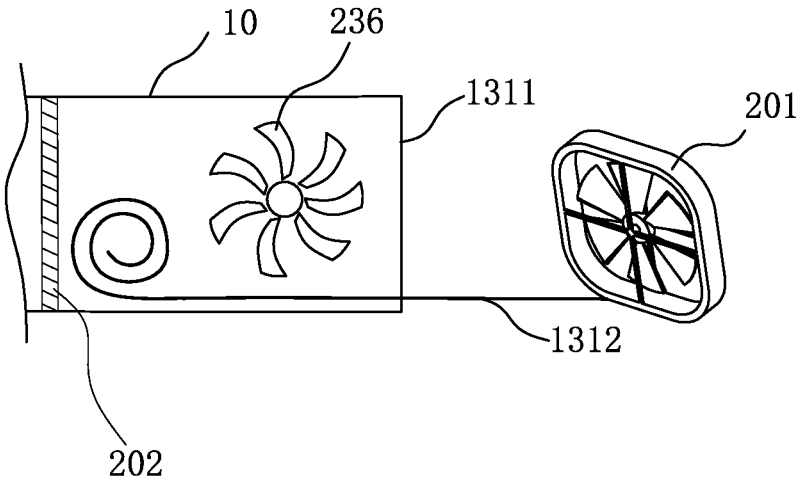
FIG. 10 showing a portion of the portable blowing device of FIG. 9.

As shown in FIG. 9 and FIG. 10, the angle adjusting member 1312 can be a metal wire that has been shaped by heat treatment and has stretchability. The metal wire is stored in the body 10 in a spiral shape, and the second fan 201 can be extended out of or retracted into the through hole 1311 by the spiral metal wire. When the second fan 201 needs to be extended out of the through hole 1311 for use, the second fan 201 can be pulled out of the through hole 1311. The metal wire is dragged out of the through hole 1311 by the second fan 201. When the second fan 201 needs to be retracted into the body 10 for use, the second fan 201 is pushed into the through hole 1311. The metal wire is thus retracted into the through hole in a helical storage state. The metal wire can be bent. The blowing direction (direction of airflow exiting from the second fan 201) of the second fan 201 can be adjusted by adjusting the bending angle of the metal wire. The blowing direction of the second fan 201 can be leftward, rightward, upward or downward.

Embodiment 4

Figure 11:
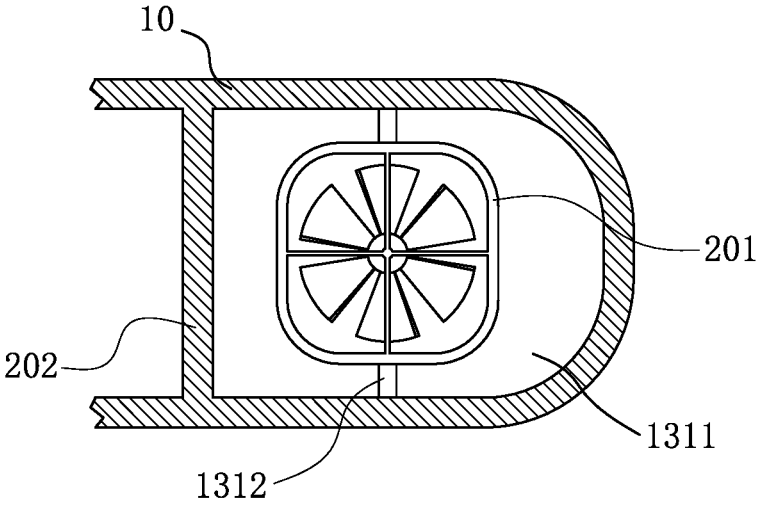
FIG. 11 is a partial structural sectional view of the portable blowing device according to Embodiment 4 of the present disclosure.
Figure 12:
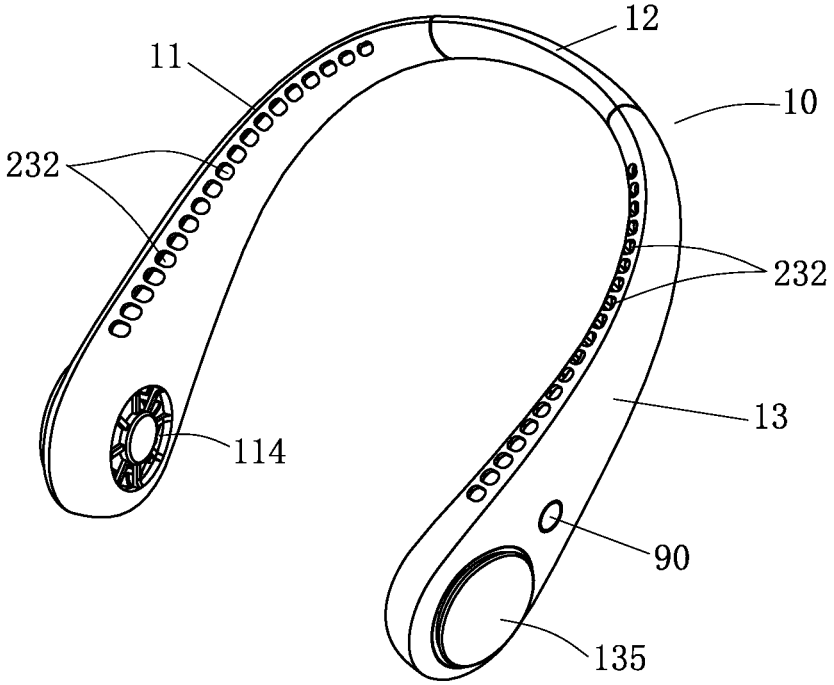
FIG. 12 is a perspective assembled view of a portable blowing device according to Embodiment 5 of the present disclosure.
Figure 13:
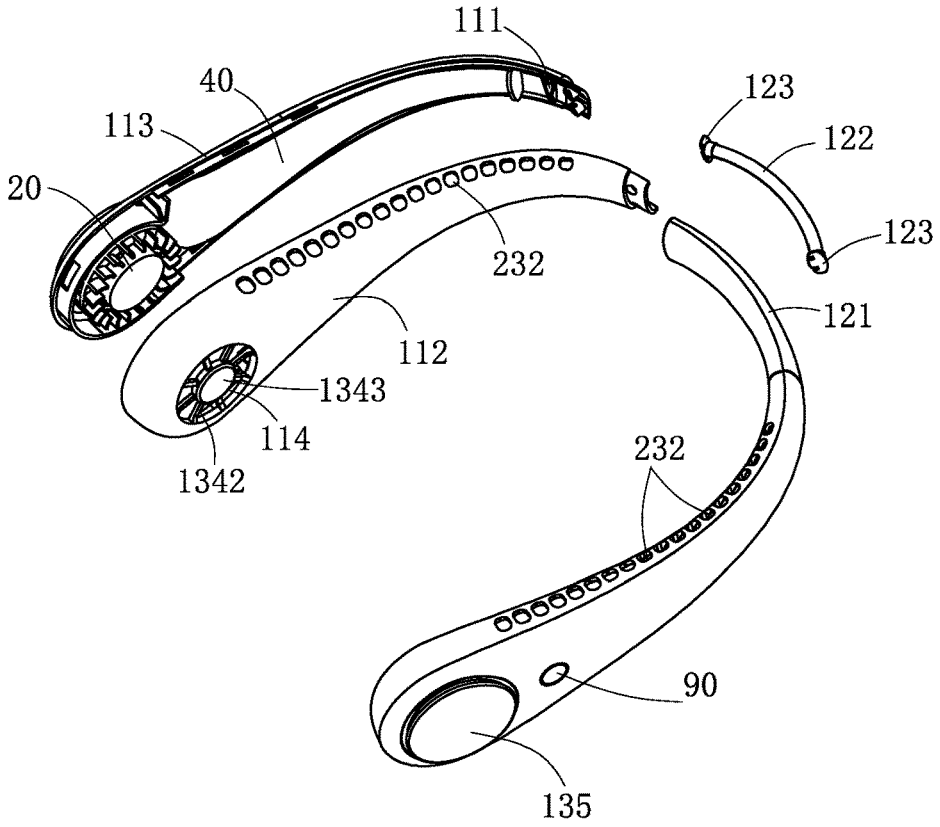
FIG. 13 is a partially exploded view of FIG. 12.
Figure 14:
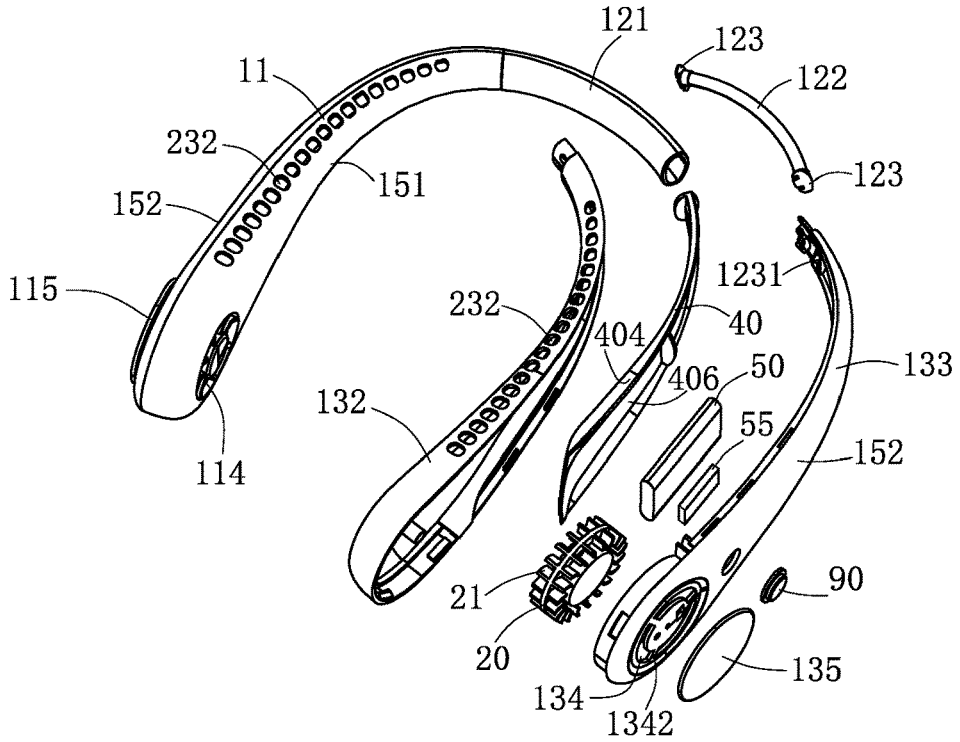
FIG. 14 is another partially exploded view of FIG. 12.
Figure 15:
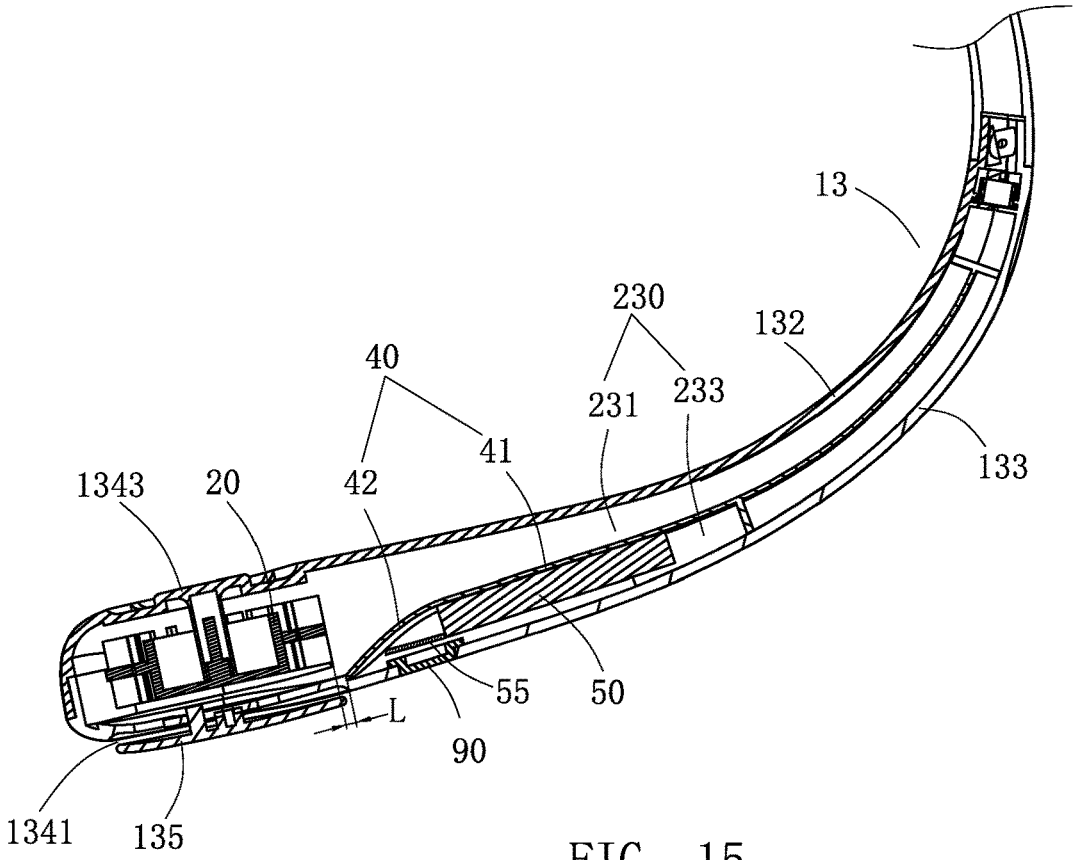
FIG. 15 is a cross section view of a arm of the portable blowing device shown in FIG. 12.

The present embodiment is partially identical to Embodiment 2, and the identical parts are not repeated here. The difference is as following: as shown in FIG. 11, the body 10 is defined with side openings. The body 10 is provided with a through hole 1311 between the inner side wall 151 and the outer side wall 152, the second fan 201 is arranged in the through hole 1311. The inner wall of the through hole 1311 is provided with an angle adjustment member 1312 for adjusting the orientation of the second fan 201.

Specifically, the angle adjusting member 1312 is a rotating shaft which is connected between the second fan 201 and the inner wall of the through hole 1311. The orientation of the second fan 201 can be adjusted by adjusting the rotating direction of the rotating shaft. Optionally, the angle adjusting member 1312 can also be a ball head, and the second fan 201 can rotate in various directions through the ball head.

The neck fan provided by the present application includes a body 10 for wearing on the neck of a human body. An airflow channel 231 is formed in the body 10. The airflow channel 231 is arranged along the lengthwise direction of the body 10. The body 10 is provided with an air outlet 232 and an air inlet 134. The air outlet 232 is arranged along the lengthwise direction of the body 10 and communicated with the airflow channel 231. The air inlet 134 is communicated with the airflow channel 231. The body 10 is provided with a fan 20 which is arranged corresponding to the air inlet 134. The fan 20 is used for introducing external airflow into the airflow channel 231 through the air inlet 134 and discharging the airflow through the air outlet 232. The air outlet 232 is arranged at the positions of the body 10 close to the neck so that the discharged airflow can be blown to the neck, so as to achieve the effect of cooling the neck. The fan 20 is located inside the body 10, which can effectively reduce the probability of hair twisting.

Embodiment 5

As shown in FIG. 12 to FIG. 15, a portable blowing device for example a neck fan in accordance with the present embodiment comprises a body 10 for wearing on the neck of a human body and fans 20 disposed in the body 10. An interior space 230 is formed within the body 10, and the space 230 extends along the lengthwise direction of the body 10 (i.e., a circumference direction of the neck), that is, the extending direction of the space 230 and the extending direction of the body 10 are the same. A wind shield 40 is arranged in the space 230 to make a portion of the space 230 form an airflow channel 231. An air outlet 232 is formed in the side wall of the airflow channel 231 to communicate the space 230 and outside of the body 10. The airflow generated by the fan 20 is capable of entering the airflow channel 231 and then exiting the channel 231 via the air outlet 232. The wind shield 40 is configured to guide the airflow generated by the fan 20 to the air outlet 232. Preferably, the fan 20 is a centrifugal fan (also known as a turbofan).

According to the portable blowing device provided in the present embodiment, the wind shield 40 is provided in the interior space 230 of the body 10 to form the airflow channel 231 in the interior space 230. Airflow generated by the fans 20 enters the airflow channels 231 and then exits the air outlet 232. Compared with the interior space 230, the airflow channel 231 has a reduced cross section area and therefore a reduced volume. The airflow generated by the fan 20 is concentrated after entering the airflow channel 231, and airflow blown out from the air outlet 232 is strengthened, so that the cooling effect and the user experience are improved.

Specifically, in the present embodiment, the wind shield 40 is an independent member arranged in the body 10. The body 10 comprises a first arm 11, a second arm 13 and a flexible connecting section 12 connecting the first arm 11 with the second arm 12. Each of the first arm 11 and the second arm 13 is provided with the interior space 230 and the wind shield 40 located in the interior space 230. The ends, away from the flexible connecting section 12, of the first arm 11 and the second arm 13 are respectively provided with the fans 20. The flexible connecting section 12 comprises a soft rubber sleeve 121 and a bending and shaping member 122 located in the soft rubber sleeve 121. Two opposite ends of the bending and shaping member 122 are respectively connected with locking members 123. The ends of the first arm 11 and the second arm 13 are respectively provided with locking grooves 1231, and the locking members 123 are locked in the locking grooves 1231, so that the flexible connecting section 12 connects the first arm 11 with the second arm 13 to form the whole body 10. In the present embodiment, the body 10 is configured to comprise the flexible connecting section 12, the first arm 11 and the second arm 13, so that the body 10 can be bent, straightened or deformed at the flexible connecting section 12, which enables a user to bend, straighten or deform the body 10 to wear it on the neck easily. Specifically, in the present embodiment, the bending and shaping member 122 is a metal hose.

In other embodiments, if the body 10 has a large enough opening formed between the first and second arms 13 to allow the user to wear it, the body 10 may not comprise the flexible connecting section, that is, the flexible connecting section may be omitted and the body 10 is formed as a single one-piece component. Two ends of the one-piece body 10 are respectively provided with the fans 20, and the space 230 and the airflow channels 231 corresponding to the fans 20 are arranged between the two fans 20.

Further, the first arm 11 and the second arm 13 respectively comprise first housings 112/132 and second housings 113/133, and the first housings 112/132 and the corresponding second housings 113/133 cooperatively form the space 230 after being assembled together. The fan 20 in the first arm 11 is disposed at an end, away from the flexible connecting section 12, of the first arm 11. The fan 20 in the second arm 13 is disposed at an end, away from the flexible connecting section 12, of the second arm 13. The space 230 of the first arm 11 and the second arm 13 are separated from each other by the flexible connecting section 12.

The wind shield 40 comprises a shielding part 41 extending along the lengthwise direction of the space 230, and a connecting part 42 connected to one end of the shielding part 41 facing the corresponding fan 20. One end of the connecting part 42 is connected with the shielding part 41, and the other end abuts against a part of the side wall of the space 230, so that the airflow channel 231 is formed between the wind shield 40 and the other part of the side wall of the space 230. Airflow generated by the fan 20 enters the airflow channel 231 and then is blown to the outside from the air outlet 232. In the present embodiment, the wind shield 40 divides the corresponding space 230 into the corresponding airflow channel 231 and a cavity 233 which does not communicate with the airflow channel 231. Thus, the wind shield 40 can prevent the airflow generated by the fan 20 from entering the cavity 233. A battery 50 and a circuit board 55 electrically connected with the corresponding fan 20 are arranged in the cavity 233. The circuit board 55 is also electrically connected with a switch 90 which is arranged outside the body 10. The battery 50 is configured to supply power to the fan 20, and the switch 90 is configured to control the fan 20.

In the present embodiment, the body 10 is of an arc-shaped structure for fitting the neck of a user such as a human body. The body 10 comprises an inner side wall 151 close to the neck of the human body and an outer side wall 152 away from the neck of the human body in use, and the air outlet 232 penetrate through the inner side wall 151. The fan 20 is a centrifugal fan comprising a pair of air intake sides located on opposite sides thereof in its axial direction and an air discharge side perpendicular to the air intake sides. The space 230 is located at and communicated with the discharge side of the fan 20. In the present embodiment, the second housings 113/133 are formed as the outer side walls 152 of the arms 11/13. Thus, the second housings 113/133 is also named as outer casings. The first housings 112/132 are formed as the inner side walls 151 of the arms 11/13. Thus, the first housings 112/132 is also named as inner casings. Top and bottom ends of the first housings 112/132 are bent toward the second housing 113/133 to form the top wall and the bottom wall. The first housings 112/132 and the second housings 113/133 are respectively provided with air inlets 114/134 at positions corresponding to the fans 20. That is, the inner side wall 151 and the outer side wall 152 of the body 10 are respectively provided with air inlets 114/134 at positions corresponding to the fans 20. The second housings 133/133 are provided with protective covers 115/135 at positions corresponding to the air inlets 114/134, and the protective covers 115/135 cover the air inlets 114/134 of the second housings 113/133 and are spaced from the air inlets 114/134, which can effectively prevent the user's hair from entering the fans 20 through the air inlets 114/134 of the second housings 113/133 when the user wears the neck fan. Due to the protective covers 115/135 are spaced from the air inlets 114/134 with gaps 1341 formed therebetween, the fans 20 can draw external airflow through the gaps 1341 to generate airflow. Optionally, in other embodiments, the inner side walls 151 are provided with protective covers at positions corresponding to the air inlets 114; or the inner side walls 151 and the outer side walls 152 are respectively provided with protective covers at positions corresponding to the air inlets 114/134. Further, the air inlet 114/134 is provided with a plurality of ribs 1342 which divide the inlet 114/134 into a plurality of inlet openings, which can more effectively prevent the user's hair or other sundries from entering the fans 20 through the air inlet 114/134. The inner side walls 151 and/or the outer side walls 152 of the body 10 are further provided with mounting sections 1343. The air inlet 114/134 is arranged around the corresponding mounting section 1343. The fan 20 is mounted to the mounting section 1343 of the inner side walls 151 or the outer side walls 152. In the axial direction of the fan 20, i.e., the air inlet direction, the protective cover 115/135 covers the air inlet 114/134 completely. That is, the protective cover 115/135 has a periphery extending beyond the periphery of the air inlet 114/134. Thus, the air inlet 114/134 is completely covered and hidden, making it safer for users to use.

In the present embodiment, the air outlet comprises a plurality of air outlet 232 which are formed in the inner side walls 151 of the arms 11/13 and arranged side by side at intervals along the lengthwise direction of the body 10, so that the airflow generated by the fans 20 can blow to most parts of the neck of the human body, allowing a larger cooling area and a better cooling effect. In the present embodiment, the wind shields 40 are plate-shaped, and peripheries of the wind shields 40 closely contact the inner surfaces of the second housings 113/133, i.e., the outer side walls 152, so that the space 230 are divided into the airflow channels 231 located in the inner side and the cavities 233 located in the outer side. In the present embodiment, the upper and lower edges of the wind shield 40 are bent and extended toward the outer side wall 150 to form hems 404, so that a groove 406 is formed between the two hems 404. The shape of the groove 406 matches the shape of the battery 50, and the battery 50 is at least partially located in the groove 406, so that the battery 50 can be better positioned and firmly located in the cavity 233. Of course, in other embodiments, the peripheries of the wind shields 40 may closely contact the inner side walls 151 and the outer side walls 152, so that the wind shields 40 form the cavities 233 with part of the inner side walls and the outer side walls, and the wind shields 40 form the airflow channels 231 with the other part of the inner side walls and the outer side walls. The present disclosure does not limit which part of the side wall of the space 230 being connected with the wind shield 40 in the body 10. In other embodiments, the wind shield 40 can also be a rubber block with a certain thickness formed by integrally extending from the inner side surface of the first housing 112/132 or the second housing 113/133, or a rubber block with a certain thickness assembled in the space 230 and closely contacting with part of the side wall of the space 230. The specific shape and forming mode of the wind shield 40 are not limited in this present disclosure, as long as an airflow channel 231 with a reduced cross section area can be formed in the space 230.

Embodiment 6

Figure 16:
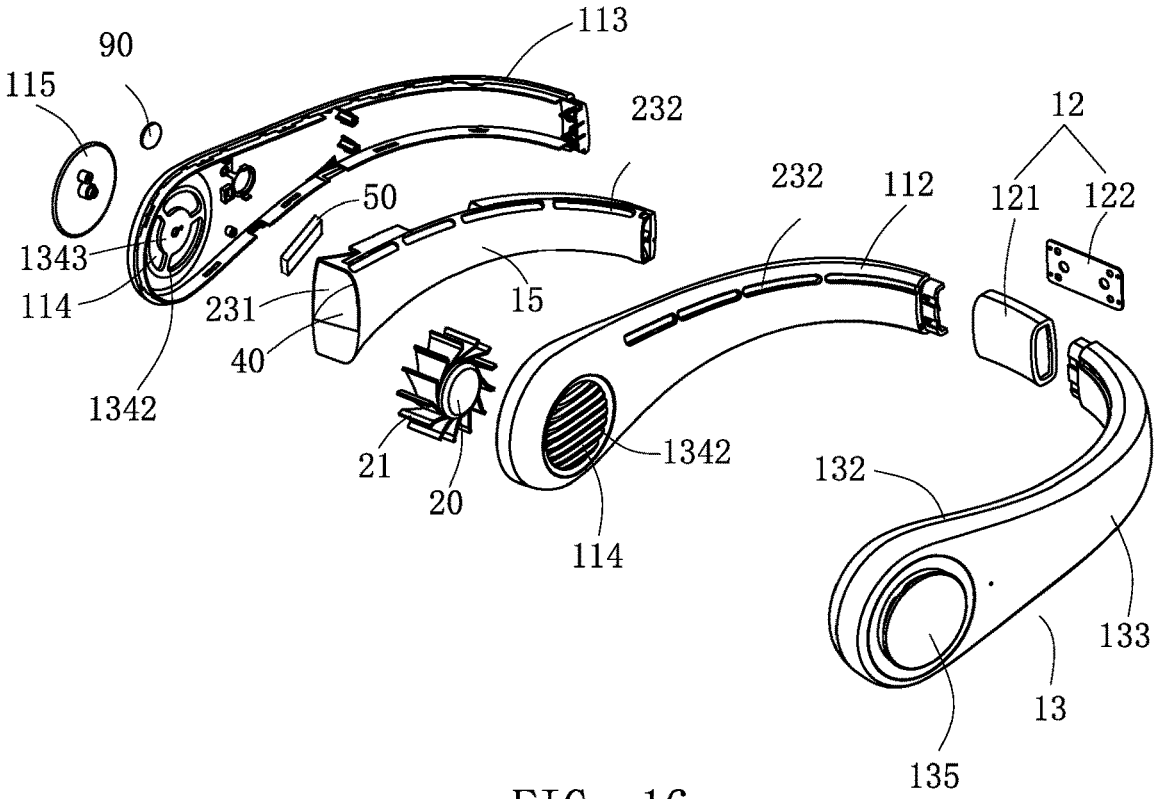
FIG. 16 is an exploded view of a portable blowing device according to Embodiment 6 of the present disclosure.
Figure 17:
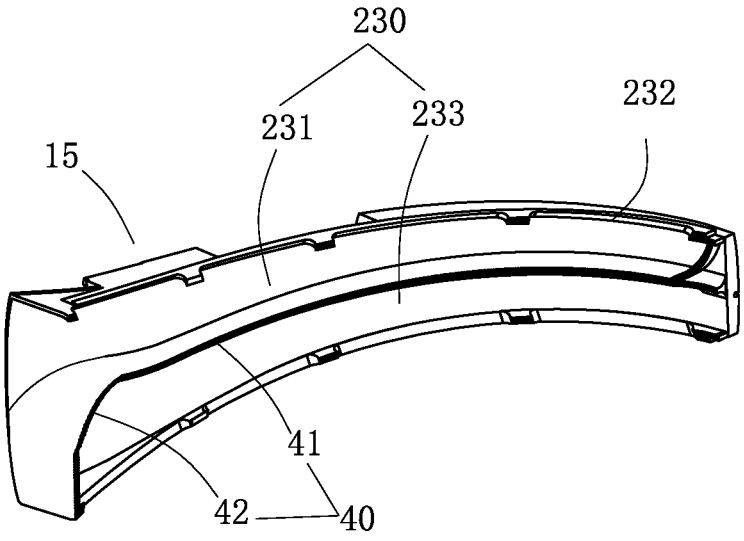
FIG. 17 is a sectional view of an inner case of the portable blowing device of FIG. 16.

The present embodiment is partially identical to Embodiment 5, and the identical parts are not repeated here. The difference is as following: as shown in FIG. 16 and FIG. 17, the first housings 112/132 and the second housings 113/133 are connected to form spaces therebetween, and an inner case 15 hermetically connected with an inner surface of the space is arranged in the space, that is, an outer surface of the inner case 15 closely contacting with the inner surface of the space. The inner case 15 is a hollow structure. The airflow channel 230 and the wind shield 40 are arranged in the inner case 15. By arranging the integrally formed inner case 15 with the airflow channel 230 formed therein, after the first housings 112/132 and the second housings 113/133 are assembled, the integrally formed inner case 15 is located in the space formed between the assembled first housings 112/132 and second housings 113/133. Even if there are small gaps located at the joints between the first housings 112/132 and the second housings 113/133, the airflow generated by the fans 20 will not escape through the joints between the first housings 112/132 and the second housings 113/133, thus achieving a strengthened airflow and a fast cooling effect. In the present embodiment, the wind shield 40 is a plate-shaped partition, a cavity 233 is formed between a side, opposite the airflow channel 231, of the wind shield and the side wall of the inner case 15, and electronic components such as batteries 50 can be placed in the cavity 233. Of course, in other embodiments, the wind shield 40 can also be a rubber block with a certain thickness integrally extending from the inner side wall of the inner case 15, or a rubber block with a certain thickness assembled in the inner case 15 and closely contacting the part of the side wall of the inner case 15. The specific shape and forming mode of the wind shield 40 are not limited, as long as ab airflow channel 231 with a reduced cross section area can be formed in the inner case 15. Preferably, the fan 20 is a centrifugal fan.

Embodiment 7

Figure 18:
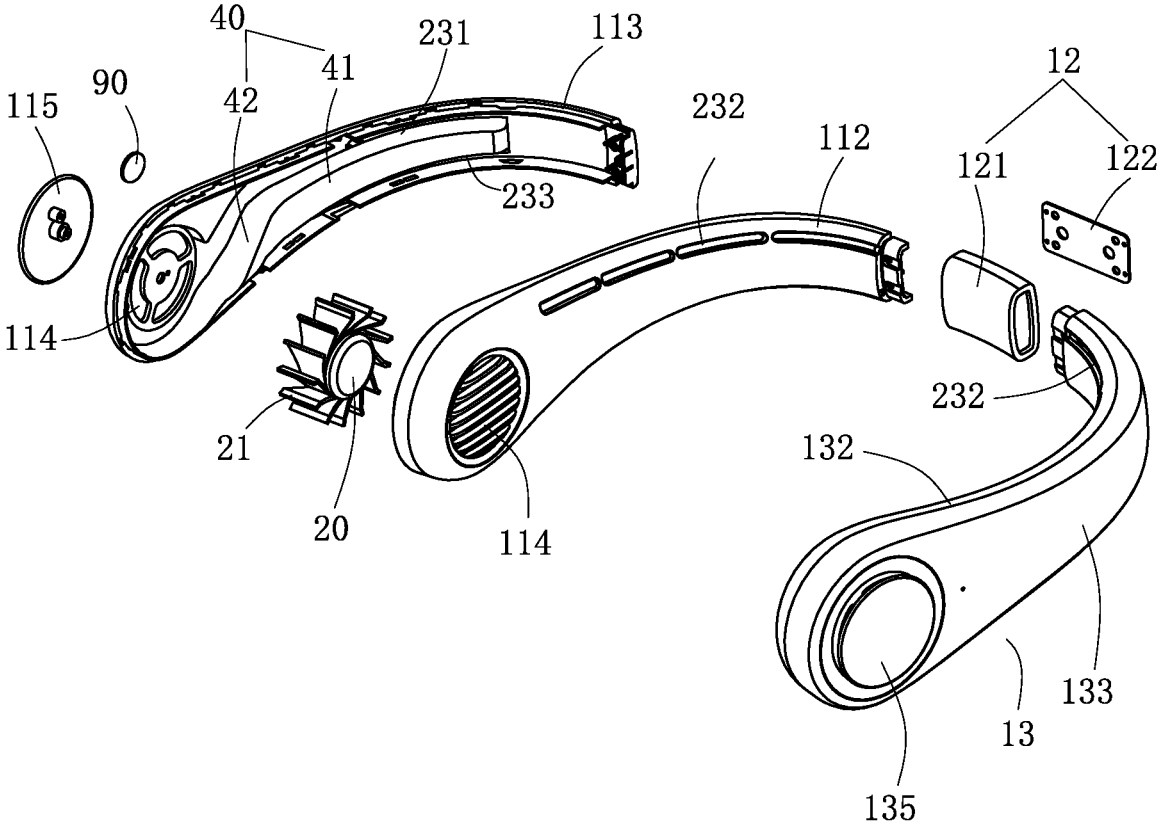
FIG. 18 is an exploded view of a portable blowing device according to Embodiment 7 of the present disclosure.
Figure 19:
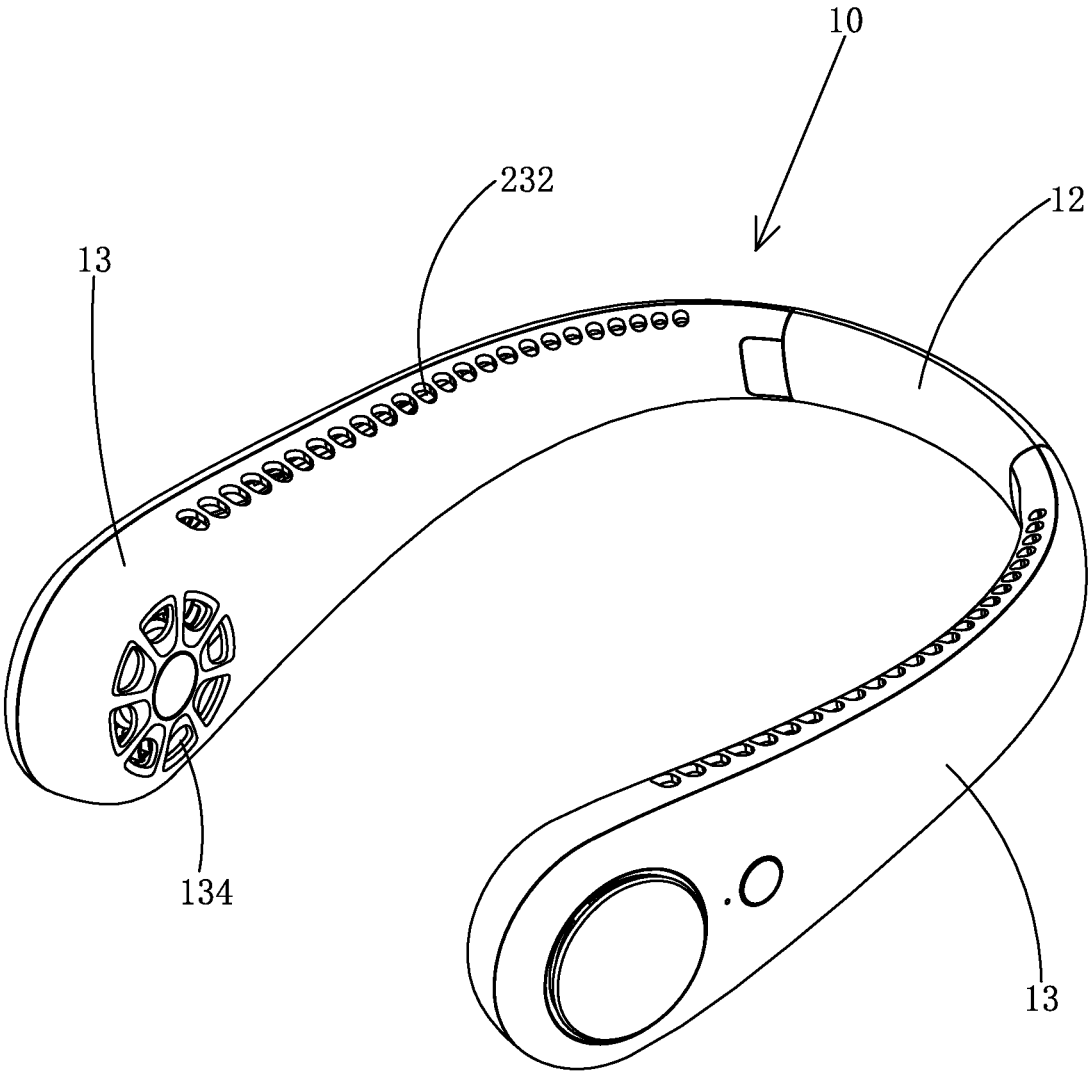
FIG. 19 is a perspective view of a portable blowing device according to Embodiment 8 of the present disclosure.
Figure 20:
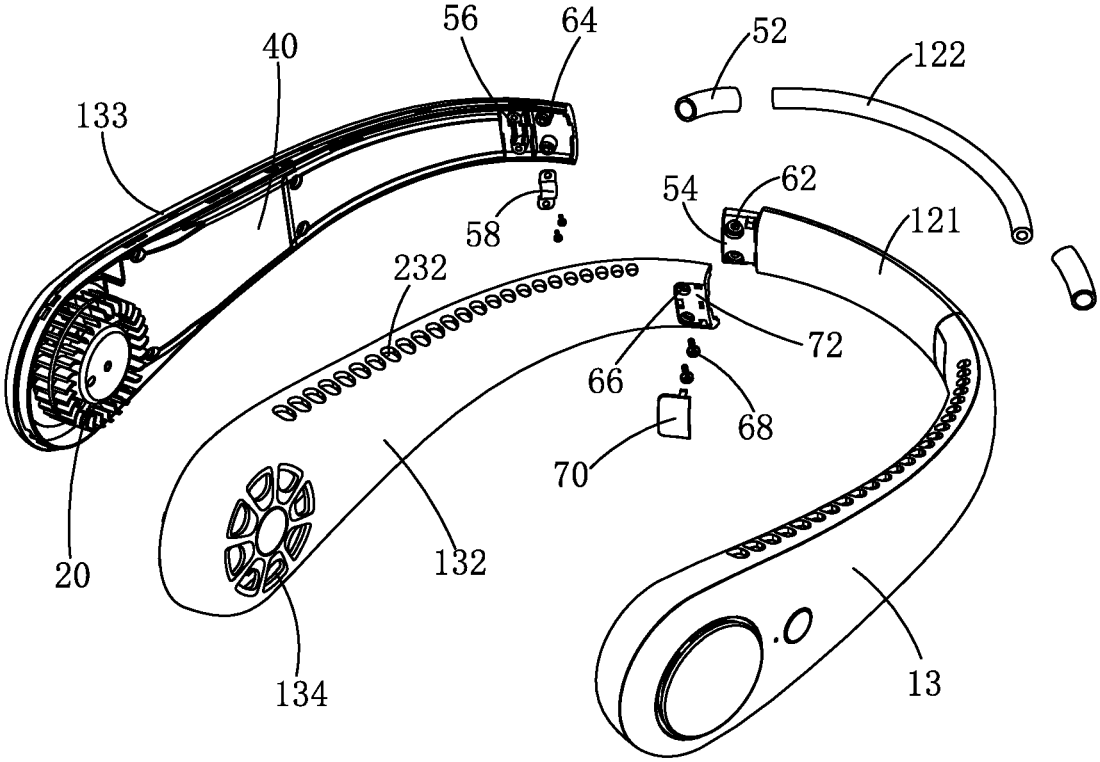
FIG. 20 is an exploded view of the portable blowing device in FIG. 19.

The present embodiment is partially identical to Embodiment 5, and the identical parts are not repeated here. The difference is as following: as shown in FIG. 18, the wind shield 40 integrally extends from the inner surface of the second housing 113/133, that is, the outer side of the wind shield 40 is integrally connected with the inner surface of the second housing 113/133, and the inner side of the wind shield 40 closely contacts with the first housing 112/132 after the first housing 112/132 and the second housing 113/133 are assembled together, so that the space 230 formed by the assembled first housing 112/132 and second housing 113/133 is divided by the wind shield 40 into an airflow channel 231 with a reduced cross-section area and a cavity 233. The battery 50 and the circuit board 55 may be accommodated in the cavity 233. In other embodiments, the wind shield 40 can also integrally extend from the inner surface of the first housing 112/132, that is, the inner side of the wind shield 40 is integrally formed with the inner side of the first housing 112/132, and the outer side of the wind shield 40 closely contacts with the second housing 133/133 after the first housing 112/132 and the second housing 113/133 are assembled together, so that the space 230 formed by the assembled first housing 112/132 and second housing 113/133 is divided by the wind shield 40 into the airflow channel 231 with a reduced cross-section area and the cavity 233. It is also possible that the wind shield 40 is formed by extension parts from both the first housing 112/132 and the second housing 113/133, that is, the first extension part extending from the first housing 112/132 form a first part of the wind shield 40 and the second extension part extending from the second housing 113/133 form a second part of the wind shield 40, and the first and second parts of the wind shield 40 cooperatively form the wind shield 40 after the first housing 112/132 and the second housing 133/133 are assembled together.

In the present embodiment, the wind shield 40 is integrally formed in the space 230 of the arm, that is, the wind shield 40 integrally extends from the inner surface of the first housing 112/132 or the second housing 113/133 so that the space 230 formed by the assembled first housing 112/132 and second housing 113/133 is divided by the wind shield 40 into the airflow channel 231 with a reduced cross-section area and the cavity 233. Airflow generated by the fans 20 enter the airflow channels 231 and then is blown out from the air outlet 232. Due to the airflow channels 231 with reduced cross-section area, the airflow generated by the fans 20 is concentrated after entering the airflow channel 231, and the airflow blown out from the air outlet 232 is strengthened, so that the cooling effect and the user experience are improved.

Embodiment 8

As shown in FIGS. 19-21A, the present embodiment provides a portable blowing device, which is also a neck fan. The neck fan is for wearing on the neck of a human body and comprises a body 10 and fans 20 arranged in the body 10. Spaces corresponding to the fans 20 are formed in the body 10, wind shields 40 and partition members 22 are arranged in the spaces, and the wind shields 40 and the partition members 22 both extend along the lengthwise direction of the body 10. In the present embodiment, the body 10 comprises a flexible connecting section 12, two arms 13 respectively connected to two opposite ends of the flexible connecting section 12, and batteries 50 and circuit boards (not shown) arranged in the arms 13. There are two fans 20 which are arranged in the two arms 13 respectively, for example, at an end, away from the flexible connecting section 12, of the arm 13. The fans 20 and the batteries 50 are electrically connected with the circuit boards to provide power to the fans 20. In the present embodiment, since the two arms 13 have the same structure and are symmetrically arranged, only one arm 13 will be described below as an example.

In the present embodiment, the arm 13 is of a hollow structure, the wind shield 40 is configured to divide the space in the arm 13 into a first cavity and a second cavity 26, and the partition member 22 is arranged in the second cavity 26 to further divide the second cavity 26 into an airflow channel 28 and a second sub-cavity 29. Preferably, the first cavity and the second sub-cavity 29 do not communicate with the airflow channel 28, that is, the first cavity and the second sub-cavity 29 are both completely enclosed cavities, and airflow will not enter the first cavity or the second sub-cavity 29 after entering the airflow channel 28 which communicates with the air discharge side of the corresponding fan 20. A side wall of the arm 13 corresponding to the airflow channel 28 is provided with air outlet 232 which communicate with the airflow channel 28 and the outside of the arm 13, the arm 13 is provided with air inlet openings 134 corresponding to the fan 20, so that airflow generated by the fan 20 is blown out from the air outlet 232 after passing through the airflow channel 28. Due to the dual separation of the space in the arm 13 by the wind shield 40 and the partition member 22, the cross-section area of the airflow channel 28 can be effectively reduced. In this way, the airflow generated by the fan 20 is concentrated after entering the airflow channel 28, and the airflow blown out from the air outlet 232 is strengthened, so that the cooling effect and the user experience are improved.

In the present embodiment, the arm 13 comprises a first housing 132 and a second housing 133 which are engaged together, and the space of the arm 13 is formed between the first housing 132 and the second housing 133. Therefore, the outer side wall of the body 10 is the second housing 133 of the arm 13, and the inner side wall of the body 10 is the first housing 132 of the arm 13.

Opposite two side edges of the partition member 22 are respectively connected with the inner side wall 132 of the arm 13 and the inner face of the wind shield 40, and the partition member 22 has a plate/panel shape extending along the length direction and the thickness direction of the arm 13, that is, the major surface of the partition member 22 extends along the thickness direction of the arm 13. In the present embodiment, one side edge of the partition member 22 is integrally connected to the inner surface of the first housing 132, and the other side edge of the partition member 22 closely contacts with the inner surface of the wind shield 40, so that the second cavity 26 is divided by the partition member 22 into the airflow channel 28 and the second sub-cavity 29 distributed at intervals in the width direction of the arm 13.

Figure 21:
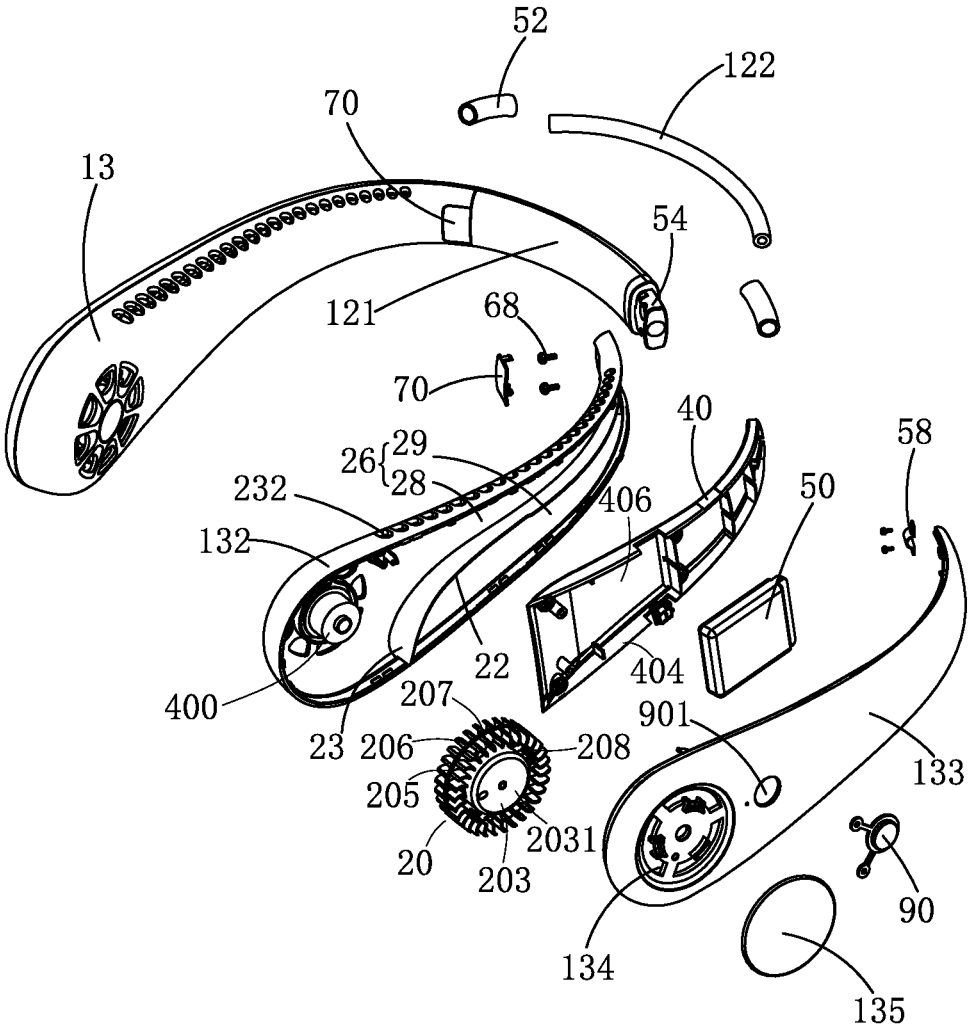
FIG. 21 is another exploded view of the portable blowing device in FIG. 19.
Figure 21A:
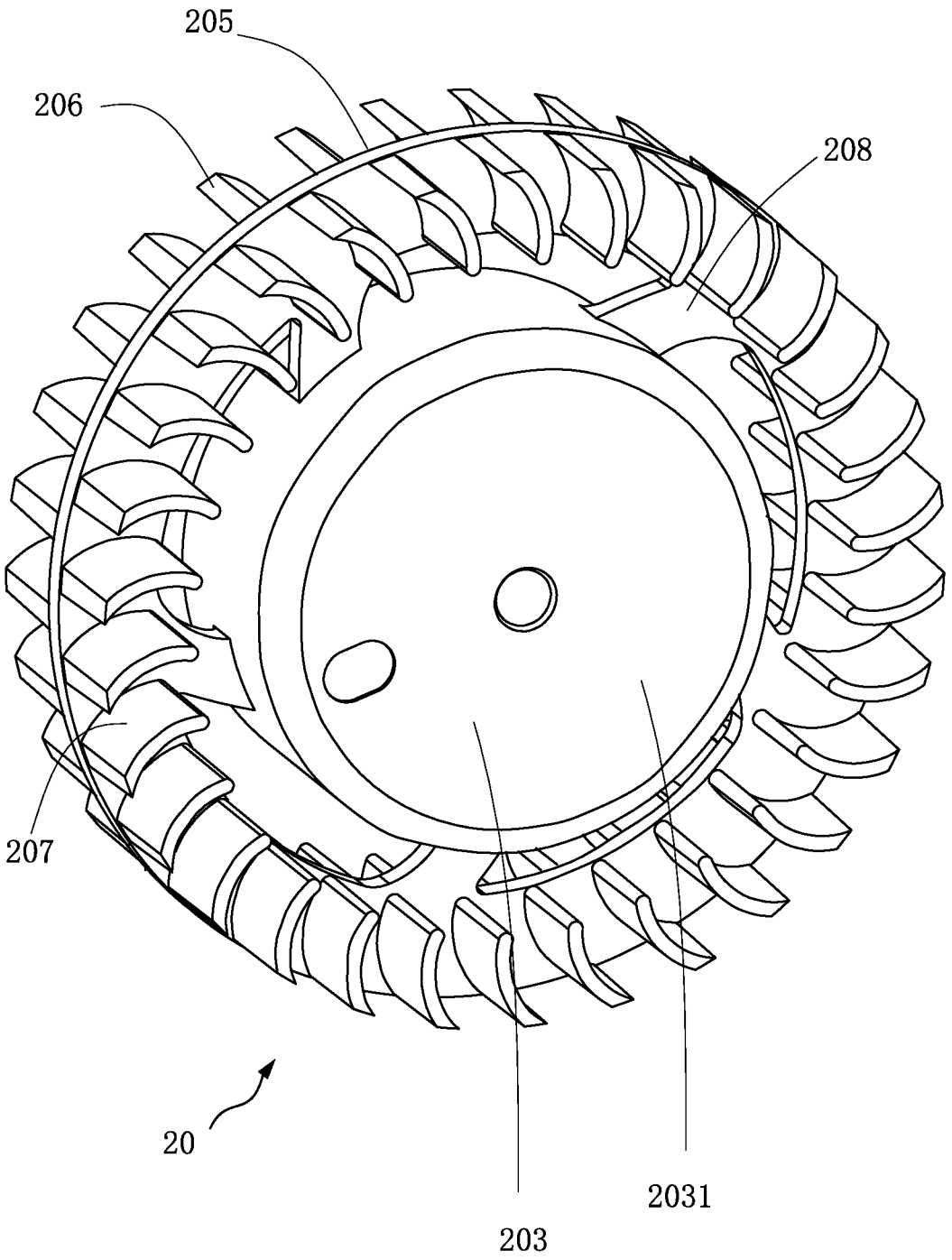
FIG. 21A is an enlarged view of the fan of the portable blowing device of FIG. 21.
Figure 22:
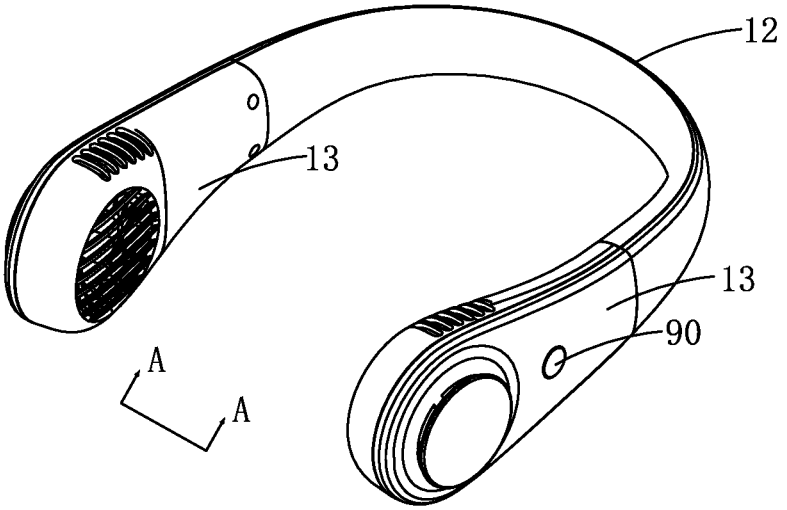
FIG. 22 is a perspective view of a portable blowing device according to Embodiment 9 of the present disclosure.
Figure 23:
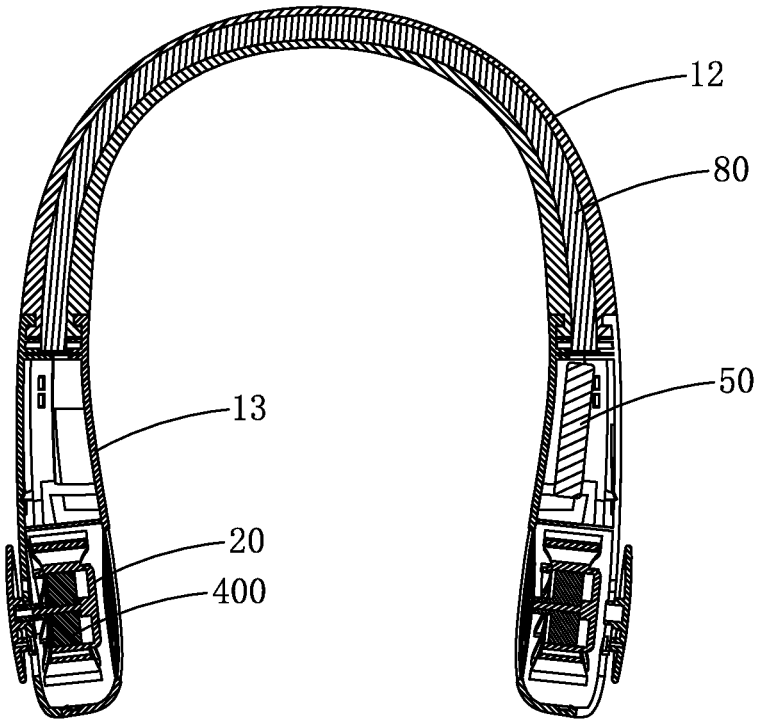
FIG. 23 is a cross-sectional view of the portable blowing device shown in FIG. 22 taken along A-A.

The fan 20 is a centrifugal fan which includes a hub 203 in the middle and a blade unit surrounding the hub 203. A driving device 400 is installed in the hub 203 for driving the hub 203 to rotate. The driving device 400 can be a motor fixed on the inner side wall or outer side wall of the arm 13. The hub 203 is a hollow structure with an opening formed at one end thereof and an end face 2031 formed at the other end thereof. The hub 203 is sleeved on the periphery of the driving device 400. The blade unit includes an annular connecting plate 205 surrounding the hub 203, and a first blade group 206 and a second blade group 207 located on inner and outer sides of the connecting plate 205 respectively. The connecting plate 205 is arranged around the hub 203 and spaced from the hub 203. A plurality of connecting spokes 208 is connected between the connecting plate 205 and the hub 203. A concaved recess is formed between the end of the blade unit (i.e. the end of the first blade group 206 or the end of the second blade group 207) and the end face 2031 of the hub 203, that is, the end face 2031 of the hub 203 is concaved relative to the end of the blade unit (as shown in FIG. 21).

The flexible connecting section 12 comprises a bending and shaping member 122 and a soft rubber sleeve 121 covering the bending and shaping member 122. Two ends of the bending and shaping member 122 are respectively sleeved with metal sleeves 52 which are enclosed by the soft rubber sleeve 121. By sleeving the two ends of the bending and shaping member 122 with the metal sleeves 52 respectively, bending and deformation of the two ends of the flexible connecting section 12 can be effectively prevented, to thereby avoid gaps between the two ends of the flexible connecting section 12 and the arms 13 becoming larger.

The two ends of the flexible connecting section 12 are respectively locked and connected with the two arms 13. More specifically, two ends of the soft rubber sleeve 121 are respectively provided with connecting portions 54 for extending into connecting ends of the arms 13, the inner side wall of the second housing 133 is provided with a fixing base 56 which is provided with a screw hole. During assembly, an end of the bending and shaping member 122 extending out of the metal sleeve 52 and the connecting portion 54 penetrates into the connecting end of the arm 13 and extends through the fixing piece 58 and is locked by the fixing base 56 and the fixing piece 58.

Two positioning holes 62 are formed in the connecting portion 54, two positioning studs 64 are arranged on the inner side wall of the second housing 133 corresponding to the positioning holes 62, screw holes are formed in the positioning studs 64, and two through holes 66 are formed in the first housing 112 corresponding to the positioning holes 62. Screws 68 pass through the through holes 66 and the positioning holes 62 in sequence and then are engaged in the screw holes of the positioning studs 64, thus realizing the locking connection between the first arm 11 and the flexible connecting section 12. In the illustrated embodiment, the neck fan 10 further comprises a cap 70. An area on the inner side wall of the first housing 112 corresponding to the through holes 66, for example, a connecting end of the first housing 112 is provided with a recessed portion 72. After being fastened in the through holes 66, heads of the screws 68 are exposed from the recessed portion 72, and the cap 70 is mounted to the recessed portion 72 in a snap fit mode to shield the screws 68 from being exposed, so that the appearance of the product is more attractive. In this embodiment, the cap 70 is secured to the connecting end of the arm 13. Alternatively, the cap 70 may be secured to the end of the connecting section 12. Specifically, the recessed portion is formed at the connecting portion 54 of the soft rubber sleeve 121 and the cap 70 is secured to the recessed portion of the connecting portion 54 of the soft rubber sleeve 121.

Embodiment 9

As shown in FIG. 22 to FIG. 25, a portable blowing device provided by the present embodiment is also a neck fan, which comprises an arc-shaped body for wearing on the neck of the human body and fans 20 arranged in the body. The body comprises a connecting section 12 and arms 13 arranged at opposite two ends of the connecting section 12. Preferably, the connecting section 12 is an arc-shaped flexible connecting section 12. A fan 20 and a driving device 400 are arranged in each arm 13, and each arm 13 comprises an outer casing 200 (i.e., the outer side wall of the arm 13) and an inner casing 210 (i.e., the inner side wall of the arm 13), wherein the inner casing 210 is located on a side close to the neck of the human body and the outer casing 200 is located on a side away from the neck of the human body. Preferably, the driving device 400 in one arm 13 is fixed on the outer casing 200, and the driving device 400 in the other arm 13 is fixed on the inner casing 210. The driving device 400 is configured to drive the fan 20 to rotate.

In the neck fan of the above embodiment, the driving device 400 in one arm 13 is fixed to the outer casing 200 while the driving device 400 in the other arm 13 is fixed to the inner casing 210, and then the fans 20 are respectively connected with the driving devices 400, so that the left and right fans 20 located at opposite ends of the body have the same assembly direction when the neck fan is worn on the neck of the human body, and the left and right fans 20 can be of the same type, which solves the problem that errors tend to occur during fan assembly and improves the universality of the fans 20. Because the left and right fans 20 are exchangeable, the production cost is reduced, the assembly process is simplified, and the error rate is reduced.

Figure 25:
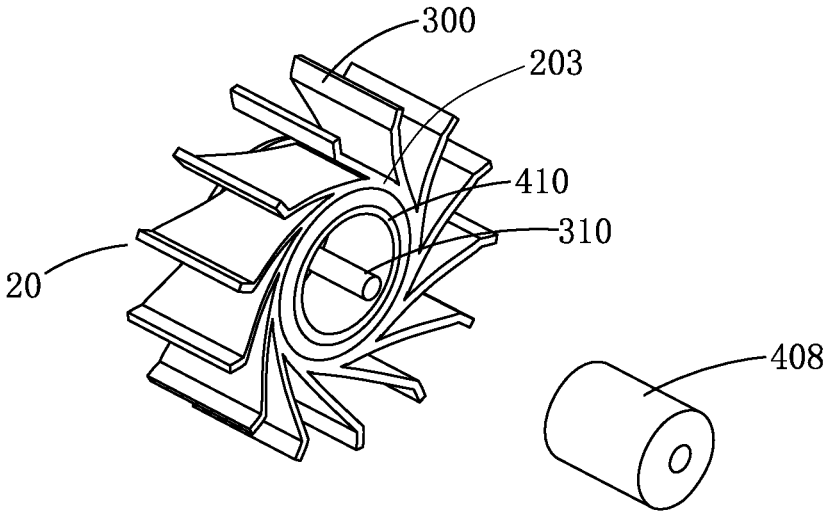
FIG. 25 is a structural diagram of a fan and a driving device of the portable blowing device shown in FIG. 24.

In one embodiment, as shown in FIG. 25, the driving device 400 comprises a stationary part 408 and a rotating part 410. The stationary part 408 of the driving device 400 in one arm is fixed on the inner surface of the outer casing 200, while the stationary part 408 of the driving device 400 in the other arm is fixed on the inner side surface of the inner casing 210. The rotating part 410 is fixedly connected with the fan 20 so that the fan 20 is rotatable with the rotating part 410.

The stationary part 408 is provided with a through hole at its axial center. The fan 20 comprises a hub 203 in the middle thereof and a blade unit around the hub 203. The stationary part 408 and the rotating part 410 of the driving device 400 are located in the hub 203. The blade unit comprises a blade group 300 around the hub 203. An end of the blade unit, i.e., a distal end of the blade group 300 and the end face 2031 of the hub 203 are flush with each other. A rotating shaft 310 is provided in the center of the hub 203. The rotating shaft 310 is rotatably inserted into the through hole of the stationary part 408, so that the rotating part 410 is rotatable with respect to the stationary part 408 to thereby drive the hub 203 and the blade unit to rotate. In the present embodiment, a rod 206 is arranged on the inner surface of the outer casing 200 where the stationary part 408 is installed. The stationary part 408 is sleeved on the rod 206 and fixedly connected with the outer casing 200. The rod 206 is of a hollow structure. The rotating shaft 310 of the fan 20 is rotatably inserted into the rod 206, so that the stationary part 408 cooperates with the rotating part 410 to drive the hub 203 and the blade unit to rotate about the axis of the rod 206.

Specifically, in the present embodiment, the driving device is described as a motor, and the stationary part 408 acts as a stator of the driving device 400. Each of opposite ends of the body 10 is provided with a stator inside, one stator being fixed on the inner surface of the outer casing 200 and the other stator being fixed on the inner surface of the inner casing 210. The rotating part 410 acts as a rotor of the driving device 400. The hub 203 of the fan 20 forms a chamber inside. The rotor is received in the chamber and tightly attached to an inner wall of the chamber. When the rotating shaft 310 is inserted into the through hole or the rod 206, the stator is located in the chamber and cooperates with the rotor to form the driving device 400. After being electrified, the rotor rotates to drive the blade unit to rotate.

In the above embodiment, by changing the assembling direction of one of the fans, the left and right fans can be assembled in the same direction, which solves the problem that the two fans are not exchangeable and assembly errors tend to occur in a traditional neck fan due to the left and right fans of the traditional neck fan are in a mirror-image relation.

In other embodiments, the driving device 400 comprises a motor with a bearing (not shown). The motor in one arm is fixed to the outer casing 200, and the motor in the other arm is fixed to the inner casing 210. The fan 20 comprises an impeller 300 and a sleeve (not shown) which is sleeved on a bearing of the motor and fixedly connected with the bearing, so that the motor drives the impeller 300 to rotate.

Figure 24:
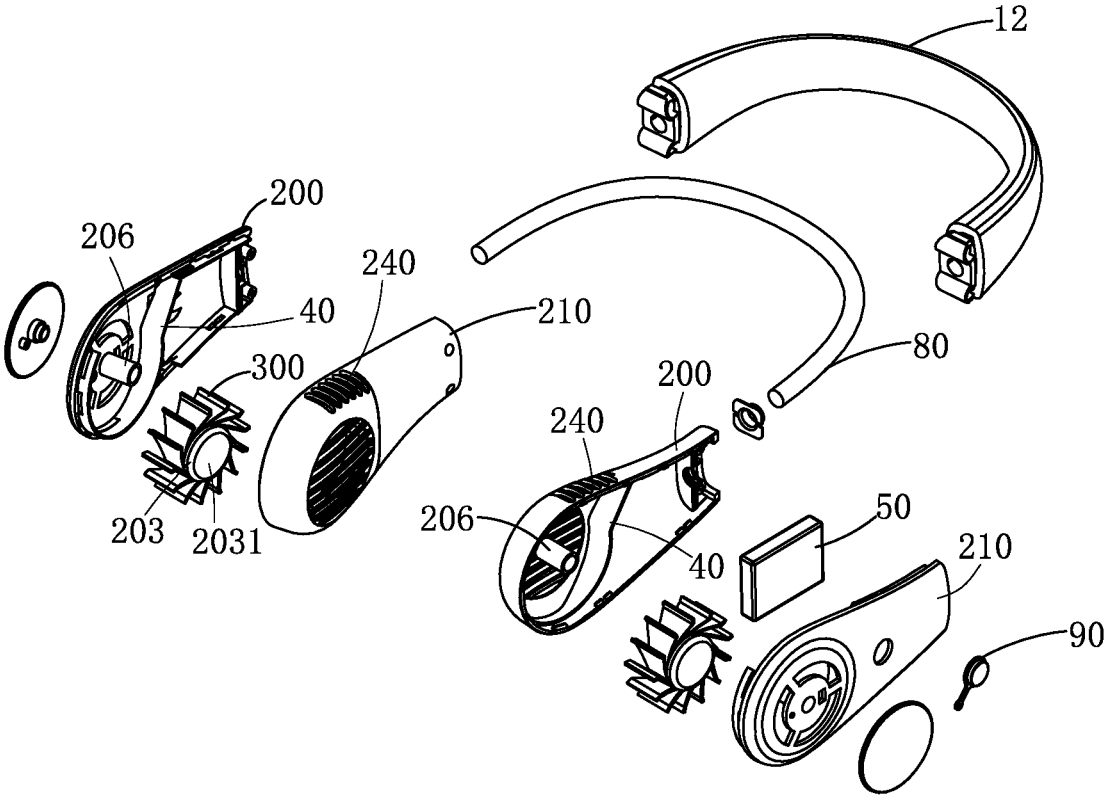
FIG. 24 is an exploded view of the portable blowing device in FIG. 22.

In one embodiment, as shown in FIG. 24, the arm 13 defines an interior space. A wind shield 40 is arranged in the space of the arm 13. Through holes 240 acting as air outlet openings, are formed in a side face of the arm 13 which is a face connected between an outer surface of the outer casing 200 and an outer surface of the inner casing 210. The wind shield 40 is configured for guiding the airflow generated by the fan 20 to the through holes 240 where the airflow exits the arm 13.

Embodiment 10

Figure 26:
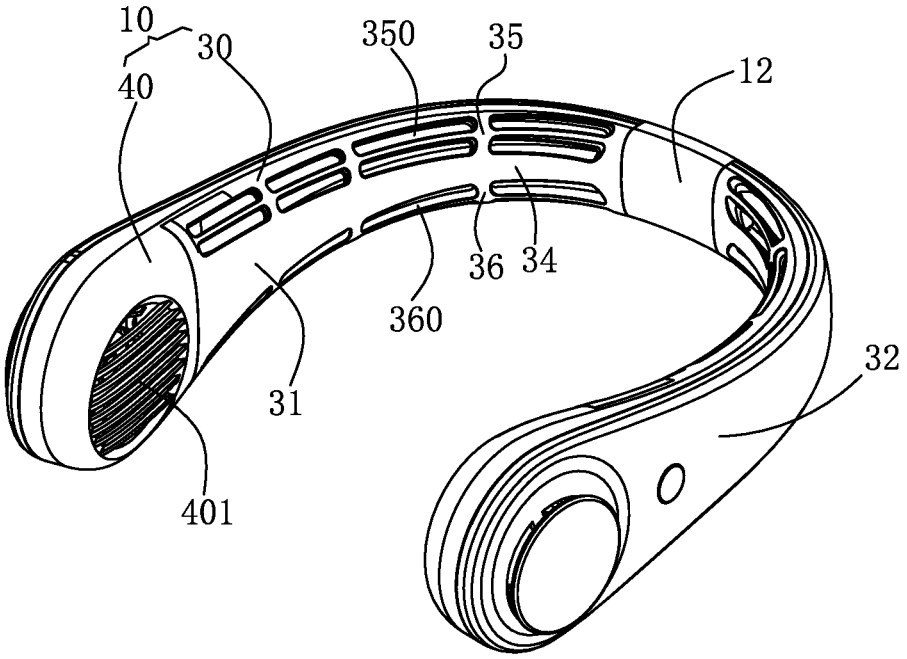
FIG. 26 is a perspective view of a portable blowing device according to Embodiment 10 of the present disclosure.
Figure 27:
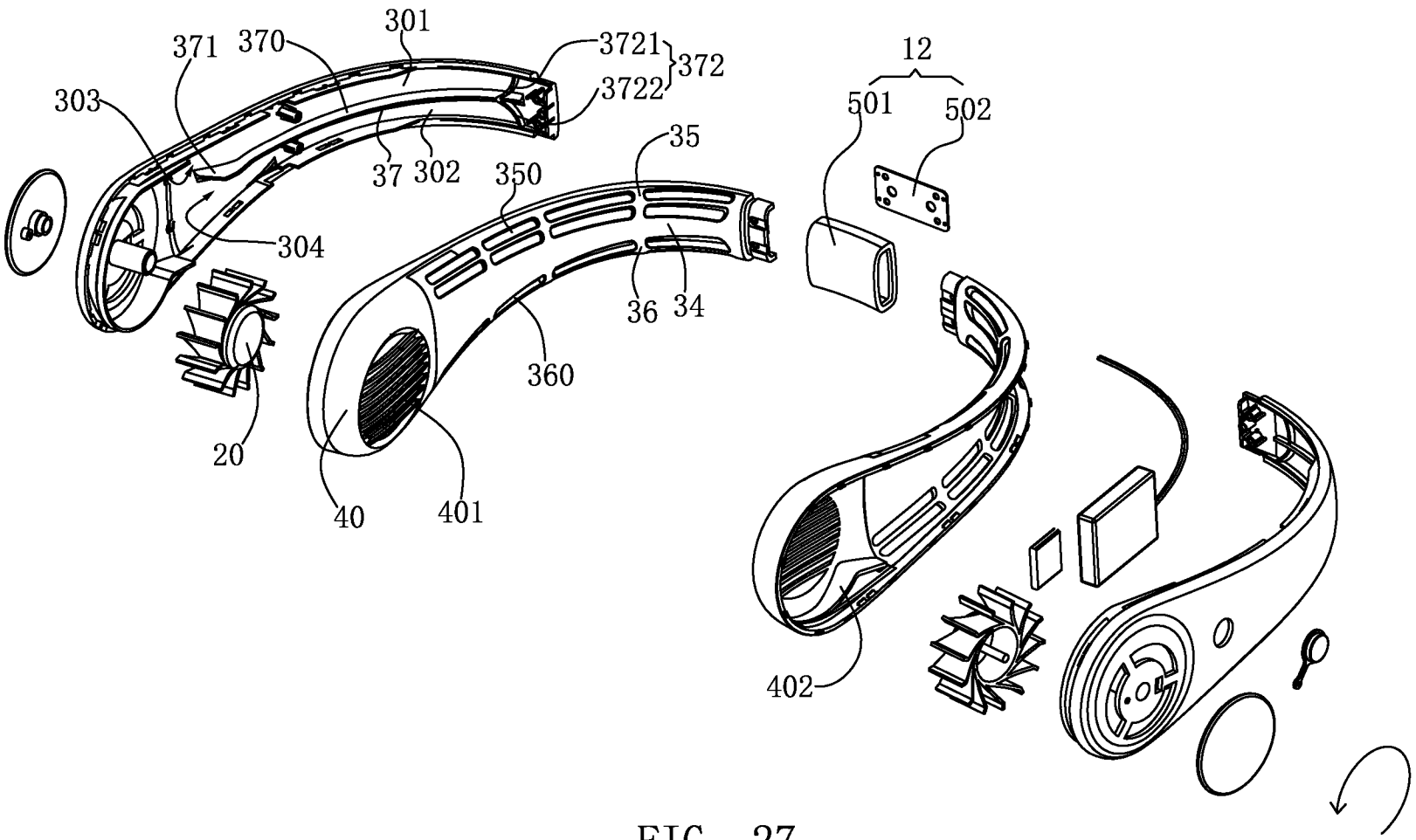
FIG. 27 is an exploded view of the portable blowing device of FIG. 26.

As shown in FIGS. 26-27, a portable blowing device provided in the present embodiment is a neck fan which comprises a body 10 and fans 20 disposed in the body 10. The neck fan can be hung on the neck of the user through the body 10, so as to cool the user conveniently.

The body 10 comprises arms 30 and end housings 40 connected to ends of the arms 30.

As shown in FIG. 26, the arm 30 comprises an inner side wall 31 close to the neck of the user and an outer side wall 32 away from the neck of the user. The inner side wall 31 comprises a middle area 34 close to the neck of the user, and a first section 35 and a second section 36 located on the upper and lower sides of the middle area 34 respectively. The first section 35 is provided with first air outlet openings 350, and the second section 36 is provided with second air outlet openings 360. It can be understood that the outer surface of the inner side wall 31 can have three faces with certain angles formed therebetween or adjacent faces being perpendicular to each other, the first section 35, the middle area 34 and the second section 36 are located on the three faces respectively, and the axis of the first air outlet openings 350 arranged in the first section 35 and the axis of the second air outlet openings 360 arranged in the second section 36 are arranged at a certain angle (or in parallel).

As shown in FIG. 27, an airflow channel is arranged in the arm 30. In the present embodiment, the arm 30 is preferably in an arc shape, and an air guiding member 37 is arranged in the arm 30. Specifically, in the present embodiment, the air guiding member 37 is in the shape of a strip and protrudes from an inner surface of the outer side wall 32, and the air guiding member 37 extends along the bending/lengthwise direction of the arm 30. A top surface of the air guiding member 37 (i.e., the top surface in the protruding direction) contacts with the inner surface of the inner side wall 31 (i.e., the surface of the inner side wall 31 close the airflow channel) and the shapes of the top surface of the air guiding member 37 and the inner surface of the inner side wall 31 completely match at the joint to ensure airtightness of the joint between the top surface of the air guiding member 37 and the inner surface of the inner side wall 31. The air guiding member 37 divides the interior space of the arm into a first airflow channel 301 and a second airflow channel 302, the first airflow channel 301 communicates with the first air outlet openings 350, and the second airflow channel 302 communicates with the second air outlet openings 360. In other embodiments, the air guiding member 37 may be omitted and only one airflow channel is provided in the arm 30, and the space formed between the inner side wall 31 and the outer side wall 32 acts as the airflow channel. The airflow generated by the fan 20 passes through the airflow channel and blows toward the neck of the user at multiple angles through the first air outlet openings 350 and the second air outlet openings 360, so as to achieve an improved cooling effect.

In the present embodiment, the first air outlet comprises a plurality of first air outlet openings 350 arranged in multiple rows and the second air outlet comprises a plurality of second air outlet openings 360 arranged in multiple rows so as to increase the area of the air outlet and improve cooling effect.

In the present embodiment, the air guiding member 37 comprises a body part 370 protruding from the inner surface of the outer side wall 32. An end close to the fan 20 is defined as a starting end, and an end away from the fan 20 is defined as a tail end. A guide plate 371 is provided at the starting end of the body part 370, and the guide plate 371 is offset from the extending direction of the body part 370. That is, the guide plate 371 is of an inclined plate structure extending inclinedly from the starting end of the body part 370. The starting end of the guide plate 371 is closer to the upper end of the outer side wall 32 while the tail end of the guide plate 371 is close to the lower end of the outer side wall 32. The tail end of the guide plate 371 is connected with the starting end of the body part 370. Therefore, the starting end of the guide plate 371 divides the entrance of the airflow channel into a first air entrance 303 and a second air entrance 304, the first air entrance 303 corresponds to the first airflow channel 301, and the second air entrance 304 corresponds to the second airflow channel 302, that is, the first air entrance 303 and the second air entrance 304 communicate with the first airflow channel 301 and the second airflow channel 302 respectively. The cross-sectional area of the first air entrance 303 is smaller than that of the second air entrance 304. In a preferred solution, the cross-sectional area of the first air entrance 303 is half of that of the second air entrance 304, and the volume of airflow entering the first airflow channel 301 and the volume of air entering the second airflow channel 302 are substantially the same. Due to the arrangement of the guide plate 371, part of the airflow blowing toward the first air entrance 303 is diverted to the second air entrance 304, so that the airflow entering the first airflow channel 301 and the second airflow channel 302 is more uniform, which allows the first air outlet and the second air outlet to discharge airflow uniformly, thus avoiding the discomfort caused by uneven air discharge from upper and lower sides of the arm 13.

The air guiding member 37 further comprises a wind stop plate 372 connected to the tail end of the body part 370, and the wind stop plate 372 stops at a tail end of the airflow channel. In the present embodiment, specifically, a first wind stop plate 3721 and a second wind stop plate 3722 are provided at the tail end of the body part 370. Two ends of the first wind stop plate 3721 are respectively connected with an upper inner surface of the outer side wall 32 and the body part 370 to stop the tail end of the first airflow channel 301, so that the airflow flows out of the first air outlets 350 after passing through the first airflow channel 301 and finally reaches the neck of the user for cooling. Two ends of the second wind shield 3722 are connected with a lower inner surface of the outer side wall 32 and the body part 370 respectively to stop the tail end of the second airflow channel 302, so that the airflow flows out of the second air outlets 360 after passing through the second airflow channel 302 and finally reaches the neck of the user for cooling.

Embodiment 11

Figure 28:
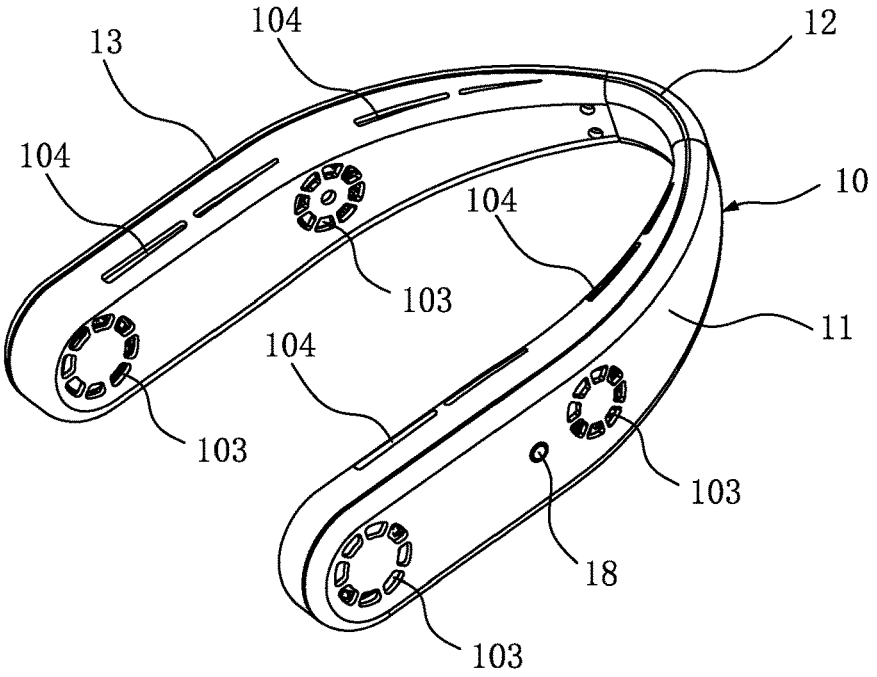
FIG. 28 is a perspective view of the portable blowing device according to Embodiment 11 of the present disclosure.
Figure 29:
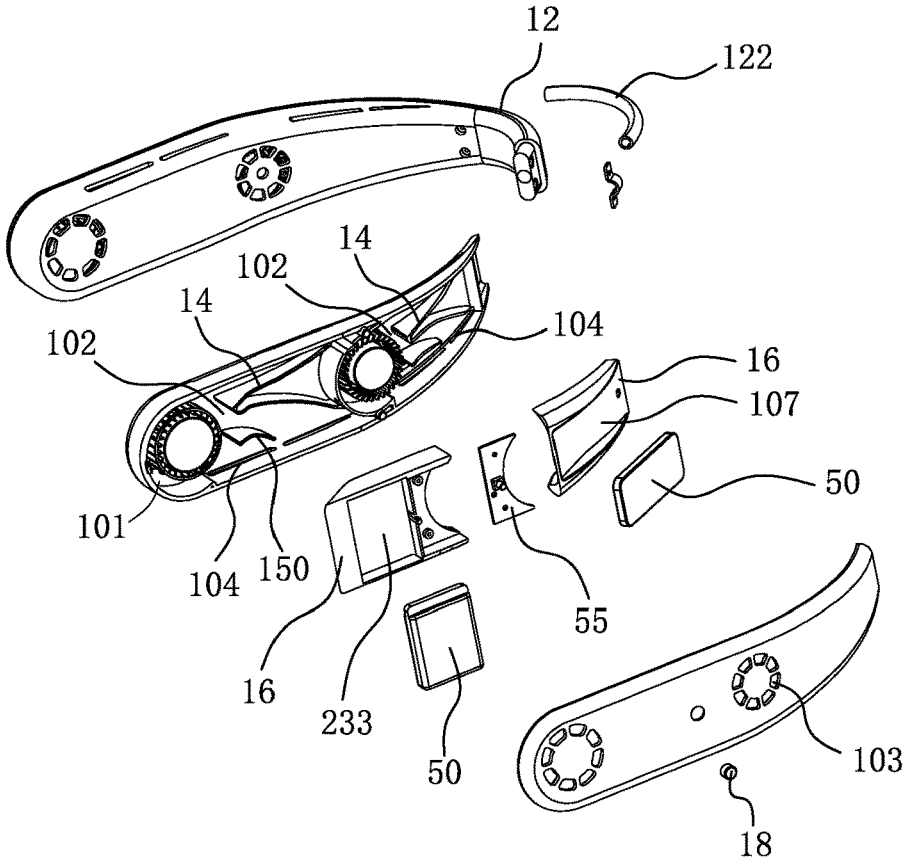
FIG. 29 is an exploded view of the portable blowing device in FIG. 28.
Figure 30:
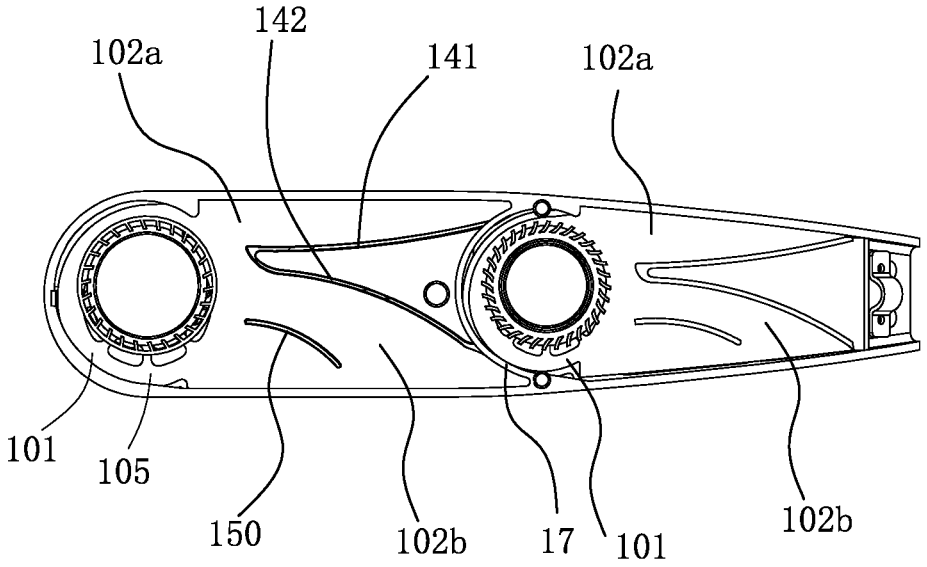
FIG. 30 is a side view of a first inner casing of the portable blowing device of FIG. 28.

As shown in FIG. 28 to FIG. 30, a portable blowing device provided in Embodiment 11 of the present disclosure can be worn on the neck of the human body, and comprises a body 10 and fans 20 arranged in the body 10.

In the present embodiment, the body 10 comprises a first arm 11, a second arm 13, and a flexible connecting section 12 connecting the first arm 11 with the second arm 13. A plurality of fans 20 are arranged in each of the first arm 11 and the second arm 13, for example, two fans 20 or three fans can be arranged in each of the first arm 11 and the second arm 13 to increase the airflow output of the portable blowing device. The flexible connecting section 12 is provided with a bending and shaping member 122 inside, and the bending and shaping member 122 is, for example, a shaping hose, so that the flexible connecting section 12 can maintain its bent shape after being bent.

Further, the first arm 11 and the second arm 13 of the body 10 are each provided with a receiving chamber 101, an airflow channel 102, an air inlet 103 and air outlets 104 corresponding to each fan 20, that is, each fan 20 has a receiving chamber 101, an airflow channel 102, air inlet 103 and air outlets 104 corresponding thereto. The receiving chamber 101 is used for receiving the fan 20, and the receiving chamber 101 communicates with the airflow channel 102 and the air inlet 103. A side wall of the airflow channel 102 is provided with the air outlets 104, and the airflow generated by the fan 20 passes through the airflow channel 102 and then blows out from the air outlets 104. The axis of the fan 20 and the center of the receiving chamber 101 are eccentric. A gap 105 is formed between the fan 20 and the inner surface of the sidewall of the receiving chamber 101. The gap 105 increases gradually from an end thereof to the other end thereof or the gap has an unequal width at opposite ends thereof. In this embodiment, the gap 105 is in the shape of "C", and the gap 105 gradually widens along the rotation direction of the fan 20. In the present embodiment, the airflow channels 102 of the first arm 11 and the second arm 13 are independent from each other and do not communicate with each other. The air inlet 103 are arranged on the inner and outer side walls of the first arm 11 and the second arm 13, and the air outlets 104 are arranged on the upper and lower side walls of the airflow channels 102.

Further, the body 10 is provided with an air guiding member 14 in each airflow channel 102, and the air guiding member 14 is connected to the inner and outer side walls of the airflow channel 102 and thus divides the airflow channel 102 into a first airflow channel **102*a* and a second airflow channel 102*b*. The side walls of the first airflow channel 102*a* and the second airflow channel 102*b* are both provided with air outlets 104, and the airflow generated by the fan 20 is guided to the air outlets 104 in the upper and lower side walls of the airflow channel 102 through the air guiding member 14. The air guiding member 14 comprises a first guiding plate 141 and a second guiding plate 142, one ends of the first guiding plate 141 and the second guiding plate 142 close to the fan 20 are connected with each other, and the other ends of the first guiding plate 141 and the second guiding plate 142 away from the fan 20 are connected to the side walls of the airflow channel 102. The first guiding plate 141 is used to define the shape of the first airflow channel 102*a*, so that the first airflow channel 102*a* is gradually enlarged from an end away from the fan 20 toward the fan 20, and the second guiding plate 142 is used to define the shape of the second airflow channel 102*b*, so that the second airflow channel 102*b* is gradually enlarged from an end away from the fan 20 toward the fan 20. Thus, the airflow generated by the fan 20 is gradually compressed after entering the first airflow channel 102*a* and the second airflow channel 102*b*, forming an air squeeze effect, whereby a strengthened airflow is generated at the air outlet openings 104 away from the fan 20**.

Further, referring to FIG. 30, the volume/width/cross section area of the first airflow channel **102*a* is smaller than that of the second airflow channel 102*b*, that is, the proportion of the first airflow channel 102*a* in the airflow channel 102 is smaller than the proportion of the second airflow channel 102***b* in the airflow channel 102. A curved guide vane 150 is arranged in the second airflow channel 102*b*. The guide vane 150 is bent away from the second guiding plate 142. The guide vane 150 is configured to divide/guide the airflow in the second airflow channel 102*b* to make the airflow exiting from the air outlet openings at different positions of the second airflow channel 102*b* more uniform. In other embodiments, the guide vane 150 can also be implemented as a straight plate, and the end of the guide vane 150 close to the fan 20 is higher than the end of the guide vane 150 away from the fan 20, that is, the end of the guide vane 150 away from the fan 20 is closer to the bottom wall of the airflow channel 102 than the end close to the fan 20.

In the present embodiment, the portable blowing device further comprises a battery 50, and a wind shield 16 and a receiving cavity 233 are arranged in the body 10. The wind shield 16 separates the airflow channel 102 from the receiving cavity 233, and the battery 50 is arranged in the receiving cavity 233 and electrically connected with the fan 20.

In the present embodiment, both the first arm 11 and the second arm 13 of the body 10 are provided with arc-shaped separators 17 (shown in FIG. 30). The separator 17 is arranged between two adjacent fans 20 accommodated in each arm (the first arm 11 and the second arm 13) and configured to separate the airflow channels 102 corresponding to the two adjacent fans 20. The separator 17 serves as a side wall of the receiving chamber 101 corresponding to the fan 20 away from the end of the housing. In other embodiments, the separator 17 may be formed in a plate shape or other shapes.

Further, the portable blowing device comprises a circuit board 55. A switch button 18 configured for controlling the fan 20 is arranged on the body 10. The circuit board 55 is electrically connected with the fan 20, the battery 50 and the switch button 18. The switch button 18 is used to control the start and stop of the fan 20 and the airflow speed.

Embodiment 12

Figure 31:
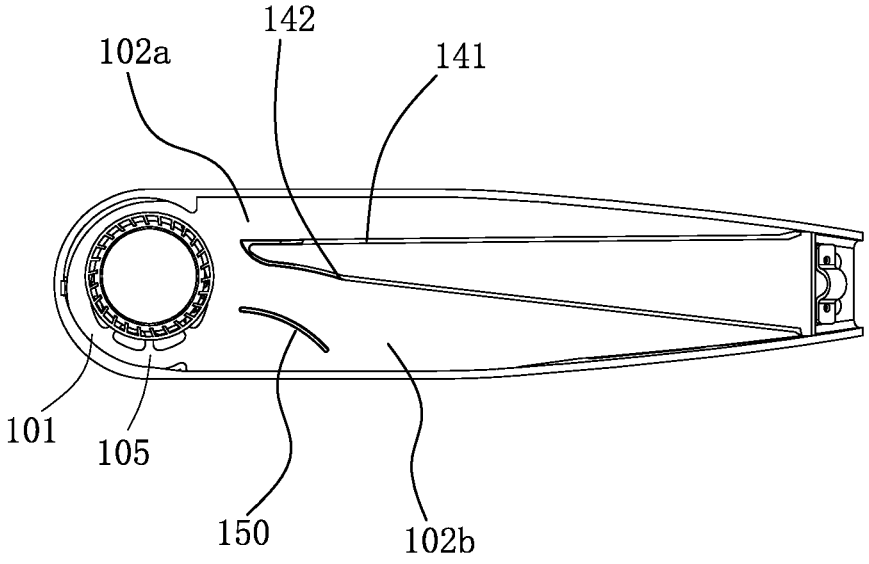
FIG. 31 is a side view of a first inner casing of the portable blowing device according to Embodiment 12 of the present disclosure.

FIG. 31 is a side view of a first inner casing of a portable blowing device according to the Embodiment 11 of the present disclosure. As shown in FIG. 31, a portable blowing device provided in the present embodiment is basically the same as the portable blowing device in Embodiment 11 (shown in FIG. 28 to FIG. 30), except that in the present embodiment, the first arm 11 and the second arm 13 are each provided with only one fan 20, and one receiving chamber 101, one airflow channel 102, one air guiding member 14, one guide vane 150 and one wind shield 16 corresponding to the fan 20. The inner and outer side walls of the receiving chamber 101 are provided with air inlets 103, and the upper and lower side walls of the airflow channel 102 are provided with air outlets 104.

Embodiment 13

Figure 32:
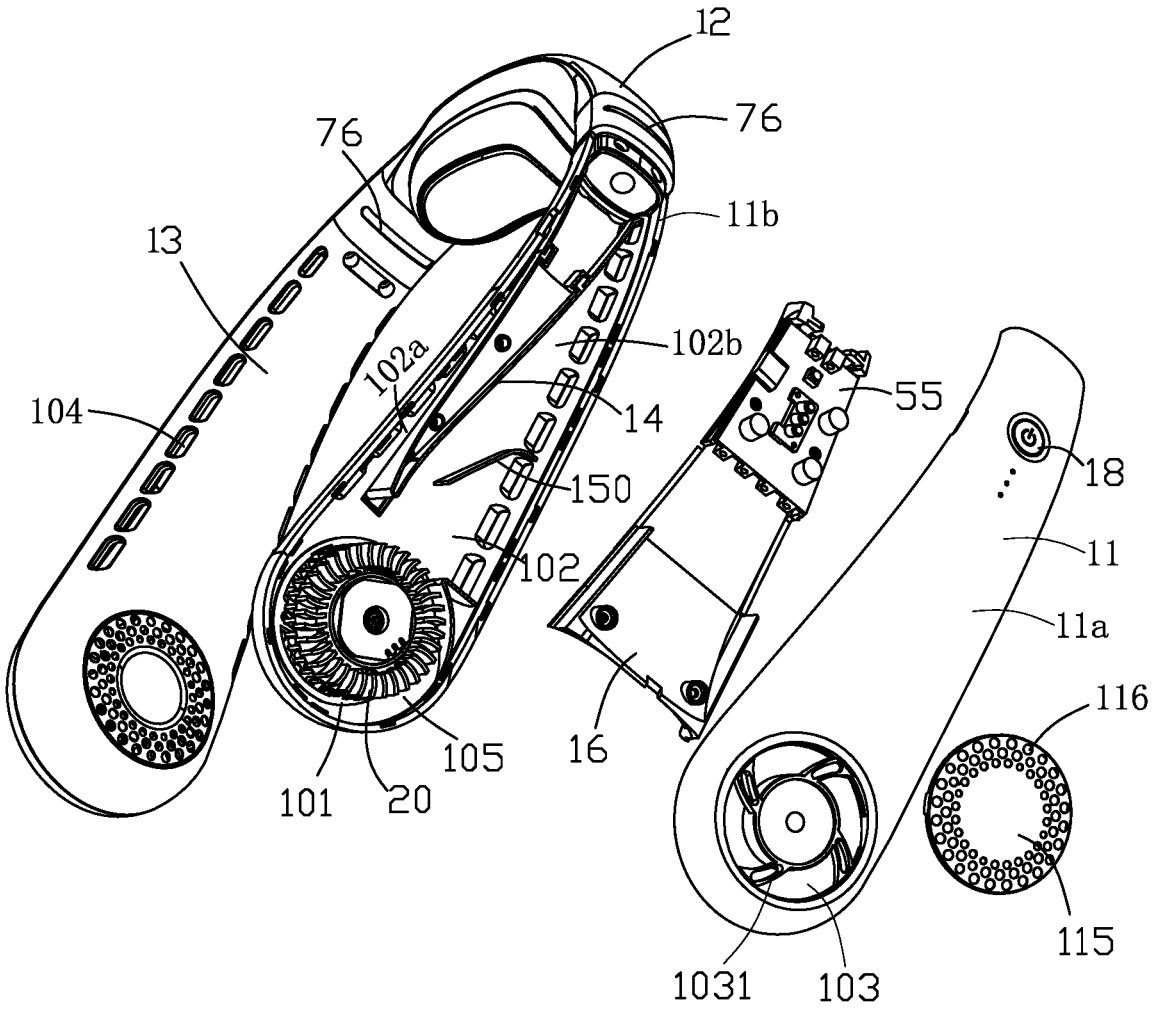
FIG. 32 is a partly exploded view of the portable blowing device according to Embodiment 13 of the present disclosure.
Figure 33:
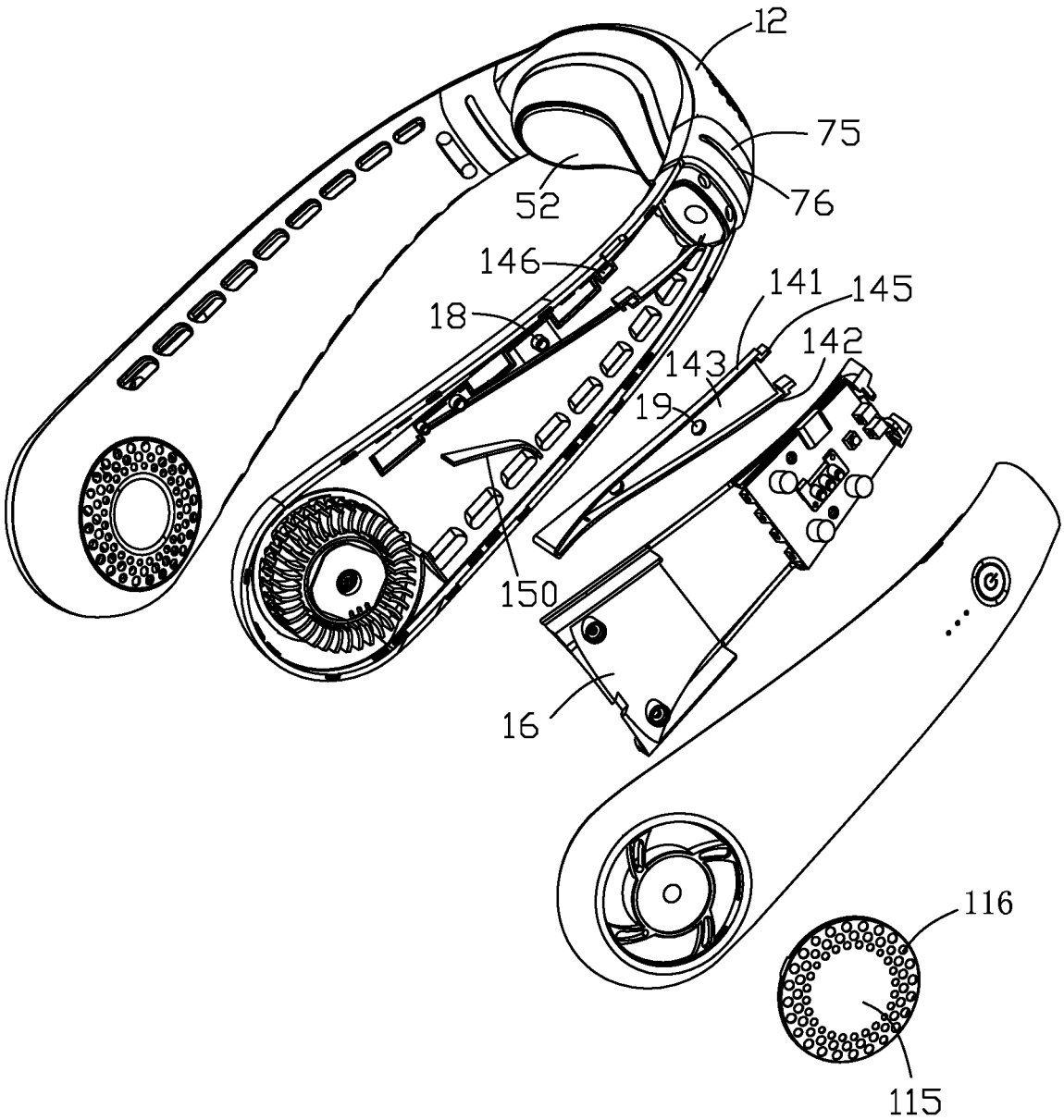
FIG. 33 is a further exploded view of the portable blowing device of FIG. 32.
Figure 34:
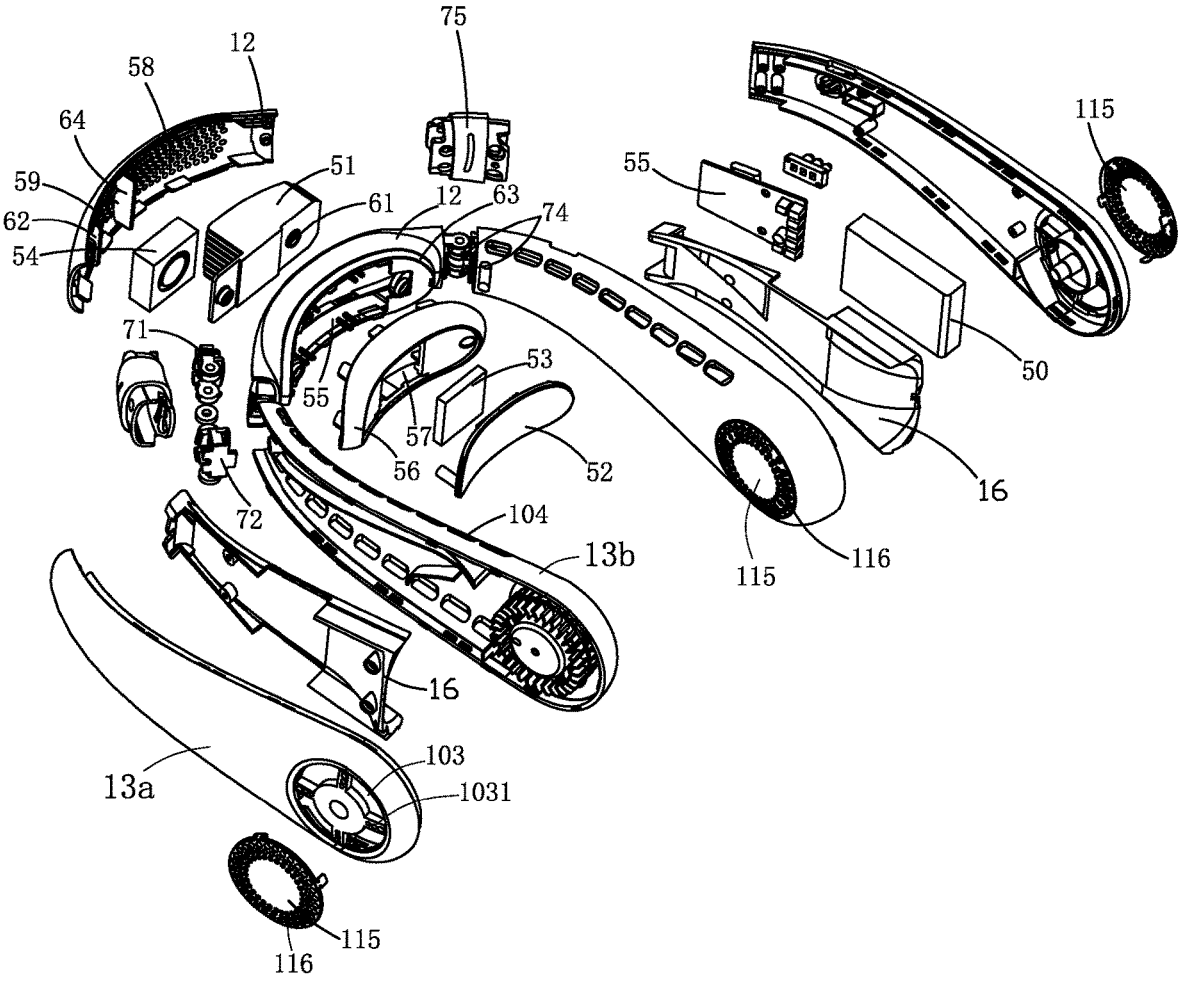
FIG. 34 is an exploded view of the portable blowing device of FIG. 32.
Figure 35:
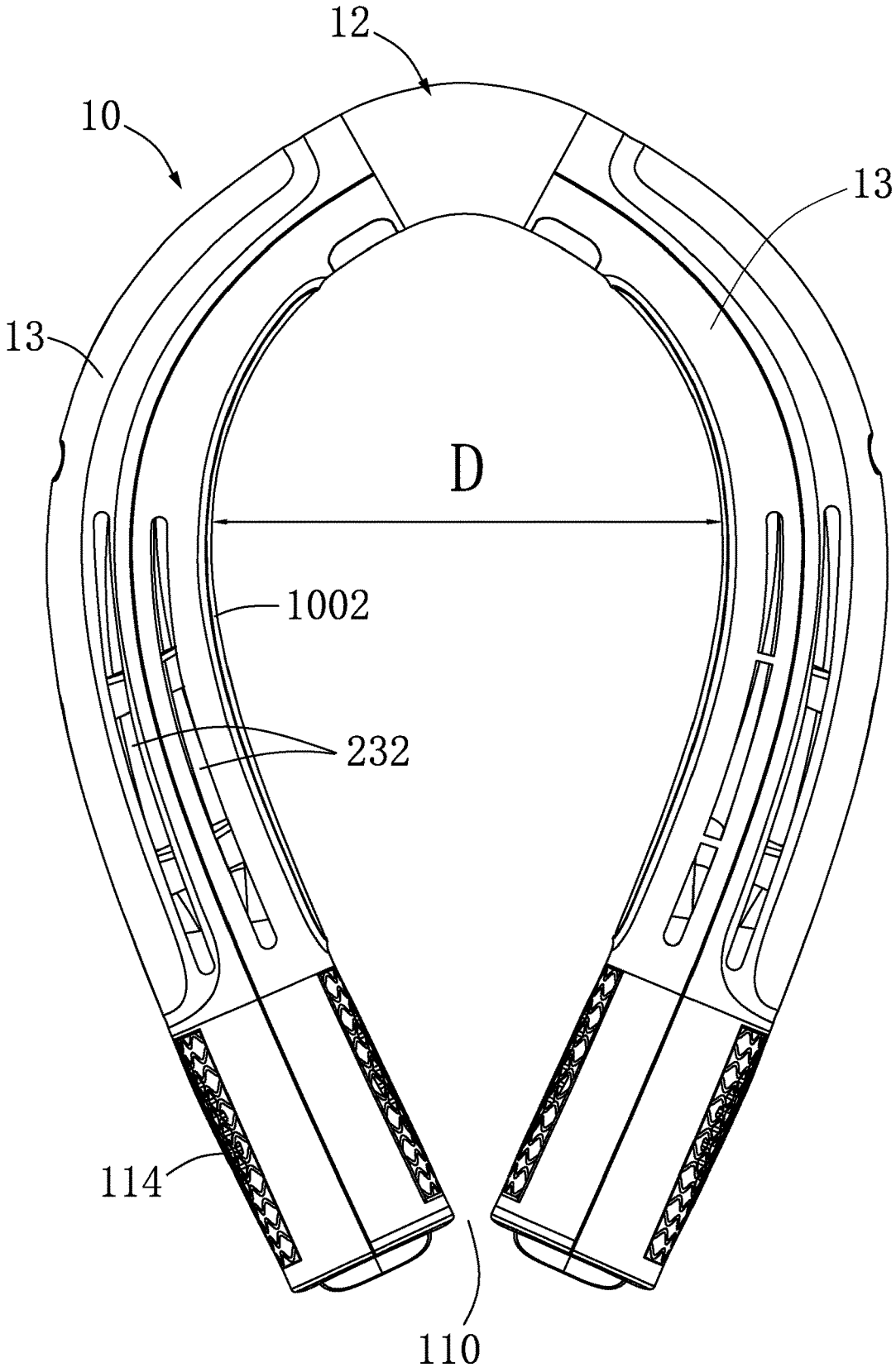
FIG. 35 is a perspective view of a portable blowing device according to the Embodiment 14 of the present disclosure.

As shown in FIG. 32 to FIG. 34, a portable blowing device provided in the present embodiment is basically the same as the portable blowing device in Embodiment 11 (as shown in FIG. 28 to FIG. 30). In the present embodiment, the portable blowing device also comprises a first arm 11, a second arm 13 and a connecting section 12 connecting the first arm 11 with the second arm 13, except that the first arm 11 and the second arm 13 are each provided with only one fan 20, and one receiving chamber 101, one airflow channel 102, one air guiding member 14, one guide vane 150 and one wind shield 16 corresponding to the fan 20. The inner and outer side walls of the receiving chamber 101 are provided with air inlets 103, the airflow channel 102 is divided into a first airflow channel 102*a* and a second airflow channel 102*b* by the air guiding member 14, the side walls of the first airflow channel 102*a* and the second airflow channel 102*b* are both provided with air outlets 104. The first arm 11 comprises a first outer casing 11*a* and a first inner casing 11*b*, and the second arm 13 comprises a second outer casing 13*a* and a second inner casing 13*b*. In the present embodiment, the air guiding members 14 in the first arm 11 and the second arm 13 are respectively assembled and fixed to the first inner casing 11*b* and the second inner casing 13*b* (i.e., the side wall of the airflow channel 102), and the split design facilitates the molding and manufacturing of the first inner casing 11*b*, the second inner casing 13*b* and the air guiding members 14.

Referring to FIG. 32, in the present embodiment, the axial center of the fan 20 and the center of the receiving chamber 101 are eccentrically arranged with a gap 105 formed between the fan 20 and the side wall of the receiving chamber 101. The gap 105 is C-shaped and gradually widens in the rotating direction of the fan 20. The gap 105 has opposite two openings at both ends thereof. In the present embodiment, the rotating direction of the fan 20 as shown in FIG. 32 is clockwise, and a larger one of the openings of the gap 105 faces the first airflow channel 102*a*. The airflow generated by the fan 20 blows obliquely toward the lower side wall of the airflow channel 102, that is, the airflow generated by the fan 20 tends to flow into the second airflow channel 102*b*, but the airflow generated by the fan 20 arrives at the entrance of the first airflow channel 102*a* firstly and then arrives at the entrance of the second airflow channel 102*b*. The volume of the first airflow channel 102*a* is designed to be smaller than that of the second airflow channel 102*b*, so that the air intake volume of the first airflow channel 102*a* is substantially equal to that of the second airflow channel 102*b*.

In the present embodiment, the first arm 11 and the second arm 13 are respectively rotatably connected with opposite ends of the connecting section 12 through rotating structures, that is, the first arm 11 and the second arm 13 can rotate relative to the connecting section 12 to adjust the width between the first arm 11 and the second arm 13, so that the user can easily put on the portable blowing device or remove the portable blowing device from the neck of the human body. The connecting section 12 is also provided with a semiconductor temperature control device which comprises a heat sink 51 arranged in the connecting section 12, a heat conducting member 52 arranged on the inner side wall of the connecting section 12, a semiconductor refrigeration sheet 53 mounted between the heat sink 51 and the heat conducting member 52, and a cooling fan 54 arranged at one end of the heat sink 51.

Specifically, the rotating structure comprises a first connecting member 71 and a second connecting member 72, one ends of the first connecting member 71 and the second connecting member 72 cooperate with each other through a pivoting structure consisted of a rotating shaft and a hole to realize rotary connection, and the other ends are respectively connected with the connecting section 12 and the first arm 11/second arm 13, for example, through screws or snap connection means, so that the first arm 11 and the second arm 13 can rotate inwardly or outwardly relative to the connecting section 12. Specifically, the first connecting member 71 comprises a first fixing part and two first pivot parts connected to an end of the first fixing part. The first pivot part defines a pivot hole. The second connecting member 72 comprise a second fixing part and a second pivot part connected to an end of the second fixing part. The second pivot part defines a pivot hole. In assembly, the first fixing part is extended and fixed into an end of the first arm 11 and the second fixing part is extended and fixed into an end of the second arm 13. The second pivot part is located between the two first pivot parts and the rotating shaft extends through the pivot holes to thereby pivot connect the first and second connecting members 71, 72.

Preferably, the rotating structure further comprises a damping member for increasing the frictional resistance of the first arm 11/second arm 13 when the first arm 11/second arm 13 rotating relative to the connecting section 12, and enabling the first arm 11/second arm 13 to stay at any rotating position stably relative to the connecting section 12, thereby preventing the first arm 11/second arm 13 from rotating relative to the connecting section 12 arbitrarily (without external force). In the illustrated embodiment, the damping member is a damping ring 74. There are two damping rings 74 which are respectively sandwiched between the second pivot part and the two first pivot parts.

In the illustrated embodiment, the rotating structure is enclosed with a silicone sleeve 75, and opposite ends of the silicone sleeve 75 are connected with the ends of the first arm 11 and the second arm 12 respectively. Preferably, some grooves 76 facilitating deformation of the silicone sleeve 75 may be formed in portions of the silicone sleeve 75 which are deformed along with deformation of the rotating structure, so that the silicone sleeve 75 is more easily bent and deformed along with the deformation of the rotating structure when the rotating structure rotates.

In the present embodiment, the inner and outer side walls of the arm corresponding to opposite sides of the fan 20 are respectively provided with protective covers 115. The protective cover 115 can be made of metal materials. The protective cover 115 is covered on the corresponding air inlet 103 and is provided with a plurality of ventilation holes 116 communicated with the air inlet 103. The ventilation holes 116 are ventilation mesh holes arranged on the protective cover 115 and communicated with the air inlet 103, so as to effectively prevent the user's hair from twisting into the fan 20. Further, a plurality of ribs 1031 are arranged in the air inlet 103 and divide the air inlet 103 into a plurality of air inlet openings, which can more effectively prevent sundries passing through the air inlet 103.

Embodiment 14

Referring to FIGS. 35 to 42, the present embodiment of the application provides a portable blowing device which includes a body 10, fans 20 arranged at opposite ends of the body 10, a temperature generating part 1001 arranged in the body 10 and a thermal conductive member 1002 arranged on the inner side wall of the body 10. The thermal conductive member 1002 is exposed outside the body 10 and thermally connected with the temperature regulation device 1001. The body 10 comprises two arms 13 and a connecting section 12 connecting the two arms 13. The connecting section 12 can restore to its original state after being elastically deformed. The arms 13 each include a connecting end connected with the connecting section 12 and a free end away from the connecting section 12. An opening 110 is formed between the free ends of the two arms 13. Under action of an external force, the two arms 13 of the body 10 can be moved away from each other and the connecting section 12 is elastically deformed to increase the size of the opening 110, so as to facilitate the user to wear the body 10 at a predetermined portion of the user for example the neck of the user.

In this embodiment, the body 10 includes two arms 13 and the connecting section 12 connecting the two arms 13. The thermal conductive member 1002 comprises two sections respectively secured on the inner side walls of the arms 13. After the connecting section 12 is elastically deformed, it can restore automatically. Under action of the external force, the two arms 13 of the body 10 can be moved away from each other to deform the connecting section 12 and increase the size of the opening 110, so as to facilitate the user to wear the body 10 at the predetermined portion of the human body. Moreover, when the body 10 is worn at the predetermined portion and the external force applied on the arms 13 is withdrawn, the inner walls of the arms 13 can be kept in contact with the human body through the automatic elastic restore of the connecting section 12, so as to increase wearing stability, make the wearing more comfortable and improve the wearing experience. Furthermore, the thermal conductive member 1002 exposed from the inner side wall of the body 10 can be maintained in contact with the skin of the human body so that the heat or cold provided by the temperature regulation device 1001 in the body 10 can be more effectively and efficiently transmitted to the human body, and the temperature regulation effect is better. By providing the connecting section 12, the size of the opening 110 of the body 10 does not need to be designed with surplus in advance according to different body shapes of different users. When wearing, the user is capable of holding the two arms 13 to move them away from each other and wear them at the predetermined portion of the user. The connecting section 12 is elastically deformed during wearing. After wearing, the connecting section 12 can restore automatically to cause the two arms 13 to move toward each other until the inner side wall of the body 10 contacts with the skin of the predetermined portion of the user.

Figure 36:
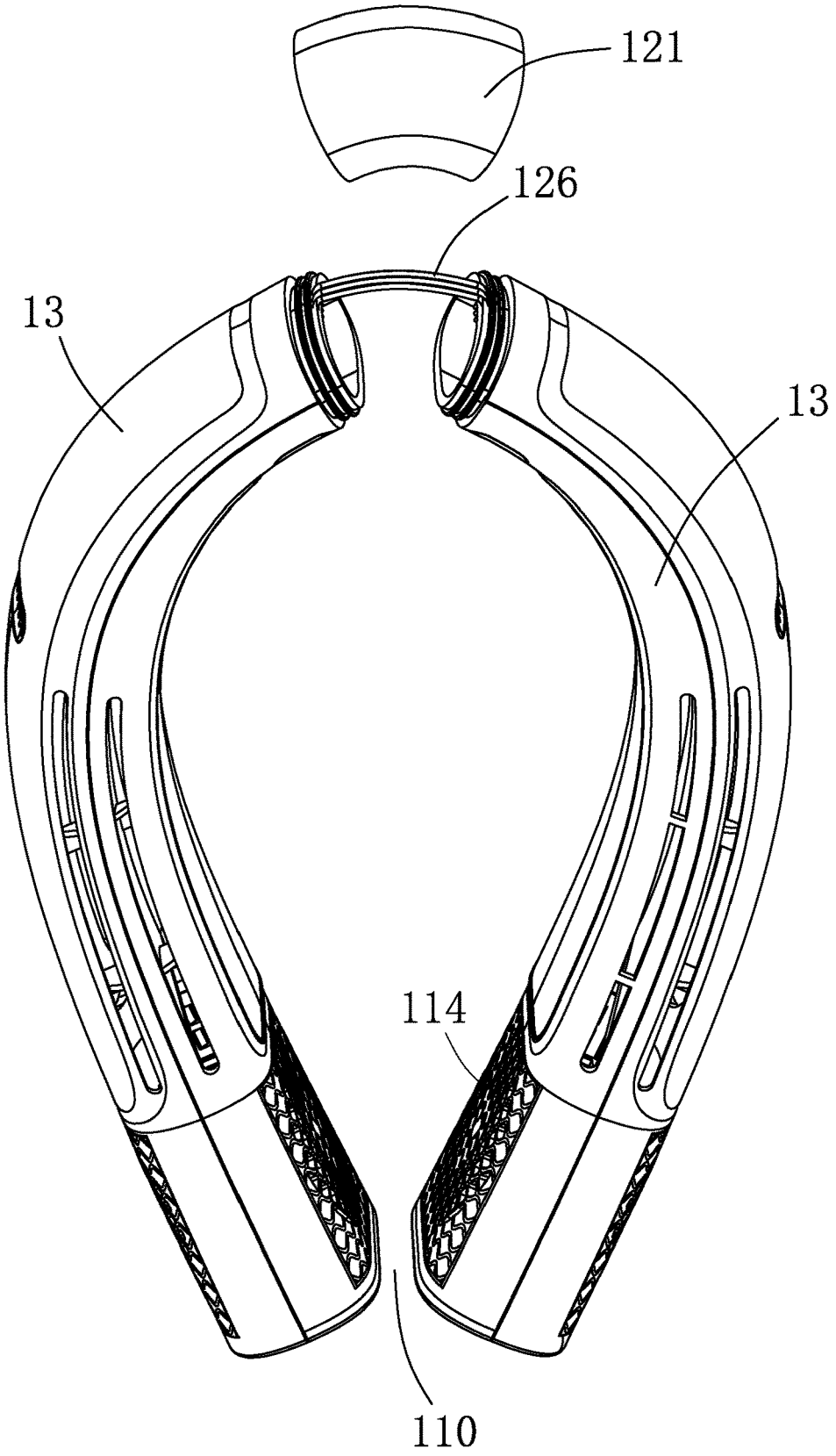
FIG. 36 is a partly exploded view of the portable blowing device shown in FIG. 35.
Figure 37:
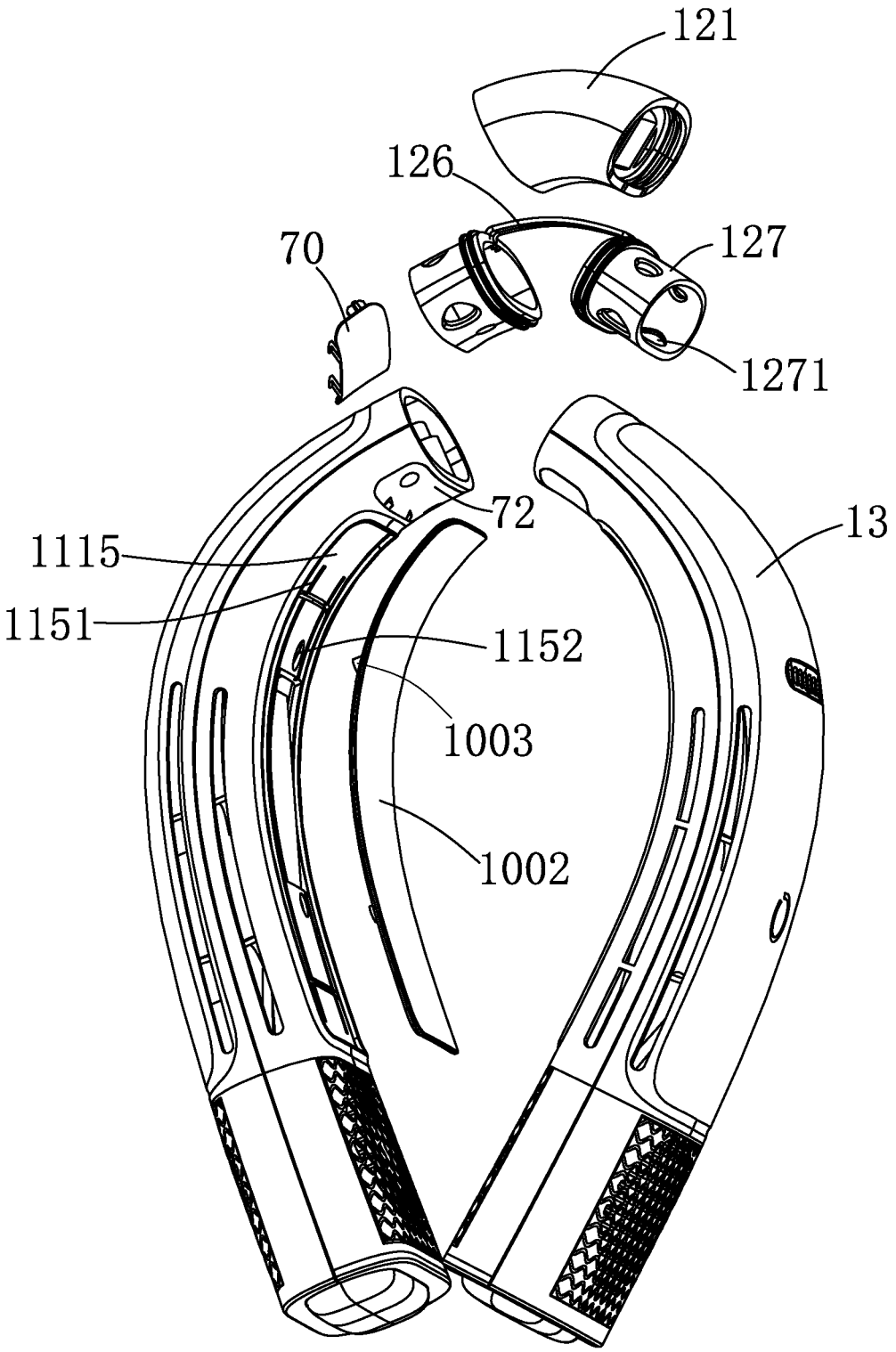
FIG. 37 is a further exploded view of the portable blowing device shown in FIG. 35.
Figure 39:
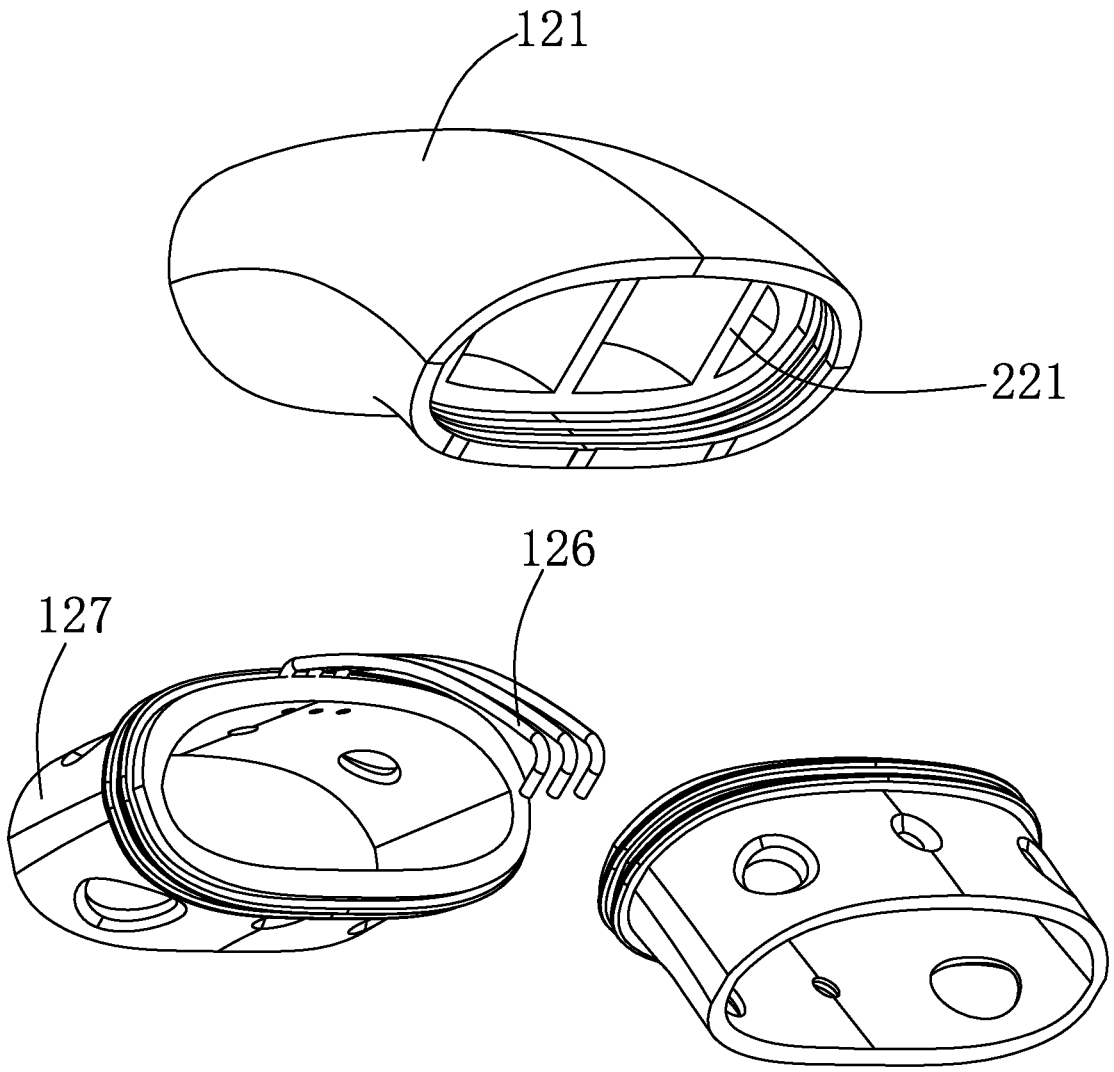
FIG. 39 illustrates a connecting member of the portable blowing device shown in FIG. 35.

Referring to FIG. 36 and FIG. 39, in the present embodiment, when the body 10 is in a natural/original state (no external force being applied to the arms 13), the size/width of the opening 110 is less than that of the spacing between the connecting ends of the two arms 13, that is, the size of the opening 110 is less than the length of the inner side wall of the connecting section 12. The maximum distance between the two sections of the thermal conductive member 1002 respectively secured on the inner side walls of the arms 13 is represented as D. Optionally, when the body 10 is located at the initial state (no external force exerted on the arms 13), 90 mm≤D≤110 mm. Thus, in the natural/original state the area of the region enclosed between the two arms 13 is usually smaller than that of the neck of the human body, so that the connecting section 12 has an enough large elastic pre-clamping force and after the body 10 is worn on the neck of the human body, the connecting section 12 tries to return to its original state to thereby provide an enough large elastic clamping force to the arms 13, so as to keep the inner side wall of the two arms 13 closely contacting with the human neck, which makes the wearing stable and the thermal conductive member 1002 on the inner side wall of the arm 13 in closely contact with the neck of the human body.

Figure 40:
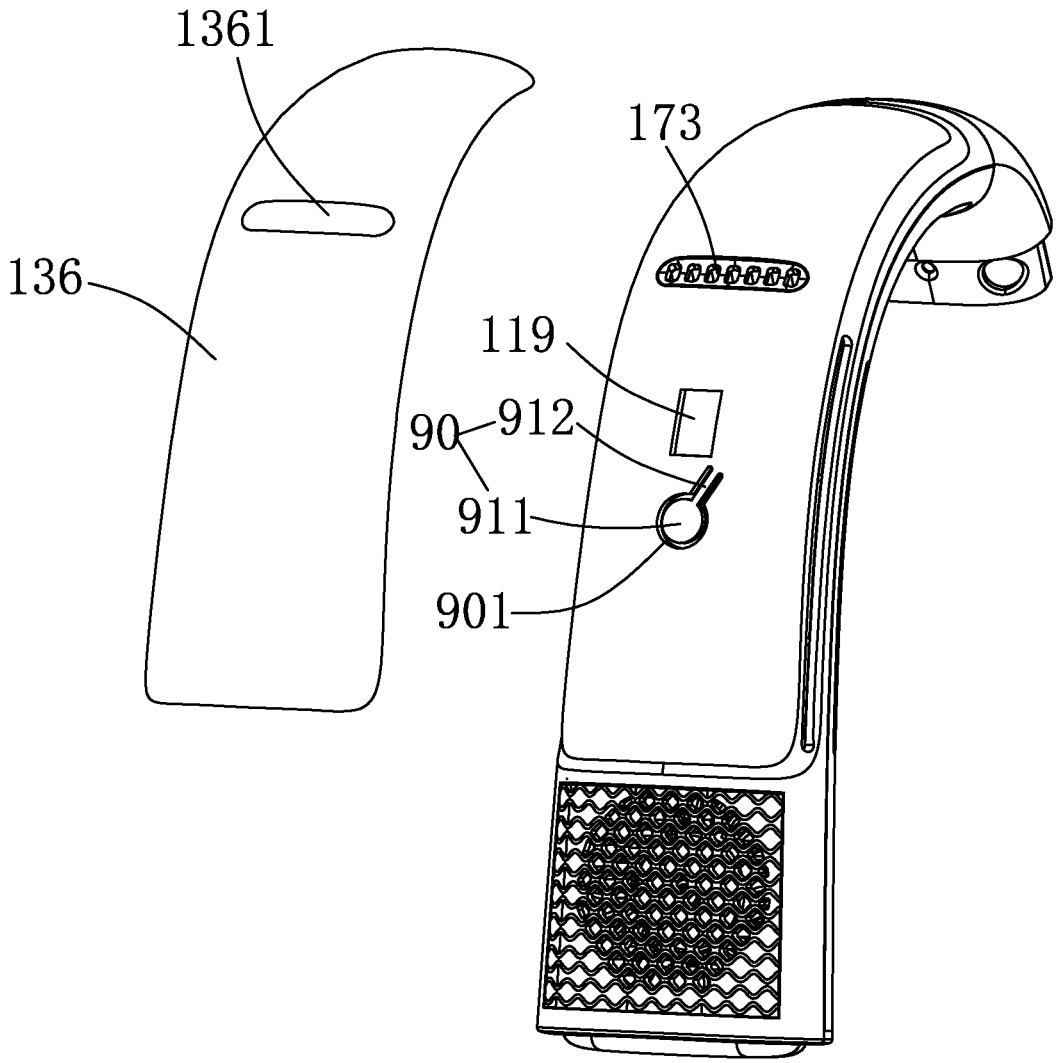
FIG. 40 is a partly exploded view of a housing of the portable blowing device of FIG. 35.
Figure 41:
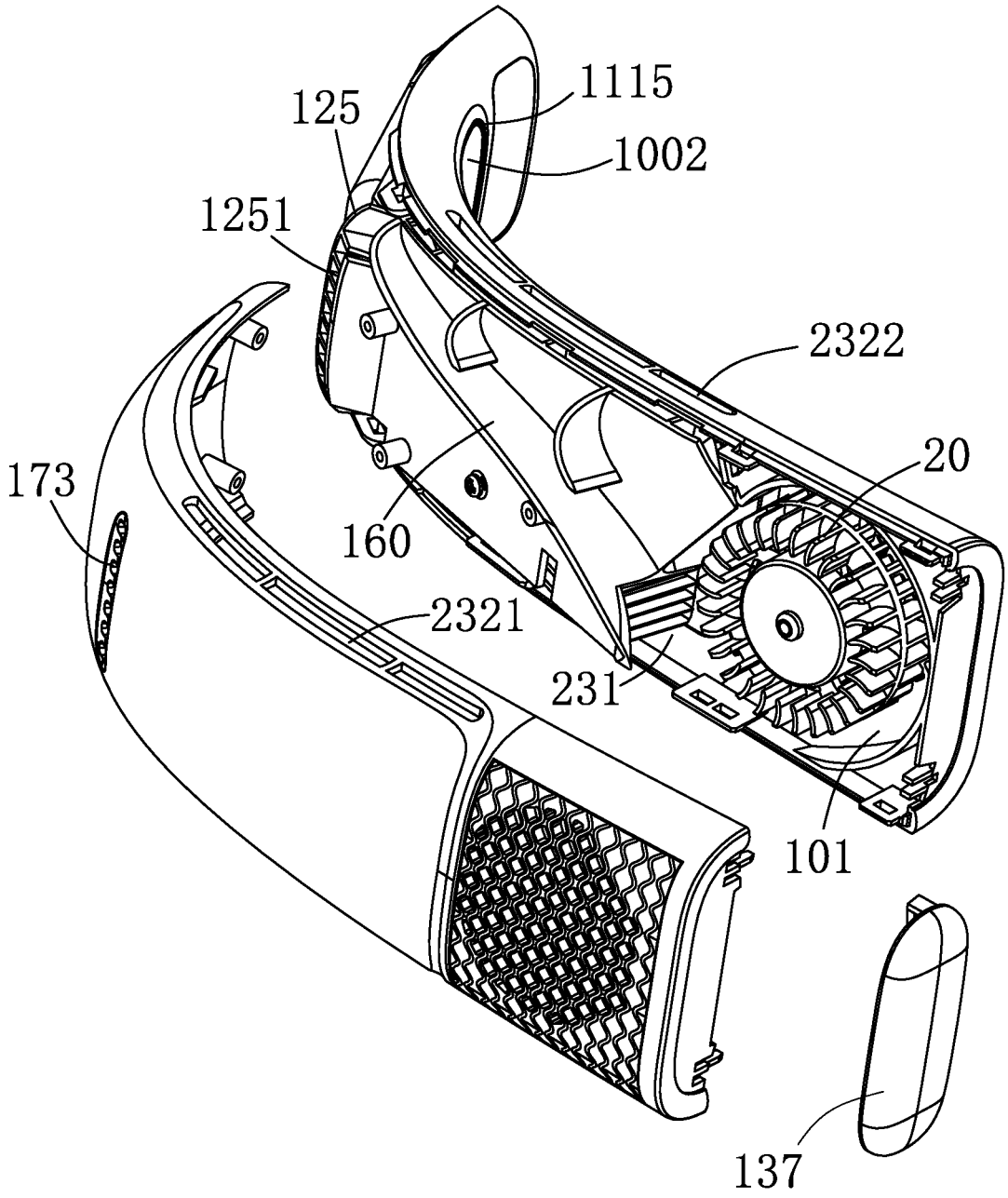
FIG. 41 is another exploded view of housing of FIG. 40.
Figure 42:
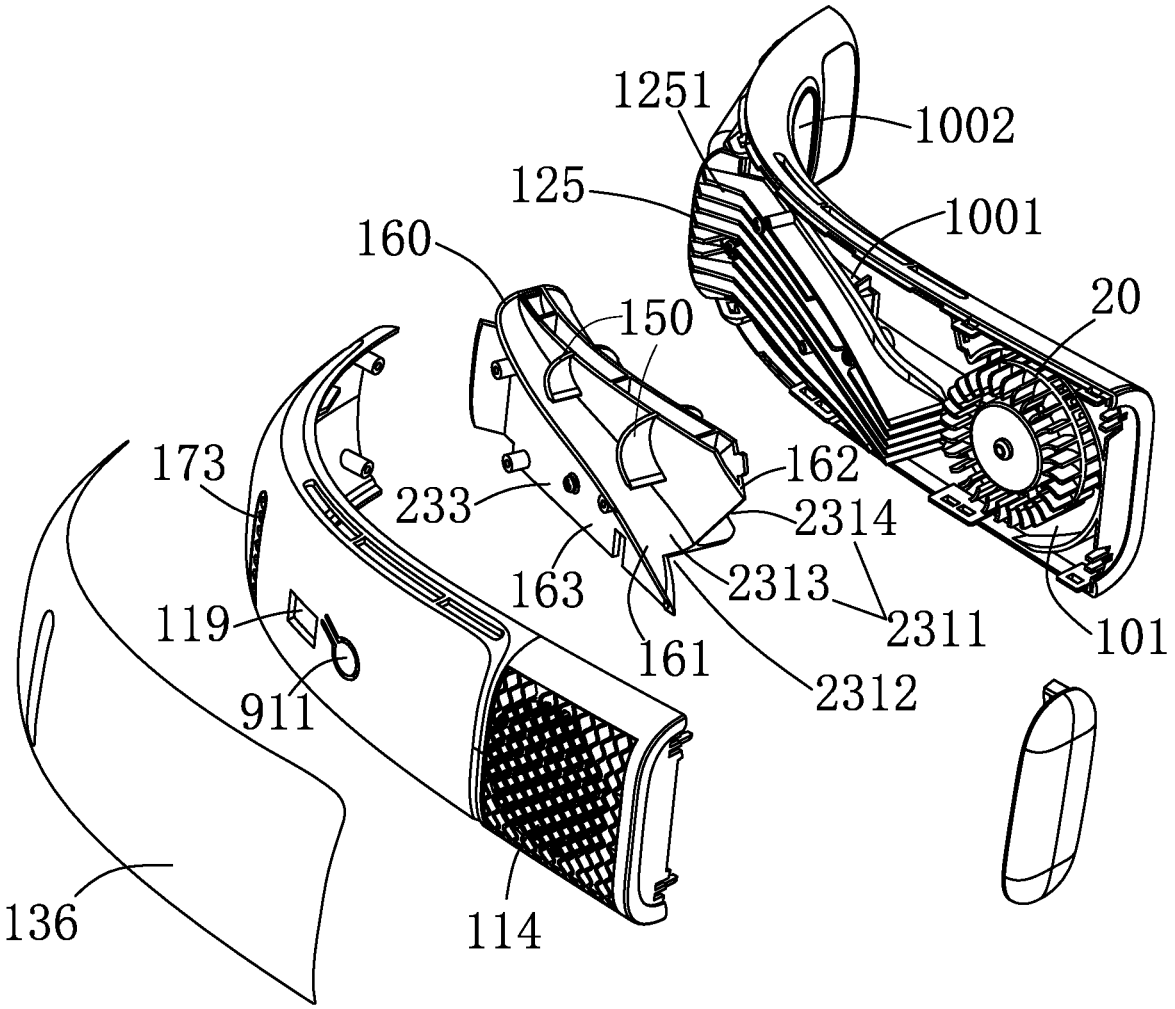
FIG. 42 is a further exploded view of the housing of FIG. 41.

Referring also to FIG. 40 to FIG. 42, alternatively, the body comprises two temperature regulation devices 1001 arranged in the two arms 13 respectively. The temperature regulation device 1001 can be a semiconductor refrigeration sheet capable of refrigeration and/or heating. The body comprises two thermal conductive members 1002 arranged on the inner side wall of the two arms 13 respectively. Each of the arms 13 is provided with a wind shield 160 which separates the internal space of the corresponding arm 13 into an airflow channel 231 and a receiving cavity 233 for receiving electronic components. The free end of the arm 13 is provided with a receiving chamber 101 for receiving the fan 20, and the receiving chamber 101 is in communication with the airflow channel 231. An air inlet 114 is formed in a portion of the arm 13 corresponding to the fan 20. An air outlet 232 is defined in the arm 13 and extends along the lengthwise direction of the arm 13. The airflow channel 231 is configured to connect the air inlet 114 and the air outlet 232. Each of the two arms 13 is provided with a temperature regulation device 1001 and a fan 20, which can effectively increase the temperature regulation efficiency of the portable blowing device and meet the temperature regulation needs of users. The arrangement of the wind shield 160 can improve the utilization efficiency of the internal space of the arm 13, avoid the influence of the heat generated by the electronic components received in the receiving cavity 233 on the temperature regulation function of the temperature regulation device 1001 and the fan 20, and make the installation of various elements inside the arm 13 compact and stable. Preferably, an accommodation groove 1115 is defined in the inner side wall of the arm 13 and the thermal conductive member 1002 is received in the accommodation groove 1115 so that the thermal conductive member 1002 does not protrude or excessively protrude out of the inner wall of the arm 13 after being secured to the inner wall of the arm 13, and the connection between the thermal conductive member 1002 and the inner side wall of the arm 13 can be more stable. The bottom of the accommodation groove 1115 is further sunken to form an adhesive receiving groove 1151 and a mounting hole 1152. The adhesive receiving groove 1151 can be conveniently used to hold the adhesive (glue) for sticking and fixing the thermal conductive member 1002 in the accommodation groove 1115 and to prevent the adhesive from overflowing from the accommodation groove 1115 to the contacting surface of the thermal conductive member 1002. The thermal conductive member 1002 is provided with a post 1003 which is configured to be secured into the mounting hole 1152 to thereby be fixed with the arm 13. The thermal conductive member 1002 is further provided with a convex contact part and the bottom of the accommodation receiving groove 1151 is provided with a through opening. The convex contact part extends through the through opening to contact with the temperature regulation device 1001 to thereby realize thermal conductive connection therewith.

Alternatively, the airflow channel 231 includes a first airflow channel 2311 and a second airflow channel 2312 arranged in parallel, and the wind shield 160 includes a first partition 161 that divides/separates the internal space of the corresponding arm 13 into the first airflow channel 2311 and the second airflow channel 2312, a second partition 162 that separates the first airflow channel 2311 into the first sub airflow channel 2313 and the second sub airflow channel 2314, and a third partition 163 that separates the second airflow channel 2312 from the accommodation cavity 233. Specifically, the second partition 162 and the third partition 163 are located on the upper and lower sides of the first partition 161 respectively. The second partition 162 comprises two plates and ends of the two plates close to the fan 20 are connected to each other to form a tip guide part for quickly guiding the air flow generated by the fan 20 into the first sub airflow channel 2313 and the second sub airflow channel 2314 respectively. A cavity is formed between the two plates, which can absorb noise generated by the air flow hitting the second partition 162. In other embodiments, the second partition 162 can also be composed of only one plate.

The arm 13 is provided with a first sub air outlet 2321 communicated with the first sub airflow channel 2313, a second sub air outlet 2322 communicated with the second sub airflow channel 2314 and a heat dissipation hole 173 communicated with the second airflow channel 2312. The first sub airflow channel 2313 and the second sub airflow channel 2314 both are provided with a flow guide 150 respectively, and the temperature regulation device 1001 is arranged in the second airflow channel 2312. A circuit board (not shown in the figure) is arranged in the receiving cavity 233 of at least one of the arms 13, and the temperature regulation device 1001 and the fan 20 are electrically connected with the circuit board respectively. In the present embodiment, each of the two arms 13 is provided with a circuit board, and the two circuit boards are also electrically connected with each other. The wind shield 160 divides the internal space of the corresponding arm 13 into a plurality of sub airflow channels and receiving cavities 233 independent from each other. Accordingly, the air outlet 232 on the arm 13 includes a plurality of sub air outlets each corresponding to and communicating with a corresponding one of the sub airflow channels. The first sub airflow channel 2313 and the second sub airflow channel 2314 can be used to transfer the air flow generated by the fan 20 to the corresponding sub air outlets and then to the human body, and the second airflow channel 2312 can be used as a heat dissipation channel for the temperature regulation device 1001 to dissipate the heat generated by 1001 through the heat dissipation hole 173, which is conducive to smooth air flow in each airflow channel, avoid disorder and noise, and improve the blowing efficiency and heat dissipation efficiency. Optionally, the second airflow channel 2312 is provided with a heat sink 125 for dissipating heat from the temperature regulation device 1001. The heat sink 125 defines a plurality of slots 1251, and the ends of the slots 1251 face and are in communication with the heat dissipation hole 173, so that a portion of the air flow generated by the fan 20 passing through the slots 1251 takes away the heat of the heat sink 125, and the heat can be quickly discharged via the heat dissipation hole 173 to improve the heat dissipation efficiency.

When the portable blowing device is used for refrigeration, it can generate air flow through the fan 20 for cooling. At the same time, the portable blowing device can also adjust the temperature of the thermal conductive member 1002 in contact with the skin of the human body by adjusting the temperature regulation device 1001, and thus realizes a cool effect through the contact of the thermal conductive member 1002 with the skin of the wearing part of the human body. When the portable blowing device is used for heating, the fan 20 does not operate to generate air flow, and the heating Part 1001 is controlled to generate heat to adjust the temperature of the thermal conductive member 1002 in contact with the skin of the wearing part of the human body, to thereby provide heating to the user through the contact of the thermal conductive member 1002 with the skin of the wearing part of the human body. The portable blowing device of the present embodiment can realize more accurate heat dissipation and cooling or heating for the human body, with better temperature regulation performance and higher heat dissipation or heating efficiency, which can meet various needs of users.

Figure 4:
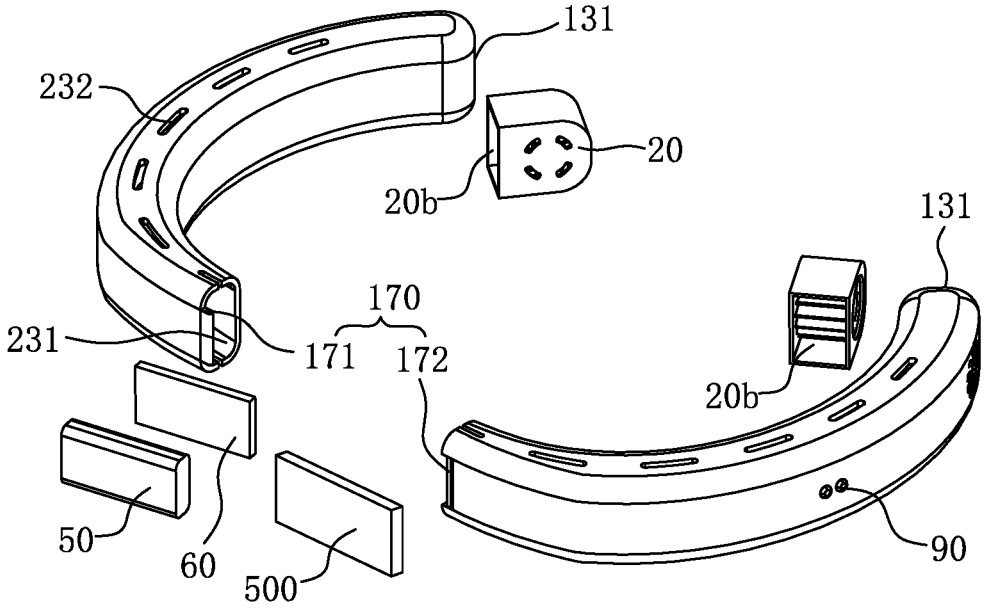
FIG. 4 is similar to FIG. 3 but viewed from another aspect.
Figure 5:
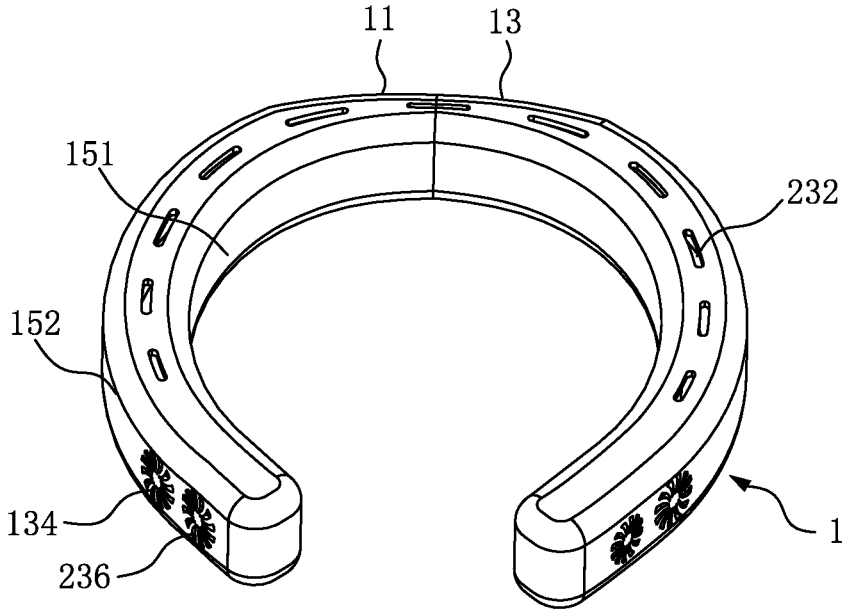
FIG. 5 is a perspective assembled view of a portable blowing device according to Embodiment 2 of the present disclosure.
Figure 6:
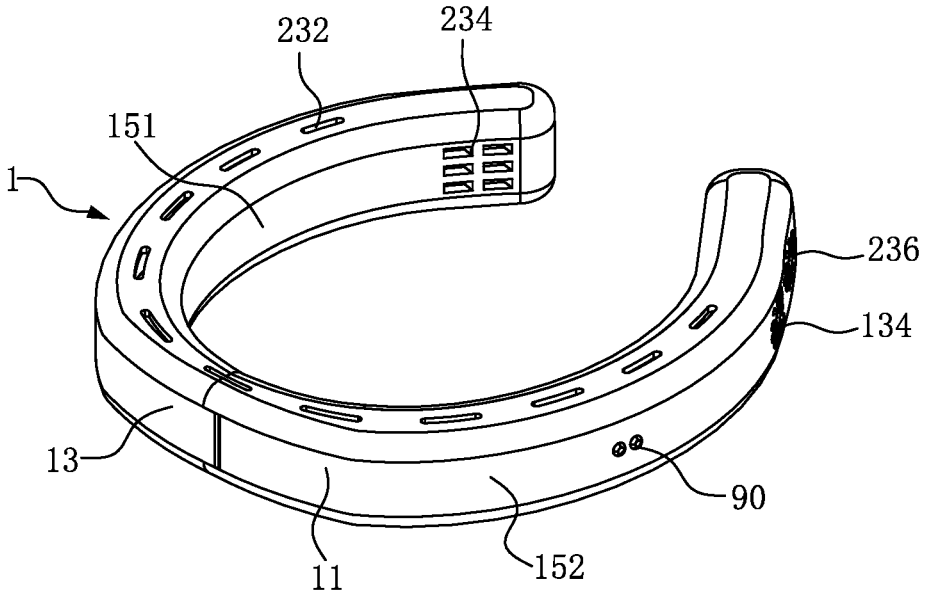
FIG. 6 is similar to FIG. 5 but viewed from another aspect.
Figure 7:
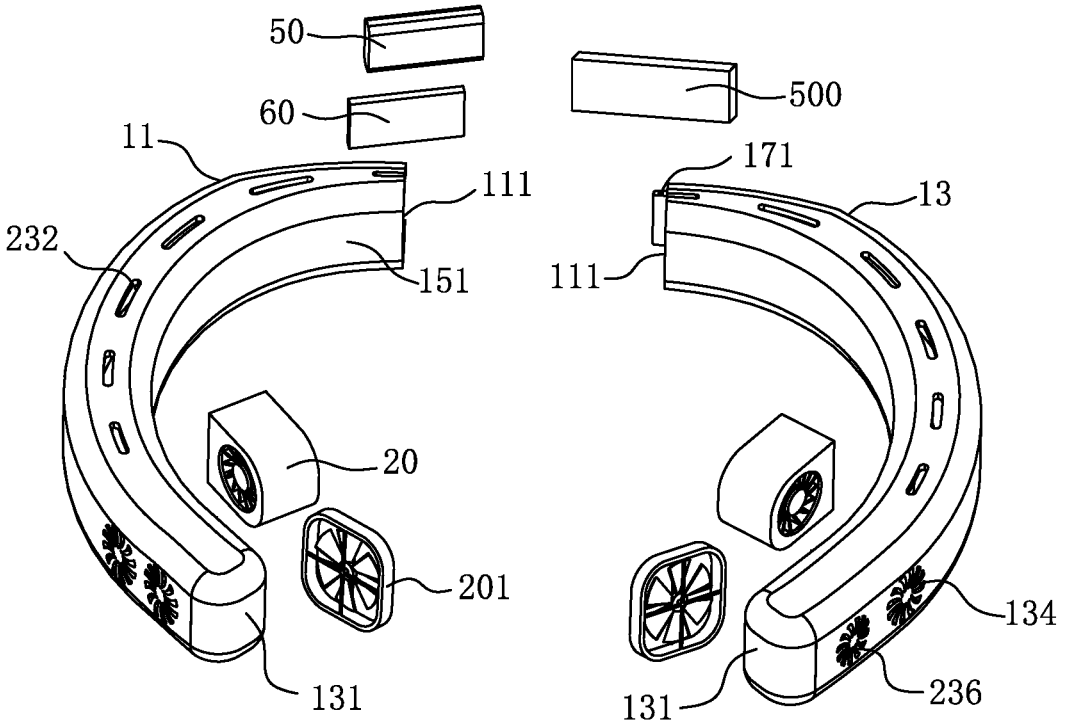
FIG. 7 is a partially exploded view of FIG. 6.
Figure 8:
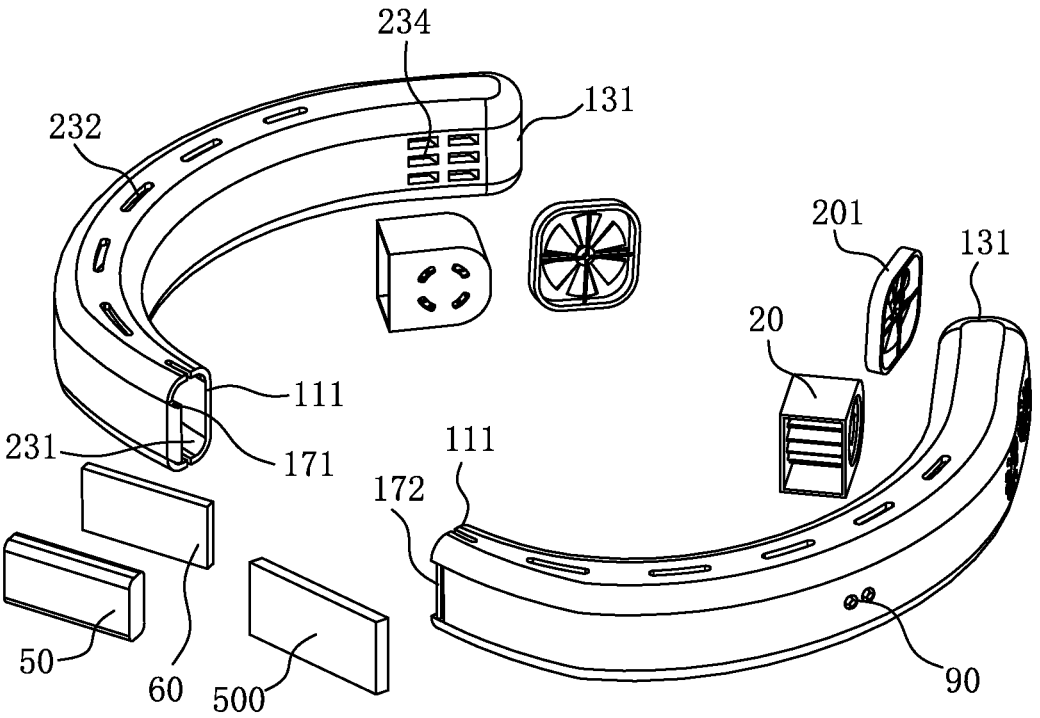
FIG. 8 is similar to FIG. 7 but viewed from another aspect.

In the present application, "thermal conductive connection" comprises direct heat transfer between two objects that contact with each other directly, and indirect heat transfer between two objects that connect with each other via an intermediate object therebetween. For example, indirect heat transfer can be achieved through intermediate heat conductive media such as heat conductive silicone grease/gel or graphite disposed between two objects. Optionally, the arm 13 is also provided with a battery 50 for supplying power to the corresponding fan 20 and the temperature regulation device 1001. In each arm 13, the battery 50, the temperature regulation device 1001 and the fan 20 are arranged in sequence along the lengthwise direction of the arm 13. The battery 50 is located near the connecting end 112 of the arm 13, and the fan 20 is located near the free end of the arm 13, which can avoid increasing the thickness or width of the arm 13, effectively balance the weight of the body 10, improve the lightweight wearing experience, and make the wearing more stable and not easy to fall from the human body. Of course, in other embodiments, if the weight balance of the body 10 is not pursued, positions of the battery 50 and the circuit board can be interchanged, that is, the battery 50 is accommodated in the receiving cavity 233, and the circuit board is arranged at the position where the battery 50 is arranged as shown in FIG. 4.

The inner side wall of the body 10, the inner side wall of the arm 13 and the inner side wall of the connecting section 12 refer to the side wall facing the user's neck when the device is worn on the user's neck, and the outer side wall refers to the side wall away from the user's neck. The thermal conductive member 1002 being arranged on the inner side wall of the arm 13 comprises the thermal conductive member 1002 being directly and integrally formed as a part of the inner side wall of the arm 13, and the thermal conductive member 1002 being made of a material different from the arm 13 and being fixed on the inner side wall of the arm 13. The thermal conductive member 1002 can be made of metal material or soft rubber material with high heat conduction efficiency, such as aluminum material or heat conductive silica gel material. In the present embodiment, the thermal conductive member 1002 is made of aluminum material and is only arranged on the inner side wall of the arm 13. In other embodiments, the thermal conductive member 1002 can be made of heat conductive silica gel material and the thermal conductive member 1002 is arranged on the inner side walls of the two arms 13 and the inner side wall of the connecting section 12, so as to increase the contact area between the thermal conductive member 1002 and the human body and widen the temperature regulation range. The thermal conductive member 1002 made of heat conductive silica gel will not affect the elastic deformation of the connecting section 12.

Optionally, the connecting section 12 includes an inner core 126 connected between the connecting ends of the two arms 13. The inner core 126 can restore to its original state after being elastically deformed. Preferably, the inner core 126 is arcuate-shaped so that the inner core 126 can automatically return to be arcuate-shaped after being elastically deformed, so as to apply a clamping/squeezing force to the two arms 13 to urge them toward each other. Thus, the inner side walls of the two arms 13 closely contact with the neck of the human body. Further preferably, the inner core 126 is elongated and connected between the side edges of the connecting ends 112 of the arms 13, that is, the inner core 126 is connected with the edges of the connecting ends 112 of the housing of the body, so that a force required to make the inner core 126 be deformed can be small and the user can use a small force to move the two arms 13 away from each other to increase the size of the opening 110. After the inner core 126 returns to the original state, the arms 13 will not clamp or squeeze the user's body too tightly when they are close to the user's body. In the present embodiment, the inner core 126 includes a plurality of metal parts spaced apart from each other, such as a plurality of parallel and spaced steel wires/rods. The number of the metal parts can be 2, 3 or more. The inner core 126 is composed of a plurality of elongated metal parts, so it is convenient to adjust the tensile force required for the deformation of the inner core 126 and adjust the force of the inner core 126 urging the arms 13 against the user's body by changing the diameter and number of the metal parts. In the present embodiment, the inner core 126 includes three spaced metal steel wires/rods, and the inner core 126 is connected to the outer edge of the connecting end of the housing of the body. In other embodiments, the inner core 126 can include two spaced steel wires/rods, which are respectively connected to opposite two edges of the connecting ends, for example, connected to the upper edges and lower edges of the connecting ends, or in other embodiments, the inner core 126 may also be made of a relatively hard plastic material that can elastically restore to its original state.

The inner core 126 being connected between the connecting ends of the arms 13 comprises direct connection between the inner core 126 and the connecting ends of the arms 13, or indirect connection between the inner core 126 and the connecting ends of the arms 13. In an optional embodiment, the connecting section 12 also includes two connecting members 127 respectively connected with opposite ends of the inner core 126. The two connecting members 127 are respectively connected to the connecting ends of the two arms 13, and the inner core 126 is connected to the two arms 13 through the two connecting members 127. The connecting members 127 are hard plastic blocks respectively matching the connecting ends. Opposite ends of the inner core 126 are injection molded with the connecting members 127, and are connected to the connecting ends of the arms 13 through the connecting members 127.

The connecting member 127 is provided with one or more positioning holes 1271, the connecting end of the arm 13 is provided with one or more through holes 117 respectively corresponding to the positioning holes 1271, and the connecting end of the arm 13 is also provided with a positioning column 107 in which the through hole 117 is defined. The connecting ends of the arms 13 are of hollow structure. When the connecting member 127 is inserted into the interior of the connecting end 112 of the corresponding arm 13, the positioning column 107 is inserted into the positioning hole 1271 and the connecting member 127 is fixedly connected with the corresponding arm 13 via a fastener for example a screw passing through the positioning hole 1271 and the through hole 117. A recessed mounting part 72 is formed in a portion of the inner side wall where the connecting end of the arm 13 is connected with the connecting member 127. The through hole 117 is arranged in the recessed mounting part 72. The arm 13 further includes a cover 70 detachably installed at the recessed mounting part 72 to shield the through hole 117 and a part of the fastener exposed from the recessed mounting part 72, which can not only simplify the installation and connection between the inner core 126 and the arms 13, but also keep the appearance of the body 10 simple and aesthetic. The cover 70 can be detachably installed at the recessed mounting part 72 through cooperation of buckles/barbs/hooks and snap holes. In the present embodiment, the peripheral portion of the recessed mounting part 72 is provided with a plurality of snap holes, the peripheral portion of a side of the cover 70 facing the recessed mounting part 72 is provided with a plurality of buckles/barbs/hooks corresponding to the snap holes respectively. The cover 70 is detachably installed at the recessed mounting part 72 by the buckles/barbs/hooks being engaged into the corresponding snap holes.

Figure 38:
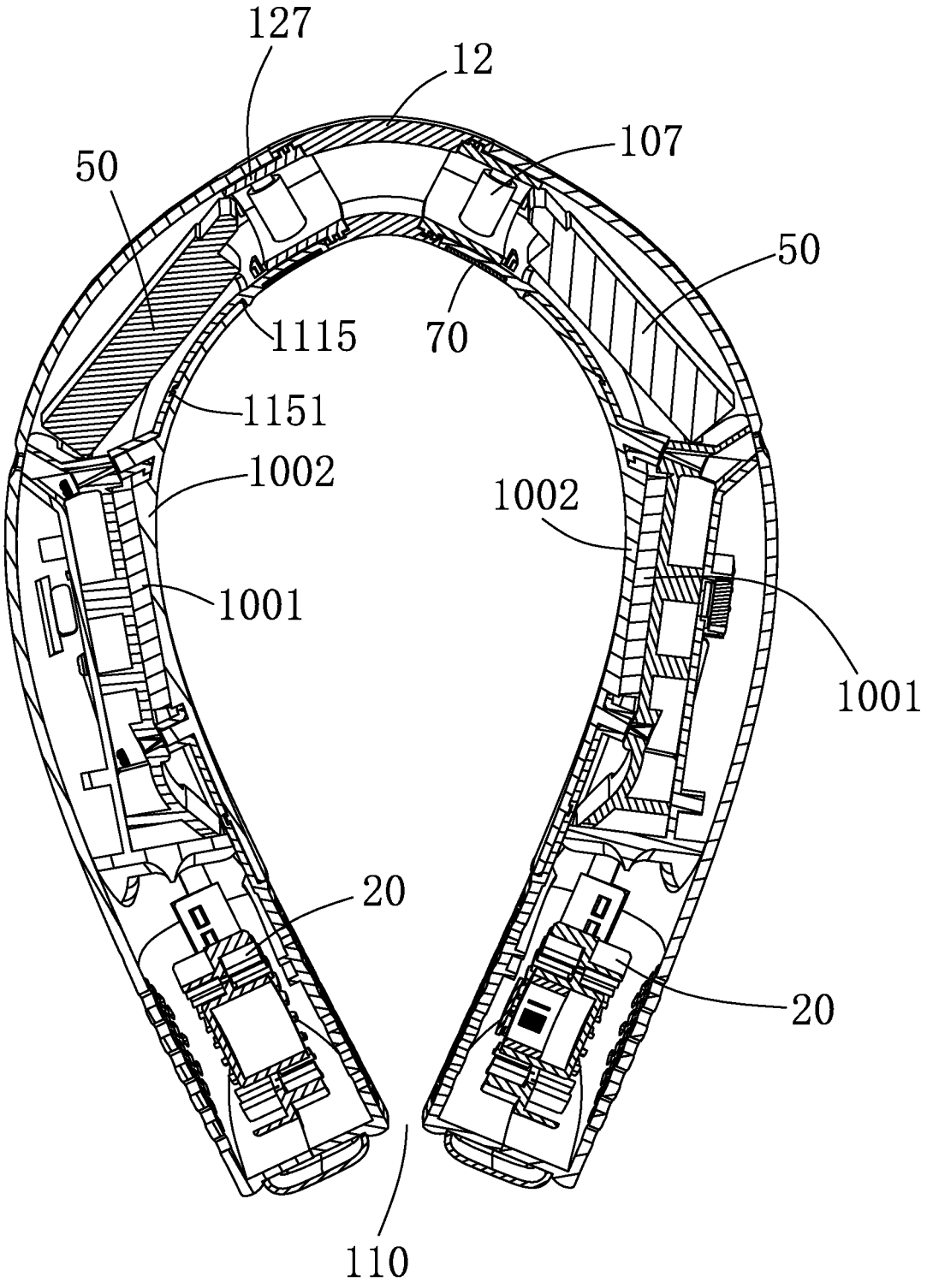
FIG. 38 is a cross section view of the portable blowing device shown in FIG. 35.

Further, the connecting section 12 includes a soft rubber sleeve 121 connected between the connecting ends of the two arms 13. The soft rubber sleeve 121 can be deformed after external force is applied. In the present embodiment, the soft rubber sleeve 121 is made of elastic material, such as rubber material, so that the soft rubber sleeve 121 can undergo elastic deformation after an external force is applied. The inner core 126 is received in the soft rubber sleeve 121. One end of each of the connecting members 127 close to the soft rubber sleeve 121 is integrally formed with and thus fixed in the soft rubber sleeve 121. The other ends of the two connecting members 127 are respectively connected in the connecting ends of the two arms 13, so that the inner core 126 and the soft rubber sleeve 121 are connected to the two arms 13 through the two connecting members 127. The outer surface of the soft rubber sleeve 121 is smoothly connected with the outer surface of the connecting end. The soft rubber sleeve 121 is curved, and the length of its inner side wall is less than that of its outer side wall (see FIGS. 35, 37 and 38 for details). That is, the longitudinal section (as shown in FIG. 38) of the soft rubber sleeve 121 is fan-shaped, and the length of the inner wall of the longitudinal section is shorter than that of the outer wall of the longitudinal section. When the arms 13 at opposite ends of the connecting section 12 are moved away from each other, the connecting section 12 is elastically deformed. After the arms 13 are released, the soft rubber sleeve 121 will return to its original state to thereby provide an elastic clamping/squeezing force to the arms 13. In some embodiments, the inner core 126 can be omitted, and the inner side wall of the arm 13 can be kept in close contact with the human body only by urging of the soft rubber sleeve 121. Preferably, a small gap exists between each of the two ends of the inner side wall of the soft rubber sleeve 121 and the connecting end of the corresponding arm 13, that is, the inner side wall of the soft rubber sleeve 121 does not fully contact with the connecting end of the arm 13, so that it is easier to move the two arms 13 away from each other and deform the connecting section 12. The soft rubber sleeve 121 is connected between the connecting ends of the arm 13. When the connecting section 12 is in the natural/original state, the outer surface of the soft rubber sleeve 121 is smoothly connected with the outer surface of the arm 13, which can maintain a smooth and aesthetic appearance for the whole body 10. After being stretched, the soft rubber sleeve 121 can elastically restore to its original state so that the inner side wall of the arm 13 connected to opposite ends of the soft rubber sleeve 121 can be kept in closely contacting with the skin of the wearing part of the human body to improve wearing stability. Optionally, the soft rubber sleeve 121 is provided with one or multiple arm members 221 such as plates, ribs or posts connected between its upper and lower inner surfaces. The multiple arm members 221 can be arranged inside the soft rubber sleeve 121 at intervals, which can strengthen the structural strength of the soft rubber sleeve 121 and separate the internal space of the soft rubber sleeve 121 into a plurality of channels for the wires connecting the electronic components installed in the two arms 13 to pass through. In other embodiments, the soft rubber sleeve 121 can also be made of other flexible and deformable materials and the connecting section 12 can realize elastic deformation and elastic restore through the inner core 126. The free ends of the two arms 13 are connected with decorative parts 137 respectively, so as to increase the aesthetics of the portable blowing device.

In some embodiments, the outer side wall of at least one of the arms 13 is provided with a switch button 90, and the part of the outer side wall corresponding to the switch button 90 is defined with a through hole 901. The switch button 90 includes a pressing part 911 located in the through hole 901 and an elastic arm 912 connected between the pressing part 911 and the edge of the through hole 901. The arm 13 is provided with a through hole 901 at the position corresponding to the switch button 90, and the pressing part 911 is suspended in the through hole 901 through the elastic arm 912, so that the switch button 90 possess elasticity and is convenient for the user to operate and press. Optionally, two switch buttons 90 are provided, including a first switch button and a second switch button. The first switch button is used to control the temperature regulation device 1001 to turn on the refrigeration mode, and the second switch button is used to control the temperature regulation device 1001 to turn on the heating mode. The body 10 is also provided with a speaker (not shown in the figure) for broadcasting sound. For example, the speaker is arranged in one of the arms 13, and the side wall of the arm 13 is correspondingly provided with a sound outlet. The sound emitted by the speaker can be transmitted out from the sound outlet. The first switch button and the second switch button are also used to jointly control the speaker to switch the language mode of broadcasting voice. For example, the language mode can include Chinese mode, English mode, Japanese mode and Korean mode. By touching or pressing the first switch button and the second switch button at the same time, the speaker can be controlled to switch among multiple language modes. In other embodiments, the two switch buttons 90 can also be arranged on the same arm 13. In this embodiment, the two switch buttons 90 are respectively arranged on the two arms 13 and electrically connected with the circuit board installed in the corresponding arm 13 to realize pressing operation of different functions, which can avoid mis-operation and facilitate operation of the user.

In some embodiments, the outer side wall of at least one of the arms 13 provided with the switch button 90 is further provided with a display window 119, and a display device is arranged at a position corresponding to the display window 119 in the corresponding arm 13. The display window 119 is made of transparent material (i.e. transparent area) or the display window 119 is an opening. The display device can be used to display at least one of the following information: power, gear and temperature. The user can observe the display information of the display device through the display window 119. The outer side wall of the corresponding arm 13 is further provided with a film sheet 136 which is used to cover the switch button 90, the through hole 901 and the display window 119. The film sheet 136 can protect the switch button 90, prevent the switch button 90 from being damaged, prevent dust and other sundries from entering the arm 13 via the gap around the switch button 90. The film sheet 136 can be a PET film and is fixed on the outer surface of the outer side wall of the arm 13 by injection molding. In the present embodiment, the outer side wall of each of the two arms 13 is provided with a film sheet 136 which covers most of the area of the outer wall of the arm 13. The portion of the film sheet 136 corresponding to the heat dissipation hole 173 is defined with a cutout 1361 for the heat dissipation hole 173 to be exposed.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A portable blowing device configured for being worn around a neck of a human body, comprising: two parts with a receiving space formed therebetween to allow the neck to be disposed therein; each of the two parts being provided with an airflow channel and a fan for generating an airflow to flow through the airflow channel; each of the two parts comprising an inner side wall facing the receiving space and an outer side wall opposite from the receiving space; and each of the two parts comprising a first air inlet defined at the inner side wall, a second air inlet defined at the outer side wall, and an air outlet which is in communication with the first and second air inlets via the airflow channel, the fan of each of the two parts being arranged at a position facing the corresponding first and second air inlets, wherein the air outlet of each of the two parts comprises a plurality of air outlet openings arranged along a circumferential direction of the receiving space, the air outlet openings in each of the two parts becoming smaller in diameter along a direction moving away from the corresponding fan.

2. The portable blowing device according to claim 1, further comprising a connecting section connected between the two parts, wherein the air outlet opening of each of the two parts closest to the connecting section is nearer to the connecting section than to the corresponding fan.

3. The portable blowing device according to claim 1, wherein ends of the inner side wall and the outer side wall of each of the two parts cooperatively form a chamber to receive the corresponding fan therein, the corresponding fan is a centrifugal fan, and the ends of the inner side wall and the outer side wall acting as a volute of the corresponding centrifugal fan.

4. The portable blowing device according to claim 1, wherein inner surfaces of ends of each of the two parts are spaced from blades of the corresponding fan to form a C-shaped gap around the corresponding fan in a circumferential direction of the corresponding fan, the gap being communicated with the corresponding airflow channel such that outside air is forced into the air inlets of each of the two parts and then forced to the C-shaped gap by the blades and finally to the airflow channel.

5. The portable blowing device according to claim 4, wherein the gap gradually widens in the circumferential direction of the fan; or the gap has two opposite ends arranged along the circumferential direction of the fan, a width of one of the two opposite ends being less than that of the other one of the two opposite ends.

6. The portable blowing device according to claim 1, wherein a plurality of ribs is provided in one of the air inlets to divide said one of the air inlets into a plurality of air inlet openings; and a cover is attached on an outer surface of one of the side walls to cover the ribs and the air inlet openings of said one of the air inlets.

7. The portable blowing device according to claim 1, wherein a plurality of ribs is provided in one of the air inlets to divide the one of the air inlets into a plurality of air inlet openings; and the corresponding fan comprises a plurality of blades arranged around the axis thereof, the blades at least partly overlapped with the air inlet openings in a direction parallel to the axis of the corresponding fan.

8. The portable blowing device according to claim 1, further comprising a connecting section connected between the two parts, wherein each of the two parts comprises a connecting end connected to one of two opposite ends of the connecting section, respectively;

a recessed portion is formed at one of the connecting ends of the two parts or at one of the two opposite ends of the connecting section, the recessed portion being sunken in a radial direction of the portable blowing device that extends from the receiving space to the outer side wall, the inner side wall and the outer side wall also being distributed in the radial direction of the portable blowing device; and wherein a cap is mounted to the recessed portion.

9. The portable blowing device according to claim 8, wherein a fastener extends through the recessed portion to fasten a corresponding one of the two opposite ends of the connecting section between the inner and outer side walls of a corresponding one of the two parts, the fastener being covered by the cap in the interior and exterior direction of the portable blowing device.

10. The portable blowing device according to claim 1, wherein each fan comprises a hub, an annular connecting plate around the hub and a plurality of blades extending from the annular connecting plate; and the annular connecting plate is spaced from the hub, a plurality of spokes are connected between the annular connecting plate and the hub, each of the spokes extends from the hub to the annular connecting plate in a direction that curves away from a radial direction of the hub which extends through a joint between the hub and a corresponding spoke.

11. The portable blowing device according to claim 1, wherein the housing defines a lengthwise direction extending around the neck of the human body and a width direction perpendicular to the lengthwise direction, and a size of the housing in the width direction decreases in a direction moving away from the fan and closer to a middle portion of the housing.

12. The portable blowing device according to claim 1, wherein the housing comprises a mounting section to which the fan is mounted, and the air inlet comprises multiple air inlet openings arranged around the mounting section.

13. The portable blowing device according to claim 1, wherein a size, in a height direction of the housing, of a cross section of the receiving chamber passing through an axis of the fan is greater than that, in the height direction of the housing, of an end of the airflow channel away from the fan.

14. A portable blowing device configured for being worn around a neck of a human body, comprising: two parts with a receiving space formed therebetween to allow the neck to be disposed therein; and a connecting section connected between the two parts; wherein each of the two parts is provided with an air inlet, an air outlet in communication with the air inlet, and a fan for generating an airflow to enter into the air inlet and exit from the air outlet; each of the two parts comprises an inner side wall facing the receiving space and an outer side wall opposite from the receiving space, the inner side wall and the outer side wall being distributed in a radial direction of the portable blowing device that extends from the receiving space to the outer side wall; each of the two parts comprises a connecting end connected to a respective connecting end of the connecting section; wherein the connecting ends of the parts or the connecting ends of the connecting section extend into the other of the connecting ends of the parts and the connecting ends of the connecting section to provide two pairs of adjacent connecting ends; and a fastener is inserted into at least one of the two pairs of adjacent connecting ends in the radial-direction of the portable blowing device to thereby fix the pair of adjacent connecting ends and prevent the pair of adjacent connecting ends from rotating relative to each other.

15. The portable blowing device according to claim 14, wherein each connecting end of the connecting section is sandwiched and fixed between the inner side wall and the outer side wall of a respective one of the two parts in the radial direction of the portable blowing device;

a positioning stud extends from one of the inner side wall and the outer side wall of the respective one of the two parts, the positioning stud defining a screw hole;

the other one of the inner side wall and the outer side wall of the respective one of the two parts defines a through hole; and the fastener is inserted through the through hole and fixed in the screw hole of the positioning stud.

16. The portable blowing device according to claim 14, wherein a recessed portion is formed at one of the two pairs of adjacent connecting ends, the recessed portion being sunken in the radial direction of the portable blowing device; and a cap is mounted to the recessed portion and the fastener is covered by the cap in the radial direction of the portable blowing device.

17. A portable blowing device configured for being worn around a neck of a human body, comprising:

two parts with a receiving space formed therebetween to allow the neck to be disposed therein; and a connecting section connected between the two parts;

wherein each of the two parts is provided with an air inlet, an air outlet in communication with the air inlet, and a fan for generating an airflow to enter into the air inlet and exit from the air outlet;

each of the two parts comprises an inner side wall facing the receiving space and an outer side wall opposite from the receiving space; and each of the two parts comprises a connecting end connected to one of two opposite ends of the connecting section, respectively;

a recessed portion is formed at one of the connecting ends of the two parts or at one of the two opposite ends of the connecting section, the recessed portion being sunken in a radial direction of the portable blowing device that extends from the receiving space to the outer side wall; and a cap is mounted to the recessed portion.

18. The portable blowing device according to claim 17, wherein each fan comprises a hub, an annular connecting plate around the hub and a plurality of blades extending from the annular connecting plate; and the annular connecting plate is spaced from the hub, a plurality of spokes are connected between the annular connecting plate and the hub, each of the spokes extends from the hub to the annular connecting plate in a direction that curves away from a radial direction of the hub which extends through a joint between the hub and a corresponding spoke.

19. The portable blowing device according to claim 17, wherein each connecting end of the connecting section is sandwiched and fixed between the inner side wall and the outer side wall of a respective one of the two parts to provide two pairs of adjacent connecting ends; a fastener is inserted into at least one of the two pairs of adjacent connecting ends to thereby fix the pair of adjacent connecting ends and prevent the pair of adjacent connecting ends from rotating relative to each other; and the fastener is covered by the cap.

* * * * *